US006213098B1

(12) United States Patent
Kato et al.

(10) Patent No.: US 6,213,098 B1
(45) Date of Patent: Apr. 10, 2001

(54) FUEL INJECTION DEVICE

(75) Inventors: Masaaki Kato; Satoru Sasaki, both of Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/653,258

(22) Filed: Aug. 31, 2000

(30) Foreign Application Priority Data

Aug. 31, 1999 (JP) ..... 11-245639
Oct. 29, 1999 (JP) ..... 11-308951
Feb. 15, 2000 (JP) ..... 2000-036678

(51) Int. Cl.[7] ..... F02M 41/00
(52) U.S. Cl. ..... 123/467; 123/300
(58) Field of Search ..... 123/467, 500, 123/501, 299, 300

(56) References Cited

U.S. PATENT DOCUMENTS 4,640,252 * 2/1987 Nakamura et al. ..... 123/446
4,798,186 * 1/1989 Ganser ..... 123/467
5,156,132 * 10/1992 Iwanaga ..... 123/496
5,458,293 10/1995 Ganser .
5,694,903 12/1997 Ganser .
5,771,865 * 6/1998 Ishida ..... 123/467
5,862,793 * 1/1999 Jay et al. ..... 123/467
5,979,410 * 11/1999 Grieshaber ..... 123/467
6,067,955 * 5/2000 Boecking ..... 123/299
6,085,719 * 7/2000 Heinz et al. ..... 123/300

FOREIGN PATENT DOCUMENTS 10-54323 2/1998 (JP) .
10-281038 10/1998 (JP) .

* cited by examiner

*Primary Examiner*—Carl S. Miller
(74) *Attorney, Agent, or Firm*—Nixon & Vanderhye P.C.

(57) ABSTRACT

A fuel injection device is composed of a valve member to open and close an injection hole, a high pressure passage for generating a basic pressure force to urge the valve member in a direction of opening the injection hole, an electromagnetic valve, first and second springs for generating biasing forces to urge the valve member in a direction of closing the injection hole, and first and second control chambers disposed in the fuel passages. The respective control chambers are communicated with the high pressure passage when the electromagnetic valve is not actuated and respective fuel pressure in the first and second control chambers urge the valve member in a direction of closing the injection hole, and the respective control chambers are communicated one after another at different timings to a low pressure conduit to reduce fuel pressure therein when the electromagnetic valve is actuated. With the device mentioned above, the valve member may be stepwise lifted to achieve variable fuel injection rate by controlling the control chambers in order to change a force balance with the basic pressure force and the biasing force.

32 Claims, 35 Drawing Sheets

FIG. 7A
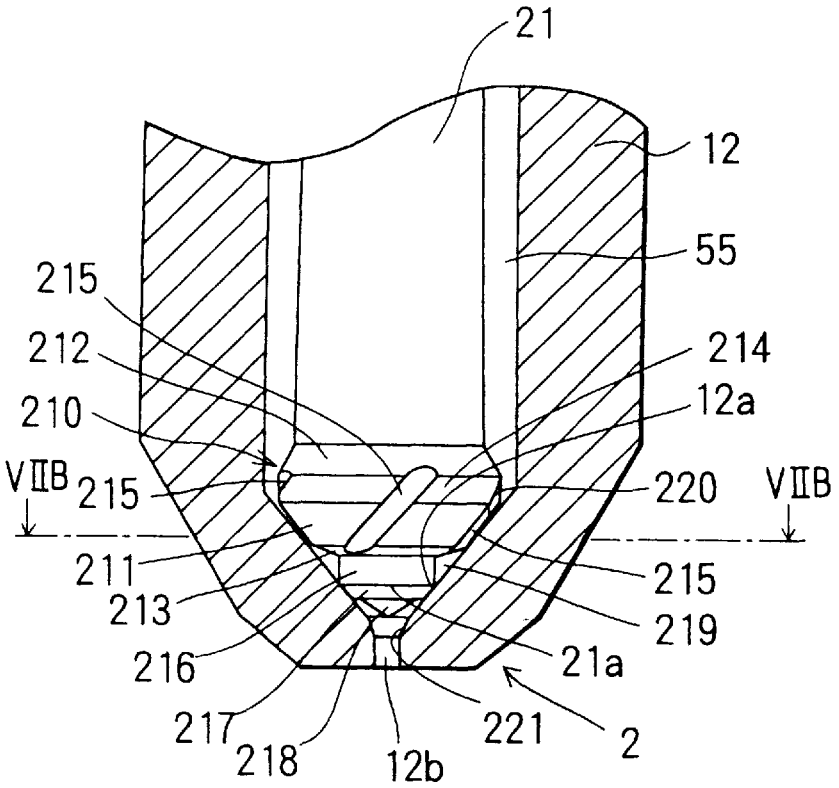
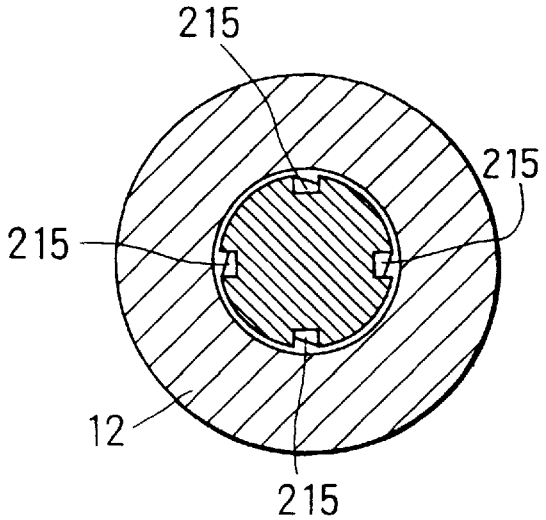
AT LOW LIFT h1
FIG. 7B
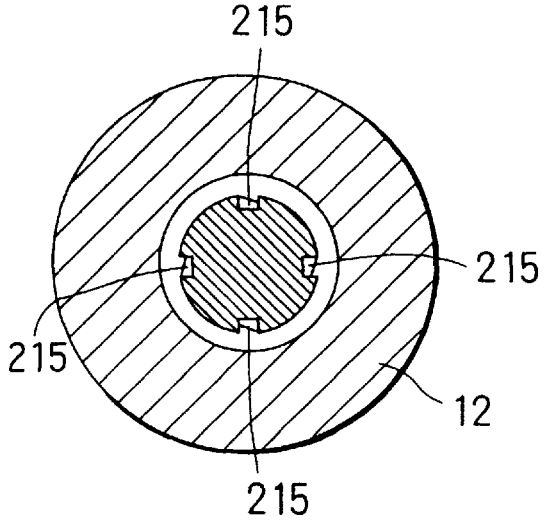
AT MAXIMUM LIFT (h2+h1)
FIG. 7C

FUEL INJECTION DEVICE

CROSS REFERENCE TO RELATED APPLICATION

This application is based upon and claims the benefit of priority of Japanese Patent Applications No. H.11-245639 filed on Aug. 31, 1999, No. H.11-308951 filed on Oct. 29, 1999 and No. 2000-36678 filed on Feb. 15, 2000, the contents of which are incorporated herein by reference.

BACKGROUND OF THE INVENTION

1. Field of the Invention

The present invention relates to a fuel injection device in which fuel may be stepwise injected.

2. Description of Related Art

Conventionally, in a fuel supply system in which fuel is supplied from a high pressure supply pump to an injector that is a fuel injection device, a technology that a needle lift is varied by a value of fuel pressure to change its injection characteristic has been proposed. Injection rate, atomization density and distribution behavior of fuel affect largely on fuel ignitability, formation of NOx, black smoke, HC and the like and combustion efficiency.

For example, well known is a nozzle with two-stage valve opening pressure that has two springs for biasing a needle with a predetermined needle lift interval. According to this technology, the needle lifts due to pressure of fuel delivered by a fuel injection pump. However, a value of pressure of fuel delivered to the fuel injection device from the fuel injection pump becomes variable according to engine operations. Therefore, it is difficult to always realize an optimum injection rate demanded by the engine over an entire range of engine operations.

To cope with this problem, an injector 230, as disclosed in U.S. Pat. No. 5,694,903 and shown in FIG. 42, is known. The injector 230 is provided with a control chamber 260 by which fuel pressure is applied to a needle 231 in a direction of closing an injection hole. A lift of the needle 231 is controlled by making a force acting in a direction of opening the injection hole due to fuel pressure transmitted to a fuel accumulating space 232 larger or smaller than a sum of forces receiving in a direction of closing the injection hole due to the fuel pressure of the control chamber 260 and biasing force of a spring 237. Even if the fuel pressure is varied according to the engine operations, regulating pressure of the control chamber 260 accurately controls an opening and closing timing by the needle 231.

Further, a lift of a pilot valve stem 270 is controlled with two steps by biasing forces of two springs 290 for urging the pilot valve stem 270 in a direction of closing the control chamber 260 and an attracting force of a coil 274. As a result, it is intended that the needle 231 is stepwise lifted to secure a predetermined fuel injection rate.

However, the conventional fuel injection device has a drawback that, even if the stem 270 is stepwise lifted, the needle is not always stepwise lifted simultaneously with the stem 270, since the needle 231 is lifted when a value of the fuel pressure of the fuel accumulating space 232 exceeds a sum value of pressure of the control chamber 260 and biasing force of the spring 237. Further, if the electromagnetic attracting force of the coil 274 is varied due to, for example, a change of temperature, a lifting characteristic of the stem 270 such as an opening area characteristic of the stem 270 is forced to change. Furthermore, due to a characteristic change of fuel such as viscosity, the pressure of the control chamber 260 is changed unstably. Accordingly, a lifting characteristic of the needle 231 is also changed so that the fuel injection rate may become unstable. Moreover, since a lifting control amount of the stem 270 is very small, it is difficult to secure a uniform quality in each of the injectors 230 so that an accurate and stable injection control may not be realized.

In the conventional fuel injection devices, though the injection rate may be variably controlled so far, it is impossible to realize a variable control of fuel atomization event such as atomization angle and droplets reaching distance.

Inadequate control of the atomization event causes to harm fuel consumption and an output so that NOx, black smoke, HC and the like may be more formed.

Further, as shown in JP-A-10-54323, well known is a fuel injection valve in which control valves are arranged at an inlet portion through which high pressure is introduced to the control chamber and at an outlet portion through which high pressure is released from the control chamber, respectively. With the plurality of control valves, the lift of the needle is stepwise controlled to obtain the stable lift control, while the leak amount can be reduced, since respective opening and closing controls of the inlet and outlet of the control chamber can be independently controlled.

However, the injection valve mentioned above still has a drawback that the valve becomes larger and is expensive since pluralities of electromagnetic valves are necessary.

SUMMARY OF THE INVENTION

An object of the present invention is to provide a fuel injection device in which fuel injection events may be accurately controlled according to engine conditions and the formation of NOx, black smoke and HC may be limited to improve the fuel consumption and the output.

To achieve the object, the injection device is composed of a valve member slidably movable in a valve body to open and close an injection hole, a high pressure fuel passage for generating a basic fuel pressure force to urge the valve member in a direction of opening the injection hole, fuel passages communicated with the high pressure fuel passage and to be communicated with a low pressure fuel conduit, control valve means disposed in the fuel passages, biasing means for generating a biasing force to urge the valve member in a direction of closing the injection hole, and a plurality of control chambers disposed in the fuel passages.

The respective plurality of control chambers are communicated with the high pressure passage when the control valve means is not actuated and respective fuel pressure in the plurality of control chambers are used as chamber fuel pressure forces to urge the valve member in a direction of closing the injection hole, and the respective control chambers are communicated one after another at different timings to the low pressure conduit to reduce fuel pressure therein when the control valve means is actuated.

With the device mentioned above, the valve member may be stepwise lifted to achieve variable fuel injection rate by controlling one after another at different timings the chamber fuel pressure force from selected any one of the plurality of control chambers that is applied to the valve member in order to change a force balance with the basic fuel pressure force and the biasing force that are then applied to the valve member.

According to the fuel injection device mentioned above, even if fuel pressure to be introduced into the device is varied according to engine operating conditions, a timing of the valve member for opening and closing the injection hole may be accurately controlled.

It is preferable for the accurate stepwise lifting of the valve member that the biasing means comprises a first biasing element for generating first biasing force to urge the valve member in a direction of closing the injection hole irrelevantly to a lifting amount of the valve member and a second biasing element for generating second biasing force to urge the valve member in a direction of closing the injection hole after the valve member has established a predetermined lifting amount.

Preferably, the valve member comprises a needle to be seated on the valve seat and a transmitting element provided on an opposite side to the injection hole with respect to the needle for transmitting the biasing force and the chamber fuel pressure forces of the plurality of control chambers to the needle. The transmitting element may be an element integrated into one body having a plurality of cross sectional areas, whose largeness are different from each other, for receiving respective fuel pressure from the plurality of control chambers, or an element separated into a plurality of bodies having respective cross sectional areas, whose largeness are different from each other, for receiving fuel pressure respectively from the plurality of control chambers.

Further, the transmitting element preferably has separated areas for receiving fuel pressure from the respective plurality of control chambers. If more than two of the control chambers and the corresponding biasing means are provided, the valve member may move with more than two stage stepwise lifting.

The respective plurality of control chambers are formed on an axis same as that of the transmitting element so that a small fuel injection device may be realized.

Furthermore, it is preferable in view of compactness of the device that the biasing means is located in one or the plurality of control chambers.

An area of the valve member which receives fuel pressure from selected any of the plurality of control chambers for producing the chamber fuel pressure force is larger than an area of the valve member which receives fuel pressure from the high pressure passage for generating the main fuel pressure force, when the valve member is seated on the valve seat, and the area of the valve member which receives fuel pressure from selected any of the plurality of control chambers for producing the chamber fuel pressure force becomes smaller than the area of the valve member which receives fuel pressure from the high pressure passage for generating the main fuel pressure force, when the valve member lifts in a direction away from the valve seat. Accordingly, as a speed at which the valve member is seated on the valve seat is limited, a valve closing shock may be eased.

Preferably, the control valve means has a plurality of moving members which are operative to open and close fuel passages on a side of the low pressure conduit with respect to the respective plurality of control chambers. As the respective control chambers may be independently and stepwise controlled so that the valve member is lifted stepwise.

Further, it is preferred that the plurality of moving members are provided on a common axis and have control valve springs for biasing the respective plurality of moving members in a direction of closing the fuel passages to be communicated to the low pressure conduit, the plurality of moving members being operative at respective different timings to open the fuel passages on a side of the low pressure conduit with respect to the plurality of control chambers against the biasing forces of the control valve springs. With this construction, the injection device becomes compact and the respective pressure of the control chambers may be highly accurately controlled.

In a case that the plurality of the control chambers comprise first and second control chambers for producing the chamber fuel pressure forces to urge the valve member in a direction of closing the injection hole, the plurality of the control valve means comprise first and second moving members and first and second control valve springs, and the first moving member is slidably and reciprocatingly held in the second moving member in such a manner that, at first, the first moving member comes in contact with the second moving member in a predetermined lifting stroke after the first moving member moves to open the fuel passage on a side of the low pressure conduit with respect to the first control chamber and, then, the first moving member together with the second moving member further moves so that the fuel passage on a side of the low pressure conduit with respect to the second control chamber may be opened by the second moving member. With this construction, the injection valve becomes compact because one driving source serves to lift the respective moving members.

The valve member may establish a first lifting amount in a low to middle speed range or a low to middle load range as engine operating conditions, and a second lifting amount larger than the first lifting amount in a high speed range or a high load range as engine operating conditions. According to the engine operating conditions, optimum fuel injection rate may be selected.

Furthermore, the valve member may change stepwise a lifting amount from the first lifting amount to the second lifting amount within a fuel injection period when the engine operating conditions show a change from the low speed range to the high speed range or a change from the low load range to the high load range. As an optimum injection rate may be realized within a fuel injection period, Generation of NOx, HC and black carbon may be limited.

Moreover, the valve member may be moved to inject fuel with optimum numbers of injections in a cycle of engine and in an optimum lifting state of the valve member and for an optimum injection period in each injection, when engine operating conditions are changed from one to another or the valve member may be moved to inject fuel with optimum numbers of injections in a cycle of engine and in an optimum lifting state of the valve member during whole ranges of engine operating conditions. These control result in reducing generation of NOx, HC and Black carbon.

Preferably, the plurality of control chambers comprise first and second control chambers and the second control chamber is communicated with the high pressure passage. The valve member comprises a needle to be seated on the valve seat and first and second pistons for forming the first and second control chambers on an opposite side to the injection hole with respect to the needle for transmitting the chamber fuel pressure forces from the first and second control chambers to the needle. The control valve means has a valve chamber formed in the fuel passages, a control valve movable in the valve chamber and an electrically controlled device for driving stepwise the control valve. The valve chamber has a first opening communicated with the fuel passage leading to the first control chamber, a second opening communicated with the fuel passage leading to the second control passage and a low pressure opening to be communicated to the low pressure conduit.

With this construction, a fuel communication between the first and low pressure openings and a fuel communication between the second and low pressure openings are sequentially controlled by the stepwise moving of the control valve so that the chamber fuel pressure forces of the first and second control chambers may be changed. As the first and second pistons work with the valve member for controlling stepwise the valve member, variable injection rate may be secured.

The control valve closes the low pressure opening when the electrically controlled device is not actuated. High pressure fuel of the high pressure passage is introduced via the second opening to the valve chamber and, then, high pressure fuel is transmitted via the first opening to the first control chamber. The high pressure passage communicated with the second control chamber is communicated to the valve chamber in which the low pressure opening is closed. Therefore, the first and second pistons are urged in a direction of closing the injection valve by high pressure fuel of the first and second control chambers. The needle, which is also urged in a direction of closing the injection hole by the biasing means, is seated on the valve seat.

Next, the control valve opens the low pressure opening when the electrically controlled device is actuated to drive the control vale during a first lifting stroke so that the first and second control chambers may be communicated to the low pressure conduit. Accordingly, fuel pressure of the first and second control chamber is changed from a high pressure state to a low pressure state to drive the first and second pistons as follows.

The first piston lifts and comes in contact with the second piston (first lifting amount) and the first piston further lifts along with the second piston (second lifting amount). The needle lifts by an amount corresponding to first and second lifting amounts of the first and second pistons so that the needle moves apart from the valve seat to inject fuel from the injection hole.

Then, the control valve closes the second control chamber when the electrically controlled device is further actuated to drive the control valve during a second lifting stroke so that the communication of the second control chamber to the low pressure conduit may be interrupted, while the communication of the first control chamber via the valve chamber to the low pressure conduit may be maintained. As high pressure of the second control chamber is maintained for urging the second piston in a direction of closing the injection hole, the first piston comes in contact with the second piston and stops at that position so that the needle moves by the first lifting amount to inject fuel from the injection hole.

In a case that, when the control valve lifts the second lifting stroke and the first piston moves by the first lifting amount, the communication between the high pressure passage and the low pressure conduit is interrupted as the second opening is closed. Therefore, the fuel pump effectively works without circulating excessive high pressure fuel so that fuel consumption of engine may be improved.

Further, it is preferable that the biasing means comprises a first biasing element for generating first biasing force to urge the valve member in a direction of closing the injection hole irrelevantly to a lifting amount of the valve member and a second biasing element for generating second biasing force to urge the valve member in a direction of closing the injection hole after the valve member has established a predetermined lifting amount. The first biasing element serves to prevent the needle apart from the valve seat when the first and second control chambers are communicated to the low pressure conduit and urging forces of the pistons to the needle in a direction of closing the injection hole are reduced. The second biasing element serves to prevent the second piston from upwardly moving due to an inertia force based on lifting the first piston when the first piston comes in contact with the second piston. Therefore, a stable injection may be secured.

If the low pressure opening is closed when the control valve is at a position in the valve chamber most near the electrically control device, fuel leakage through a clearance necessary for sliding the control valve in the electrically control device may be reduced since the clearance is located under low fuel pressure circumstances.

It is preferable that the fuel passage between the second control chamber and the second opening is provided with a first throttle for regulating fuel flow and with the fuel passage for communicating the second control chamber to the high pressure passage on a side of the second control chamber relative to the first throttle. The construction has a merit that one of the throttles may be eliminated, compared with the construction in which high pressure is introduced from the high pressure passage via the second control chamber to the first control chamber. The one elimination of the throttles results in supplying fuel smoothly and rapidly to the first control chamber, thus resulting in increasing the downward speed of the needle for closing the injection hole so that the response ability of the valve member may improve.

BRIEF DESCRIPTION OF THE DRAWING

Other features and advantages of the present invention will be appreciated, as well as methods of operation and the function of the related parts, from a study of the following detailed description, the appended claims, and the drawings, all of which form a part of this application. In the drawings:

FIG. 7A is an enlarged view of a nozzle portion with respect to the injector shown in FIG. 1;

FIG. 7B is a cross sectional view taken along a line VIIB—VIIB of FIG. 7A at a low lift;

FIG. 7C is a cross sectional view of FIG. 7B at a maximum lift;

DETAILED DESCRIPTION OF THE PREFERRED EMBODIMENTS (First Embodiment)

Figure 1:
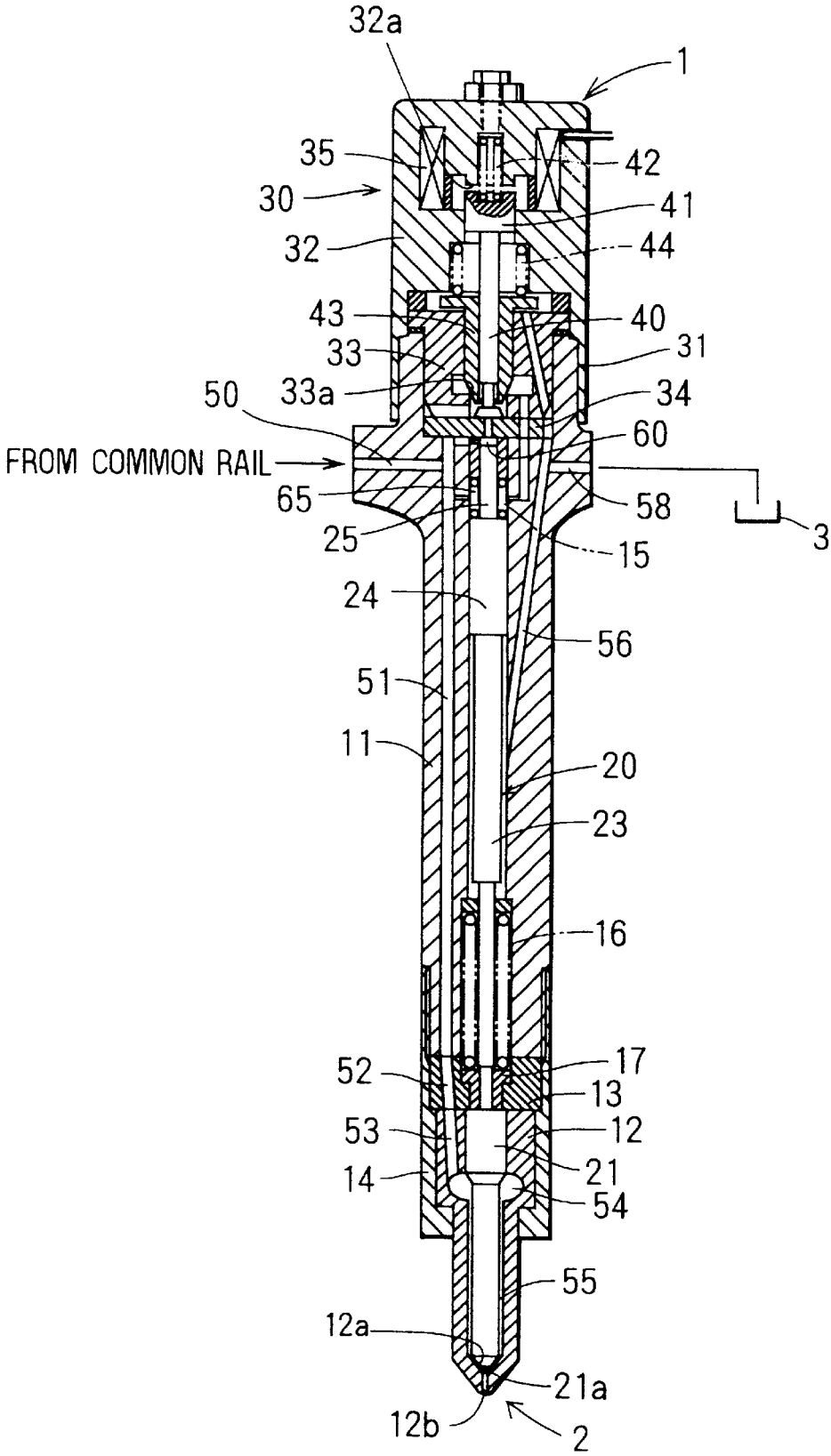
FIG. 1 is a cross sectional view of an injector according to a first embodiment of the present invention.

FIG. 1 shows an injector 1 as a fuel injection device according to a first embodiment of the present invention. The injector 1 is installed in an engine head (not shown) of an engine for directly injecting fuel in each cylinder of the engine. High pressure fuel discharged from a fuel injection pump is accumulated to a predetermined pressure in a pressure accumulating chamber of a pressure accumulating pipe (not shown) and is sullied to the injector 1. A discharge pressure of the fuel injection pump is adjusted according to engine revolution, load, intake fuel pressure, intake air volume and coolant temperature.

In the injector 1, a valve body 12 is fastened via a tip packing 13 to a housing 11 by a retaining nut 14. A valve element 20 is composed of, from a side of an injection hole 12*b* in order, a needle 21, a rod 23, a control piston 24 and a control piston 25. The rod 23 and control pistons 24 and 25 constitute a transmitting element.

Figure 2:
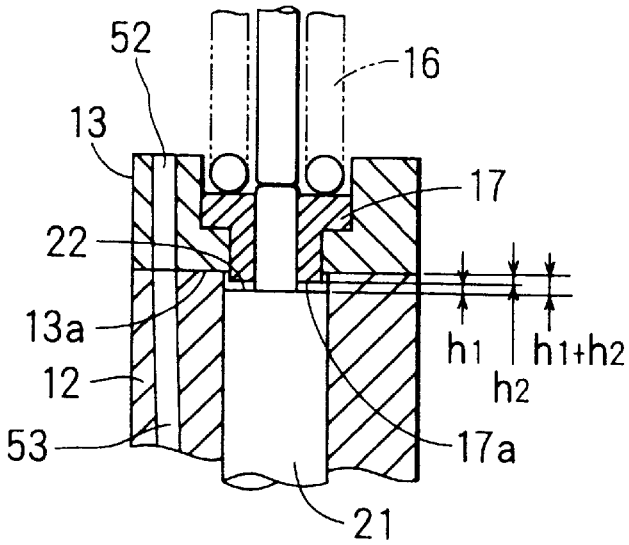
FIG. 2 is a partly enlarged view of the injector shown in FIG. 1.

The needle 21 is held by the valve body 12 so as to make a reciprocating movement therein. The needle 21 is urged to a valve seat 12*a* formed in the valve body 12 via the control pistons 25 and 24 and the rod 23 by a first spring 15, as first biasing means. The first spring 15 is housed in a second control chamber 65 on a same axis as the control piston 25. An initial preload of the first spring 15 is Fs1 and a spring constant thereof is K1. A second spring 16, as second biasing means, is fitted around a circumference of the rod 23 in the housing 11 on a same axis as the rod 23 and presses a spring seat 17 against the tip packing 13. An initial preload of the second spring 16 is Fs2 and a spring constant thereof is K2. As shown in FIG. 2, when the spring seat 17 is seated on the tip packing 13, a clearance between a lower end surface 17*a* and s shoulder portion 22 of the needle 21 has a length h1, which constitutes a first lifting amount. Further, when the spring seat 17 is seated on the tip packing 13, the lower end surface 17*a* of the spring seat 17 protrudes out of a lower end surface 13*a* by a length h2, which constitutes a second lifting amount. Therefore, a maximum lifting amount of the needle 21 is a length h1+h2.

As shown in FIG. 1, an electromagnetic valve 30 is fastened to an upper part of the housing 11 by a nut 31. The electromagnetic valve is composed of an armature 32, a body 33, a plate 34, a coil 35, a first control valve 40, a second control valve 43, the first spring 42 and the second spring 44. The first and second control valves 40 and 43 are movable members.

Figure 4:
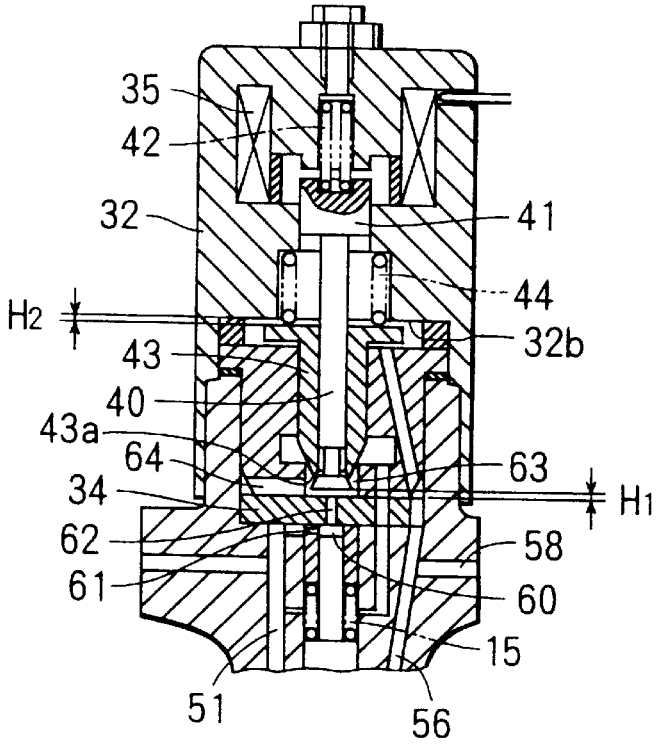
FIG. 4 is a part view of the injector shown in FIG. 1 for explaining a first lift stroke of a control valve.
Figure 5:
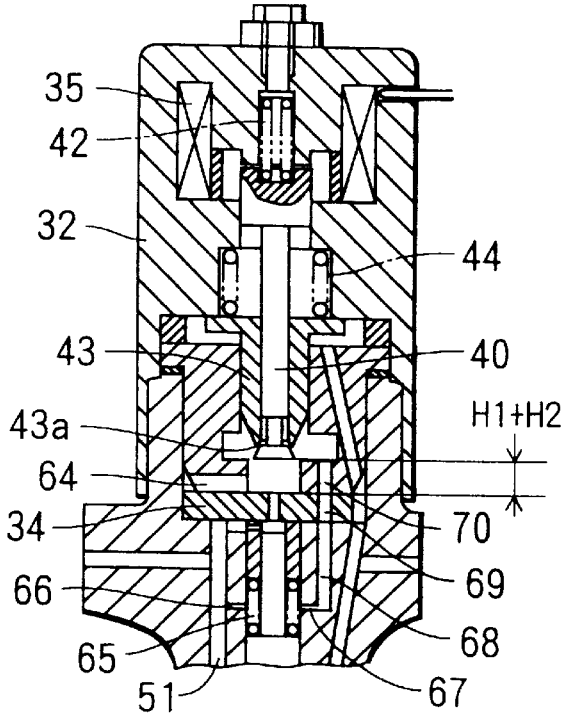
FIG. 5 is a part view of the injector shown in FIG. 1 for explaining a second lift stroke of a control valve.

The second control valve 43 may be seated on a valve seat 33*a* formed on the body 33 by a biasing force of the second spring. The second control valve 43 is formed in a cylindrical shape and has a through hole penetrating in an axial direction. The first control valve 40 is held by an inner circumferential wall of the second control valve 43 so as to make a reciprocal movement therein. The first and second control valves are arranged on a same axis. The first control valve 40 may be seated on the plate 34 by a biasing force of the first spring 42. The core 41 located above the first control valve 40 is attracted to an end surface 32*a* of the armature 32 against the biasing force of the first spring 42 by a magnetic attracting force exerted on energizing the coil 35. As shown in FIG. 4, the first lifting amount H1 corresponds to a moving distance of the first control valve 40, which is upward lifted until the first control valve 40 comes in contact with an end 43*a* of the second control valve 43. When a larger current is supplied to the coil 35, the force attracting the core 41 of the first control valve 40 becomes stronger so that both the first and second control valves 40 and 43 may be upward lifted against the sum of biasing forces of the first and second springs 42 and 44 and stops when the second control valve 43 comes in contact with a stopper 32*b* of the armature 32. The second lifting amount H2 corresponds to a moving distance of the second control valve 43 after the first control valve 40 comes in contact with the second control valve 43 and until the second control valve 43 comes in contact with the stopper 32*b* of the armature 32. The maximum lifting amount of the first control valve 40 is h1+h2.

Figure 3:
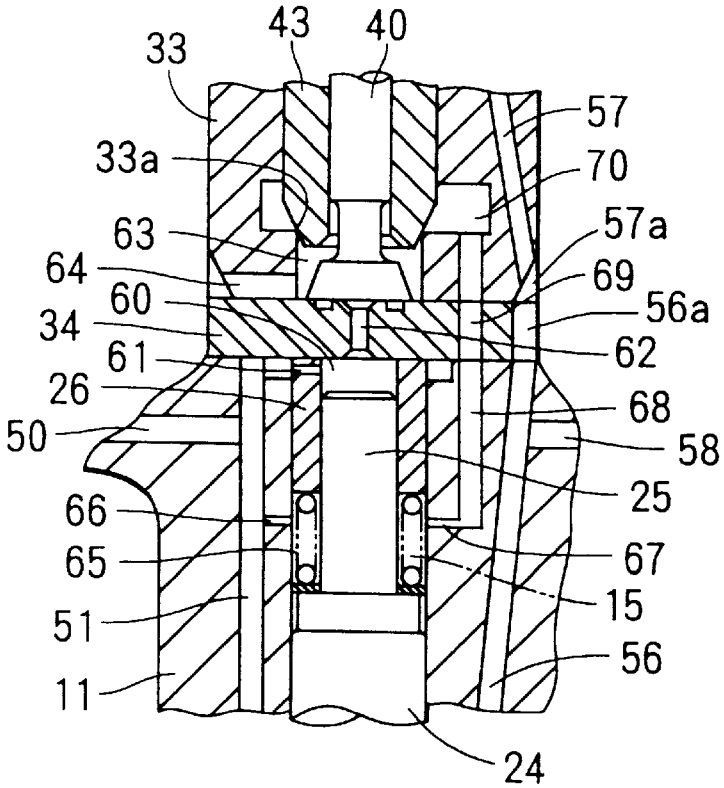
FIG. 3 is a partly enlarged another view of the injector shown in FIG. 1.

As shown in FIG. 3, an inlet throttle 61 and an outlet throttle 62 are respectively communicated with the first control chamber 60, as a pressure chamber. A passage area of the outlet throttle 62 is larger than that of the inlet throttle 61. The outlet throttle 62 is a fuel passage to be communicated with a low pressure side. The inlet throttle 61 is formed in a liner 26, which is press fitted or closely fitted to the housing 11, and is communicated with a fuel passage 51. High pressure fuel is supplied via a fuel in-flow passage 50, the fuel passage 51 and the inlet throttle 61 to the first control chamber 60. The outlet throttle 62 is formed in the plate 34 put between the body and the housing 11 and is communicated with a fuel chamber 63.

An inlet throttle 66 and an outlet throttle 67 are respectively communicated with the second control chamber 65, as another pressure chamber. A passage area of the outlet throttle 67 is larger than that of the inlet throttle 66. The inlet throttle 66 is communicated with the fuel passage 51 and high pressure fuel is supplied via the fuel in-flow passage 50, the fuel passage 51 and the inlet throttle 66 to the second control chamber 65. The outlet throttle 67 is communicated with a fuel passage 68. The outlet throttle 67, the fuel passage 68 and fuel passages 69 and 70 constitute fuel passages to be communicated with a low pressure side.

When the first control valve 40 opens the outlet throttle 62, the high pressure fuel in the first control chamber 60 is evacuated via the outlet throttle 62, the fuel chamber 63 on a low pressure side, fuel passages 64, 57*a* and 56*a* and a fuel out-flow passage 58 to a fuel tank 3. The fuel passage 57 is formed around the body 33 to communicated with the fuel passage 64 and is communicated via the fuel passage 56*a* provided in the plate 34 to the fuel passage 56. The fuel passage 56, which is opened to a circumference of the rod in the housing 11, is used to evacuate low pressure fuel in the housing 11 to the fuel tank 3.

When the second control valve 43 is apart from the valve seat 33*a* of the body 33 and opens the fuel passage 70, high pressure fuel in the second control chamber 65 is evacuated via the outlet throttle 67, the fuel passages 68, 69 and 70, the fuel chamber 63, the fuel passages 64, 57*a*, 56*a*, and the fuel out-flow passages 58 to the fuel tank 3. A fuel passage 57, which is communicated with the fuel passage 57*a* formed in the body 33, is opened to an inside of the electromagnetic valve 30 where the second spring 44 is housed and is used to evacuate low pressure fuel in the inside of the electromagnetic valve 30 via the fuel passages 57*a* and 56*a* to the fuel tank 3.

The control piston 24 is closely fitted to the housing 11. The control piston 25, which is located on an opposite side of the injection hole relative to the control piston 24, is closely fitted to the liner 26 and faces to the first control chamber 60. A lower part of the control piston 24 is in contact with the rod 23. One end of the first spring 15 is in contact with the liner 26 and the other end thereof is retained by the control piston 25. The control pistons 24 and 25, which are provided separately, may be integrated as one body. Further, the control piston 24 may be integrated with the rod 23.

A sum of an area Ap1, on which the control pistons 24 and 25 receive fuel pressure from the first control chamber 60, and an area Ap2, on which the control pistons 24 and 25 receive fuel pressure from the second control chamber 65, is larger than a cross sectional area of a guide portion of the needle 21 which slides the valve body 12, that is, a cross sectional area Ag of a bore of the valve body 12 in which the needle 21 is housed. High pressure fuel supplied from the pressure accumulating pipe (not shown) is transmitted via the fuel in-flow passage 50 formed in the housing 11, the fuel passage 51, a fuel passage formed in the tip packing 13, a fuel passage 53 formed in the nozzle body 12, the fuel accumulating space 54 and a fuel passage around the needle 21 to a valve portion 2 formed by the needle 21 and the valve seat 12*a*.

Next, detail construction of the valve portion 2 is described. As shown in FIG. 7A, a contacting portion 21*a*, which is provided at a leading end of the needle 21 may be seated on the valve seat 12*a* of the valve body 12. The valve portion 2 is composed of the contacting portion 21*a*, a circular force generating portion 210, a swirl chamber 219 and the injection hole 12*b*. The circular force generating portion 210 is constituted by conical faces 211, 212 and 213 formed at an outer circumference of the needle 21, a cylindrical face 214 and a plurality of oblique grooves 215. The conical face 211 is formed with a conical angle that is slightly smaller than or same as that of a seat face 220.

The circular force generation portion 210 is not limited to the construction mentioned above for securing functions and effects mentioned below, but may be a construction such that a conical face is formed in the valve body 12 such as the seat face 220, a conical face is also formed at the outer circumference of the needle 21 such as the conical face 211 so as to face to the conical face on a valve body side, and oblique grooves are provided in one of the conical faces on the needle side and on the valve body side. Both of the conical faces may be replaced with both of spherical surfaces.

The swirl chamber 219 is constituted by the seat face 220 of the valve body 12 and both of a conical face 213 and a cylindrical face 216, which are positioned at the needle 21 on a downstream of the circulation force generating portion 210. The swirl chamber 219 is not limited in the shape mentioned above and the cylindrical face 216 may be replaced with a conical face, a composite cylindrical and conical surface or a spherical surface. The contacting portion 21*a* of the needle 21 may be seated on the valve seat 12*a* by a biasing force of the first spring in a direction of closing the injection hole. On the other hand, the contacting portion 21*a* of the needle 21 receives a force due to the fuel pressure in the fuel passage 55 in a direction apart from the valve seat 12*a,* that is, in a direction of opening the injection hole. A flow passage at a downstream of the contacting portion 21*a* is provided with the seat face 220 and conical faces 217 and 218 of the needle 21. A conical angle of the conical face 217 is larger than that of the seat face 220 and a conical angle of the conical face 218 is larger than that of the conical face 217. The valve body 12 is provided with a conical face 221 that is continuously changed from the seat face 220 to constitute the flow passage communicated to the injection hole 12*b*. The conical faces 217 and 218 may be one surface having a same conical angle. Further, the seat face 220 and the conical face 221 may be one conical face having a same angle as the seat face 220 or a curved surface such as an arc.

Next, an operation of the injector 1 is described. Fuel discharged from the fuel injection pump (not shown) is delivered to the accumulating pipe (not shown). The high pressure fuel, pressure of which is accumulated to a predetermined value by the accumulating chamber in the accumulating pipe, is supplied to the injector 1. Current for driving the control valve, a value of which is controlled by an engine control apparatus (ECU) according to engine operations, is supplied to the coil 35 of the electromagnetic valve 30. The electromagnetic attracting force of the coil exerted by the current supply attracts the first control valve 40 against the biasing force of the first spring 42. Then, the outlet throttle 62 is opened so that the first control chamber 60 is communicated via the outlet throttle 62 with the fuel chamber 63 on a side of low pressure. As the passage area of the outlet throttle 62 is larger than that of the inlet throttle 61, the volume of the out-flow fuel is larger than that of the in-flow fuel so that the fuel pressure Pc1 of the first control chamber 60 begins to decrease. The pressure decreasing speed may be adequately set by adjusting a difference of the passage areas between the outlet and inlet throttles 62 and 61 and a volume of the first control chamber.

When the pressure in the first control chamber 60 is decreased and the sum of the pre-loaded force of the first spring 15 and the force received from the fuel pressure of the first and second control chambers 60 and 65, both of which act in a direction of closing the injection hole, becomes lower than a force of moving upwardly the needle 21, the needle 21 begins to open the injection hole. If the electromagnetic attracting force exerted by holding current IH1 supplied to the coil 35 is smaller than the sum of biasing forces of the first and second springs 42 and 44, the first control valve 40 stops at a position showing the first lifting amount H1, as shown in FIG. 1.

Next, force acting on the needle 21 is described.

(1) When the lifting amount h of the needle 21 is less than the first lifting amount h1 (h>h1):

① At a valve closing by needle (h=0);

A valve closing force Fc1 is a sum of a force Fct acting on the valve element 20 in a direction of closing the injection hole due to the fuel pressure Pct of the first and second control chambers 60 and 65 and an initial pre-loaded force Fs1 of the first spring 15. That is, Fc1=Fct+Fs1=Pct×Ap+Fs1 and, further, Pct×Ap=Pc1×Ap1+Pc2×Ap2 where Pc1 is pressure of the first control chamber 60, Pc2 is pressure of the second control chamber 65, Ap1 is an area of the valve element 20 receiving fuel pressure from the first control chamber 60 in a direction of closing the injection hole, and Ap2 is an area of the valve element 20 receiving fuel pressure from the second control chamber 65 in a direction of closing the injection valve. There is a relation, Ap=Ap1+Ap2.

A valve opening force Fo is a force Fd acting on the needle 21 due to fuel pressure in a direction of opening the injection hole, that is, Fo=Fd=Pd (Ag−As) where Pd is fuel pressure in the fuel passage 55 and As is an area of the valve seat 12*a* on which the needle 21 is seated.

A force F applied to the needle 21 is shown by the following formula (1).

$$F=Fo-Fc1=Pd(Ag-As)-Pct\times Ap-Fs1 \quad (1)$$

② At a valve opening by needle (o<h<h1);

When fuel pressure of the first control chamber 60 is decreased and the needle valve 21 is moved apart from the valve seat 12*a,* a spring force Fs becomes Fs=Fs1+K1×h by adding a force corresponding to a contraction h of the first spring 15. Accordingly, the valve closing force Fc1 is Fc1=Fct+Fs=Fct+Fs1+K1×h and the valve opening force Fo=Fd=Pd×Ag. The force F applied to the needle 21 is shown by the following formula (2).

$$F=Fo-Fc1=Pd\times Ag-Fct-Fs1-K1\times h \quad (2)$$

The area of the valve element 20 receiving fuel pressure, which is equal to the area Ap receiving fuel pressure from the first and second control chambers 60 and 65 minus the area Ap1 receiving fuel pressure from the first control chamber 60 where the fuel pressure is reduced, that is, the area Ap2 receiving fuel pressure from the second chamber 65, is smaller than Ag.

(2) When the lifting amount h of the needle 21 is equal to or more than the first lifting amount h1 (h1≦h): The spring force Fs is Fs=K1×h+Fs1+K2(h−h1)+Fs2 by adding the initial pre-loaded force Fs2 and a force due to the contraction of the second spring 16. The valve closing force Fc1 is Fc1=Fct+Fs=Pct×Ap+K1×h+Fs1+K2(h−h1)+Fs2. The valve opening force Fo is Fo=Fd=Pd×Ag. The force F applied to the needle 21 is shown by the following formula (3).

$$F=Fo-Fc1=Pd\times Ag-Pct\times Ap-K1\times h-Fs1-K2(h-h2)-Fs2 \quad (3)$$

Next, forces acting on the first and second control valves 40 and 43 are described.

(1) At a valve closing time when the lifting amount H of the first control valve is zero (H=0):

A valve closing force Fvcl acting on the first valve 40 is only an initial pre-load Fvs1 of the first spring 42, that is, Fvc1=Fvs1. Valve opening force acting on the first control valve 40 is a valve opening force Fvo1 which the first control valve 40 receives from the fuel pressure Pc1 of the first control chamber 60, that is, Fvo1=Ao1×Pc1 where Ao1 is an opening area of the outlet throttle 62. A force Fv1 applied to the first control valve 40 is shown by the following formula (4).

$$Fv1=Fvo1-Fvc1=Ao1\times Pc1-Fvs1 \quad (4)$$

A valve closing force Fvc2 acting on the second valve 43 is an initial pre-load Fvs2 of the second spring 44, that is, Fvc1=Fvs1. A valve opening force Fvo2 acting on the second control valve 43 is a valve opening force which the second control valve 43 receives from the fuel pressure Pc2 of the second control chamber 65, that is, Fvo2=Ao2×Pc2 where Ao2 is an area on which the second control valve seated on the valve seat 33*a* receives the fuel pressure of the second control chamber 65. The force Fv2 applied to the second control valve 43 is shown by the following formula (5).

$$Fv2=Fvo2-Fvc2=Ao2\times Pc2-Fvs2 \quad (5)$$

At H=0, the first and second control valves 40 and 43 do not receive a force from each other.

(2) When only the first control valve 40 is lifted (0<H<H1):

A magnetic attracting force Fm1 exerted by the holding current IH1 supplied to the coil 35, which is applied to the first control valve 40, caused the first control valve 40 to lift from the plate 34. As the initial pre-load Fvs1 and the force due to the contraction of the first spring 42 is applied to the control valve 40 as the valve closing force, the valve closing force Fvc1 acting on the first control valve 40 is Fvc1=Fvs1+K1×H. The valve opening force Fvo1 thereof is the magnetic attracting force Fm1 and a force that the first control valve 40 receives from the fuel pressure Pv1 of the fuel chamber 63 on an area counterbalanced by its upper and lower pressure receiving areas. At H>0, the fuel pressure Pv1 of the first control chamber 60 affects via the outlet throttle 62 on the fuel pressure Pv1 of the fuel chamber 63, unless the fuel pressure Pv1 is low. However, the fuel chamber 63 is opened via the fuel passages 64, 57*a* and 56*a* and the fuel out-flow passage 58 to the fuel tank 3 so that the fuel pressure of the fuel chamber 63 is almost equal to atmospheric pressure, that is, negligible pressure. A sum of the valve opening force is Fvo1=Fm1+Avo1×Pv1. The force Fv1 applied to the first control valve 40 is shown by the following formula (6).

$$Fv1=Fvo1-Fvc1=Fm1+Avo1\times Pv1-Fvs1-K1\times H \quad (6)$$

At this time, the force applied to the second control valve 43 is same to that shown in the formula (5).

(3) When the first and second control valves 40 and 43 are lifted (H1≦H):

A magnetic attracting force Fm2 exerted by the second holding current IH2 supplied to the coil 35 is applied to the first control valve 40. A valve closing force applied to the first control valve 40 is Fvs1+K1×H by the spring force of the first spring 42. In addition to that, the spring force Fvs2+K2 (H−H1) of the second spring 44 acting on the second control valve 43 is applied. Therefore, the valve closing force Fvc1 applied to the first control valve 40 is Fvc1=Fvs1+K1×H+Fvs2+K2×(H−H1). The valve opening force Fvo1 applied to the first control valve 40 is Fvo1=Fm2+Avo1×Pv1. The force Fv1 applied to the first control valve 40, if neglect a force receiving from the second control valve 43, is shown by the following formula (7).

$$Fv1=Fvo1-Fvc1=Fm2+Avo1\times Pv1-Fvs1-K1\times H \quad (7)$$

Next, as the second control valve 43 is lifted, the fuel pressure of the fuel passage 70 reduces from Pc1 and becomes Pv2 near atmospheric pressure, same as that of the fuel chamber 63, that is, Pv2≈Pv1. A valve opening force Fvo2 applied to the second control valve 43 is Fvo2=Avo2×Pv2 where Avo2 is a pressure receiving area of the second control valve 43 which receive pressure in a valve opening direction from the fuel chamber 63 and the fuel passage 70. A valve closing force Fvc2 applied to the second control valve 43 is Fvc2=Fvs2+K2×(H−H1). The force Fv2 applied to the second control valve 43, if neglect a force receiving from the first control valve 40, is shown by the following formula (8).

$$Fv2=Fvo2-Fvc2=Avo2\times Pv2-Fvs2-K2\times(H-H1) \quad (8)$$

A sum Fv of the force applied to the first and second control valves 40 and 43 is shown by the following formula (9).

$$Fv=Fm2+Avo1\times Pv1-Fvs1-K1\times H+Avo2\times Pv2-Fvs2-K2\times(H-H1) \quad (9)$$

When the magnetic attracting force exerted by the driving current applied to the coil 35 causes the first control valve 40 to move against the spring force of the first spring 42 and establishes the first lifting amount H1 as shown in FIG. 4, the fuel pressure Pc1 of the first control chamber 60 is reduced. Accordingly, the pressure Pd from the accumulating pipe, if exceeds the sum of the fuel pressure Pc1 and the initial pre-load of the first spring 15, causes the needle 21 to move upwardly against the first spring 15 so as to open the injection hole. This is a case that a condition F≧0 is satisfied in the formula (1). Therefore, the needle 21 is lifted by the first lifting amount h1.

Figure 6:
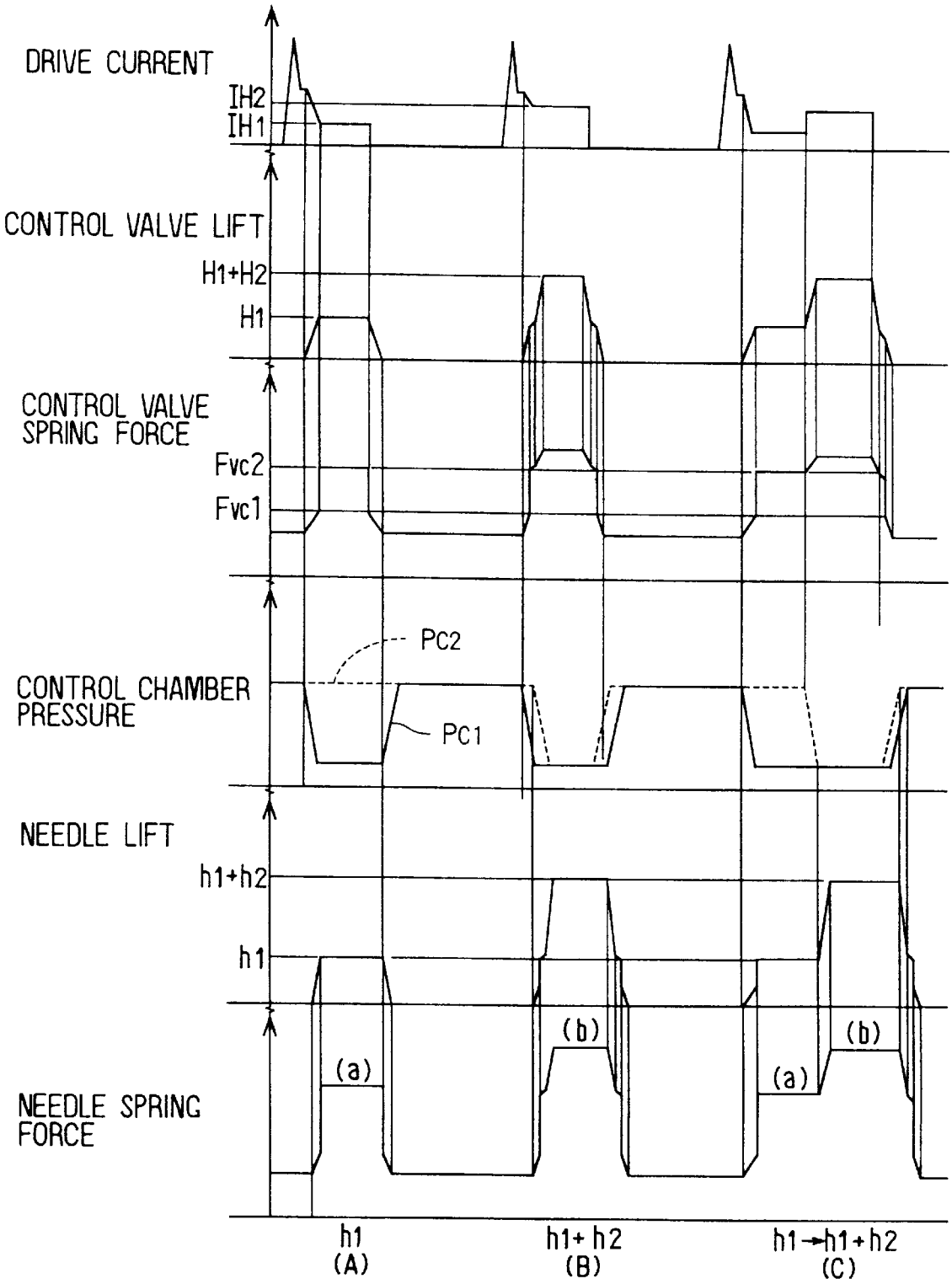
FIG. 6 is a time chart showing a stepwise lifting.

After moving the first lifting amount h1, the needle 21 receives the initial pre-load Fs2 of the second spring 16 so that the needle 21 stops lifting and keeps the first lifting amount h1, as shown in a needle lift diagram (A) in FIG. 6. Even if the fuel pressure of the first control chamber is reduced, the needle 21 keeps the first lifting amount h1, as far as F≧0 in the formula (2) and F<0 in the formula (3) are satisfied.

Further, when higher current is supplied to the coil 35 of the electromagnetic valve 30 and the electromagnetic attracting force is increased, the second control valve 43 is moved together with the first control valve 40 against the biasing forces of the first and second springs 42 and 44 to establish a lifting state (H1+H2) as shown in FIG. 6. Accordingly, when the fuel pressure of the second control chamber 65 is reduced and F≧0 in the formula (3) is satisfied, the needle 21 is lifted to exceed the first lifting amount h1 so that the needle 21 may be further lifted by the second lifting amount h2 in addition to the first lifting amount h1. The total needle lifting amount becomes h1+h2 that is a maximum lifting state as shown in (b) of (B) or (C) in FIG. 6.

According to the fuel pressure reduction of the second control chamber 65, force acting on the needle 21 in a valve opening direction is further increased. However, as the shoulder portion 22 of the needle 21 comes in contact with the lower end surface of the tip packing 13, further lifting of the needle 21 is stopped. The force in a direction of opening the injection hole is received by the tip packing 13. After a lapse of a predetermined driving pulse time, the supply of the driving current to the coil 35 is stopped and the second control valve 43 is seated on the valve seat 33*a* so that the fuel passage 70 may be closed. Then, the fuel pressure of the second control chamber 65 begins to increase due to high pressure fuel flown from the inlet throttle 66. Further, when the outlet throttle 62 is closed by the first control valve 40 seated on the plate 34, the fuel pressure of the first control chamber 60 increases due to high pressure fuel flown from the inlet throttle 61.

As the force of moving downwardly the control pistons 24 and 25 is increased, the needle 21 begins to move downward in a direction of closing the injection hole via the rod 23. When the needle 21 has moved downward by the second lifting amount h2, the needle 21 does not receives the biasing force of the second spring 16 and only the fuel pressure of the first and second control chambers 60 and 65 and the initial pre-load Fs1 of the first spring 15 urge the valve element 20 in a direction of closing the injection hole. As the valve closing force acting on the needle 21 is reduced, the needle 21 is slowly seated on the valve seat 12*a* so that seating impact and noise may be reduced.

As mentioned above, the fuel pressure of the first and second control chambers 60 and 65 are controlled by the first and second control valves 40 and 43, which are regulated by the current supplied to the electromagnetic valve 30, and, further, controlled by the preset passage areas of two pairs of the throttles 61 and 62 and the throttles 66 and 67. The needle 21 is stepwise lifted by controlling the force receiving from the fuel pressure in a direction of opening or closing the injection hole relative to the biasing forces of the first and second springs 15 and 16. At the valve opening time, various lifting characteristics such as a lifting of only the first lifting amount h1, lifting of the first and second lifting amounts h1+h2 or stepwise lifting with a longer time interval of the first lifting amount h1 before starting the second lifting amount h2. Further, at the valve closing time, it is possible to eliminate or shorten the time interval of h1. As a result, fuel injection amount at an initial stage may be reduced so that nitrogen oxide and combustion noise may be limited. Further, the fuel injection rate at injection last stage may be closed with a shorter time so that the formation of black smoke may be reduced.

The following described is an operation of the valve portion 2 when the lifting of the needle 21 is stepwise controlled.

Figure 8:
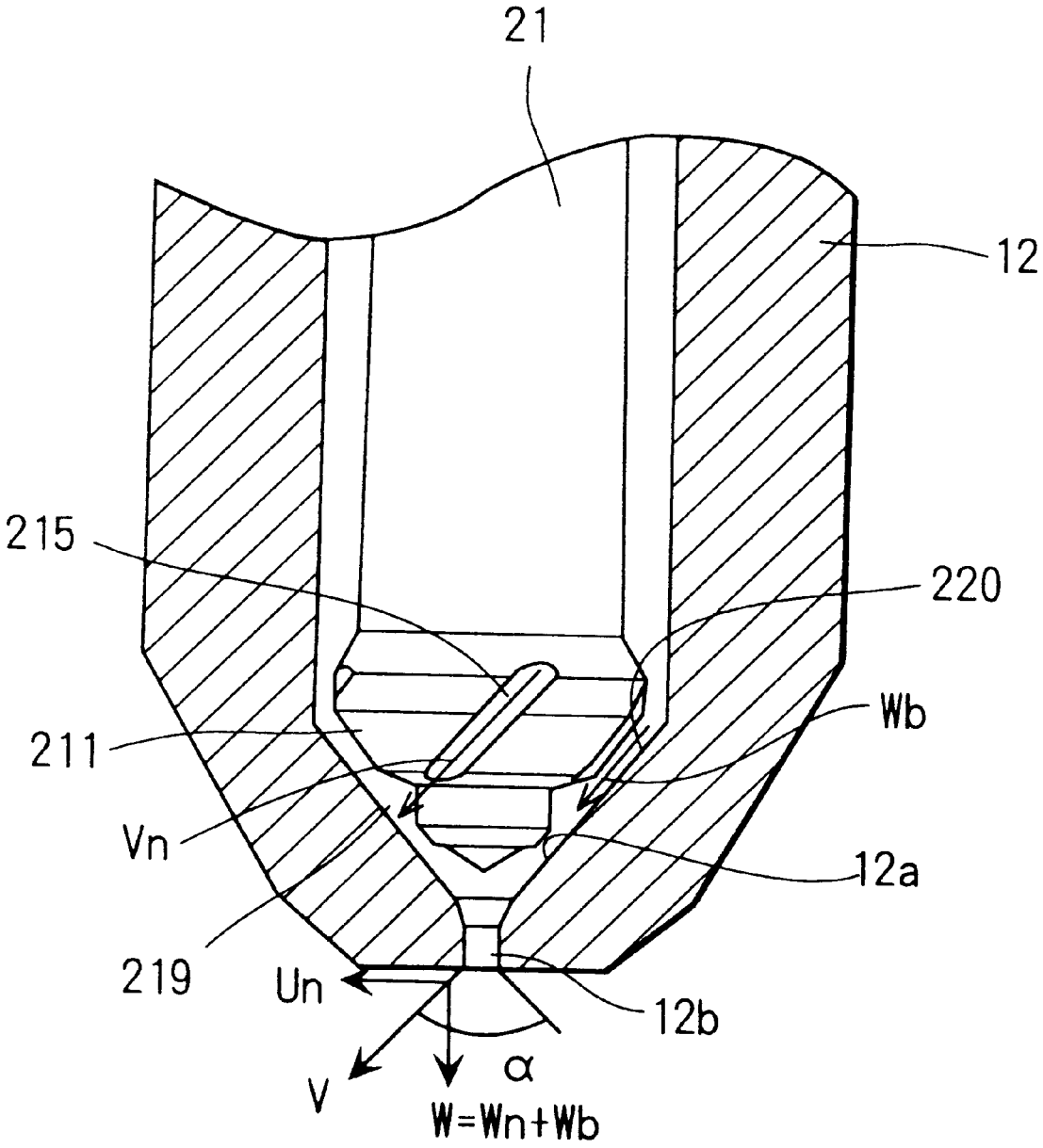
FIG. 8 is an enlarged view of a nozzle portion with respect to the injector shown in FIG. 1 at the maximum lift.
Figure 9:
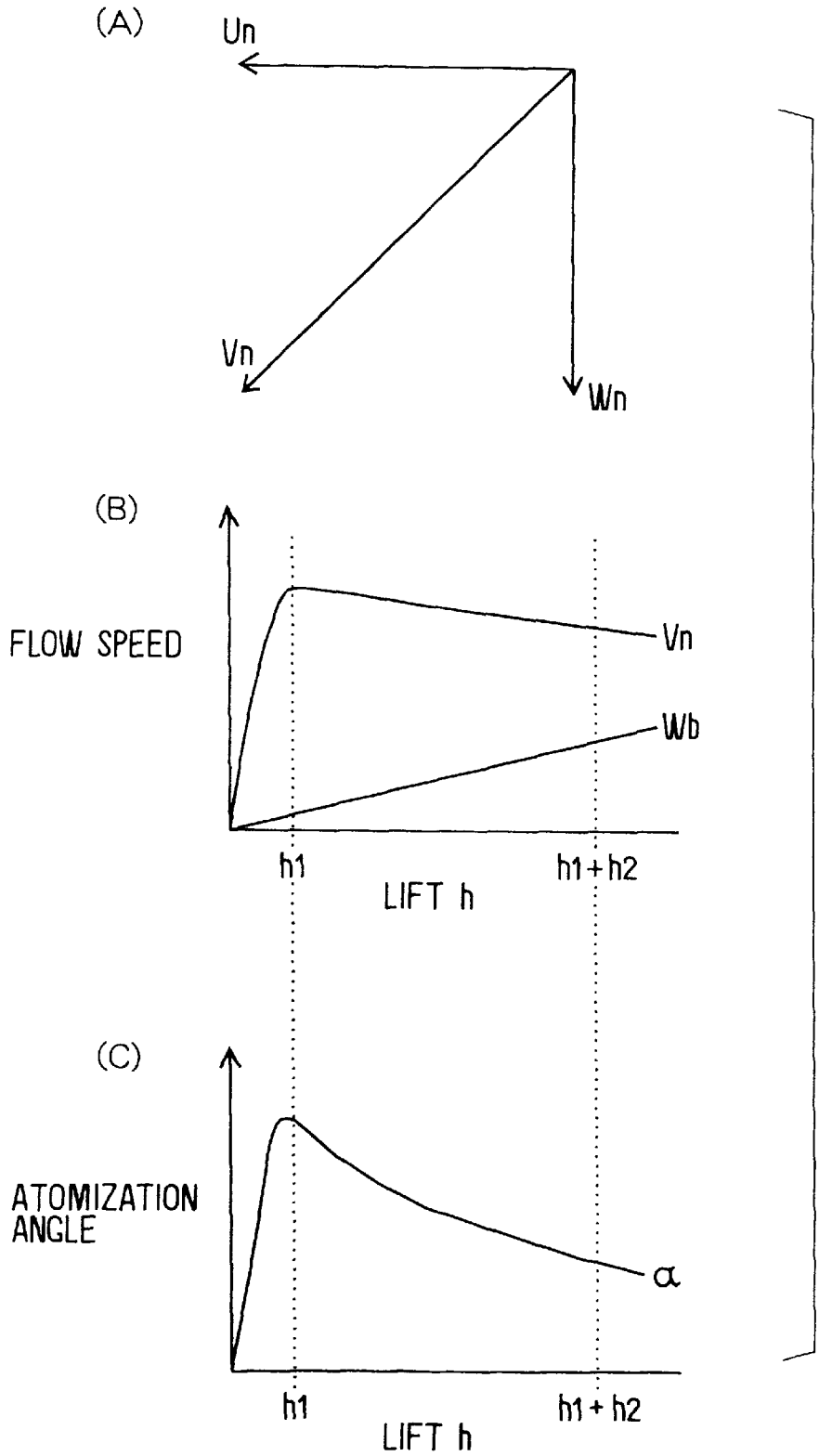
FIG. 9 is a characteristic chart showing a relationship among a flow speed, atomization angle and lift amount.

When the needle 21 lifted by h1, a clearance between the conical face 211 of the needle 21 and the seat face 220 is very small as shown in FIG. 7B. At this time, as shown in FIG. 8, flow speed of fuel flowing in the oblique groove 215 is Vn and flow speed of fuel flowing in the clearance between the conical face 211 and the seat face 220 is Wb. As shown in FIG. 9A, the speed Vn may be resolved into a speed component Un in a circumferential direction and a speed component Wb in an axial direction. A speed ratio of Vn to Wb is decided by a ratio of one passage area to the other passage area and shows a change according to a lifting of the needle 21 as shown in FIG. 9B.

Since the flow area of the oblique groove 215 is constant irrelevant to the lifting of the needle, the speed Vn in the oblique groove 215 may be increased, as the fuel amount is increased according to a largeness of an opening area between the contacting portion 21*a* and the valve seat 12*a*. If the opening area between the contacting portion 21*a* and the valve seat 12*a* at a vicinity of the first lifting amount h1 is set to be equal to the passage area of the oblique groove 215, Vn shows a maximum speed at the first lifting amount h1.

Though Wn is increased in proportion to the needle lifting, a value of Wn is smaller than that of Vn and Wn is more slowly increased, compared with Vn, as far as the needle lifting amount is within a range substantially from several microns to several tenth millimeters. As a result, the ratio of Vn to Wb is maximum at near the first lifting amount h1. At this time, the atomization angle may be decided by a ratio of the speed component in a circumferential direction to the speed component in an axial direction at an outlet of the injection hole, which becomes equal to a ratio of the speed component Un in a circumferential direction to the speed component W=Wn+Wb in an axial direction with respect to fuel flown into the swirl chamber 219 in view of a momentum preservation law and a free swirl law. That is, fuel is injected with a atomization angle $\alpha$ decisive by a formula of $\tan(\alpha/2)=Un/(Wn+Wb)$.

When the fuel pressure of the first control chamber 60 is further reduced, the needle 21 is lifted against the biasing forces of the first and second springs 15 and 16 to obtain the maximum lifting amount (h1+h2). At this state, as the area between the contacting portion 21*a* and the valve seat 12*a* is enlarged and the fuel speed Wb is increased, the speed Vn in the oblique groove 215 is disturbed and decreased by Wb. Consequently, the atomization angle $\alpha$ is decreased as shown in FIG. 9C.

According to the first embodiment, as a diameter of the swirl chamber 219 is relatively small and a volume of the swirl chamber 219 is reduced, a time delay is limited before the circulation force to the fuel is established. Further, as the swirl chamber 219 is provided right above the contacting portion 21*a*, a change of the atomization angle is immediately followed to the lifting amount. As the atomization by the swirl injection serves to split fuel into tiny particles, fuel with more tiny articles may be injected with lower injection pressure, compared with the other hole nozzle type.

A method of controlling the injector of the first embodiment according to engine operations is described.

As shown in FIG. 10, at a region of low and middle speed and low and middle load, basically, the lifting of the needle 21 is controlled to maintain a low lifting state of the first lifting amount h1 so that fuel is supplied to a combustion chamber with a low injection rate and a short droplets reaching distance. At a region of high speed and high load, the needle is lifted by h1+h2 to realize a high injection rate and a high droplets reaching distance.

Figure 10A:
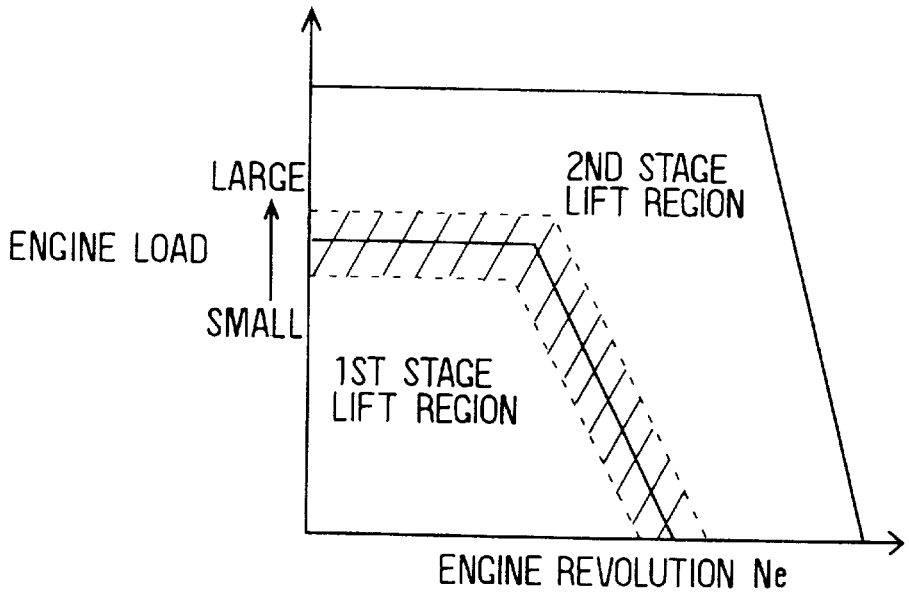
FIG. 10A is a chart showing a relationship between engine revolution and engine load.
Figure 10B:
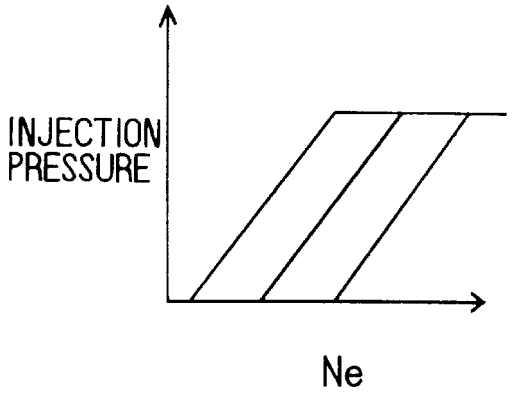
FIG. 10B is a chart showing a relationship between engine revolution and injection pressure.
Figure 10C:
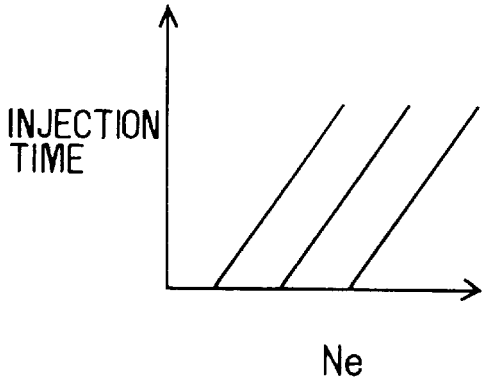
FIG. 10C is a chart showing a relationship between engine revolution and injection time.

The injection pressure shown in FIG. 10B and the injection timing shown in FIG. 10C are controlled in accordance with a map based on injection amount. Adjustments due to temperature (air, coolant and fuel), an intake pressure and soon are added to the map. In an engine to be normally operated, a first step lifting driving region that the lifting amount is h1 and a second step lifting driving region that the lifting amount is h1+h2 are changed as shown by a solid line in FIG. 10A.

However, in an engine to be installed in a vehicle having a transient driving region, which is presumed to be, for example, a broken line region as shown in FIG. 10A, it becomes necessary to change the lifting amount by a special control in order to prevent a stepwise output change of the engine when the engine conditions fall within the broken line range mentioned above. For example, as shown in (C) in FIG. 6, if the current supplied to the electromagnetic valve 30 is controlled to realize the stepwise lifting during the injection period, the stepwise output change may be prevented. A ratio of the first step lifting length to the second step lifting length may be changed according engine operating conditions fallen within the broken line range shown in FIG. 10A. Further, a plurality of injections may be set during a cycle of the engine. For example, when the engine operating condition is being changed from the low load to the high load, a plurality of first step injections are made with only the first lifting amount h1 and, then, a number of second step injections with the first and second lifting amount, h1+h2, may be gradually increased from zero to a certain numbers or respective injection periods among the plurality of injections may be separately controlled. Furthermore, it is possible to combine a lifting mode shown in (C) of FIG. 6 with a plurality of combinations of (A) and (B) of FIG. 6. Moreover, when the driving conditions are fluctuating back and forth within the broken line region shown in FIG. 10A, it is possible to have a hysteresis for injection control.

According to the first embodiment mentioned above, a variable atomization angle technology necessary for realizing future combustion concept may be provided with a low cost and with a low injection pressure by the construction that the needle is stably controlled with two stages and the circular force acting on the fuel flow may be changed at the valve portion 2 by the needle lifting. Further, inlet and outlet edges of the oblique groove 215 are rounded with lager radius on their oblique sides, respectively, that is, on an in-flow inner side at the inlet and on a swirl flow downstream side at the outlet. As a result, fuel flow loss may be limited and the fuel flow separation does not occur so that a generation of cavity may be prevented. In other words, unnecessary pressure increase in the injection system may be prevented, resulting in improving a machinery efficiency and reliability of the nozzle.

Further, when the valve element 20 starts the valve closing from the maximum lifting amount (h1+h2), the valve closing speed is high due to the sum of biasing forces of the first and second springs 15 and 16. However, at a region of less than the first lifting amount h1, a valve closing speed of the needle just before being seated on the valve seat becomes slow so that the valve closing hammer shock may be eased.

Furthermore, in a state that the valve element 20 is away from the valve seat 12*a,* a pressure receiving area on which the valve element 20 receives fuel pressure in a direction of opening the injection hole is larger than a pressure receiving area on which the valve element 20 receives fuel pressure from the both control chambers in a direction of closing the injection hole minus a pressure receiving area on which the valve element 20 receives fuel pressure from the control chamber whose fuel outlet is opened. Accordingly, a speed of the needle 21 for being seated on the valve seat 12*a* is reduced to ease the valve closing hammer shock, thus resulting in improving reliability.

Moreover, at a light load operation in which only first stage lifting injection is performed, the fuel injection rate becomes low so as to stably control a very small amount of injection.

Further, the contacting portion 21*a* of the needle 21 may be adjusted not to off set its center due to pressure balancing effect in the swirl chamber 219 so that the needle 21 and the valve body 12 may be always on the same axis so as to prevent variations of atomization.

(Second Embodiment)

Figure 11A:
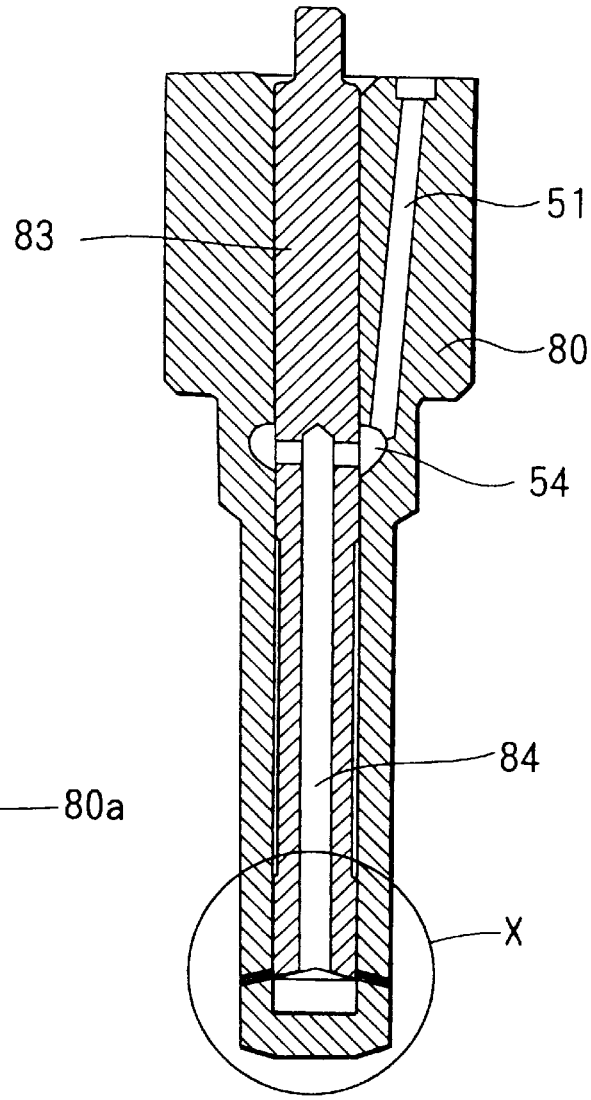
FIG. 11A is a cross sectional view of an injector according to a second embodiment of the present invention.
Figure 11B:
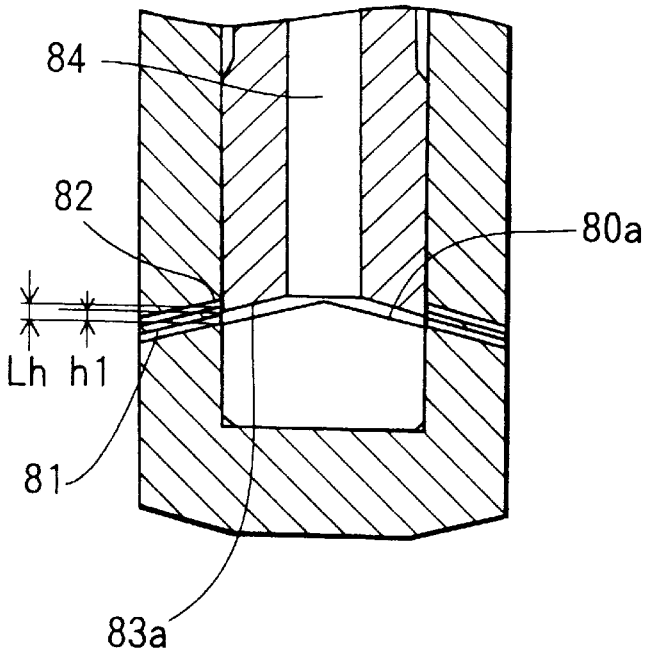
FIG. 11B is a partly enlarged view of the injector shown in FIG. 11A.

A second embodiment of the present invention is described with reference to FIGS. 11A and 11B. With respect to components and construction substantially same to those of the first embodiment, to which the same reference numbers are affixed, the explanation thereof is omitted.

Instead of the first embodiment in which fuel circular velocity direction becomes variable based on the distance between the circular force generating portion 210 and the seat face 220, according to the second embodiment, a plurality of first and second injection holes 81 and 82, which are provided in a valve body 80, are selectively opened and closed based on a lifting amount of a needle 83 so as to change the injection rate and the state of the atomization. That is, the first and second injection holes constitute variable injection means.

A fuel passage 84 is formed inside the needle 83. The fuel passage 83 is communicated via the fuel accumulating space 54 to the fuel passage 51 provided in the valve body 80. A contacting portion 83*a* of the needle 83 is urged to a valve seat 80*a* provided in the valve body 80 by the biasing force of the first spring 15 (not shown in FIGS. 11A and 11B). The first and second injection holes 81 and 82, which constitute first and second groups of injection holes, respectively, are opened to an outer circumference of the valve body 80 at a plurality portions. There is a distance Lh between the respective lower side portions of the first and second injection holes 81 and 82. The distance Lh is larger than the first lifting amount h1 of the needle 83 but smaller than the maximum lifting amount (h1+h2) thereof.

When the needle 83 begins to lift due to the drive of the electromagnetic valve and the contacting portion 83*a* moves away from the valve seat 80*a,* high pressure fuel begins to be injected from the first injection hole 81. When the needle 83 continues to lift and stops at the first lifting amount h1, only the first injection hole 81 is opened. Then, when the needle 83 further lifts and the lifting amount exceeds Lh, fuel is injected from the second injection hole 82, too. At the maximum lifting amount (h1+h2) of the needle 83, the first and second injection holes 81 and 82 are fully opened to secure maximum injection rate. (h1+h2) is set to be larger than (Lh+diameter of the second injection hole 82).

Instead of the wide-angle conical shaped single atomization of the first embodiment, a plurality of atomization, each of which is a narrow angle atomization in each of the injection holes, are formed to constitute a conical shaped atomization as a whole according to the second embodiment. Each conical atomization angle of the first group of injection holes may differ from that of the second group of injection holes. Further, the injection rate may be changed by controlling stepwise with two stages the lifting amount of the needle 83 and, further, may be adjusted by changing the respective diameters of the first and second injection holes 81 and 82.

(Third Embodiment)

Figure 12:
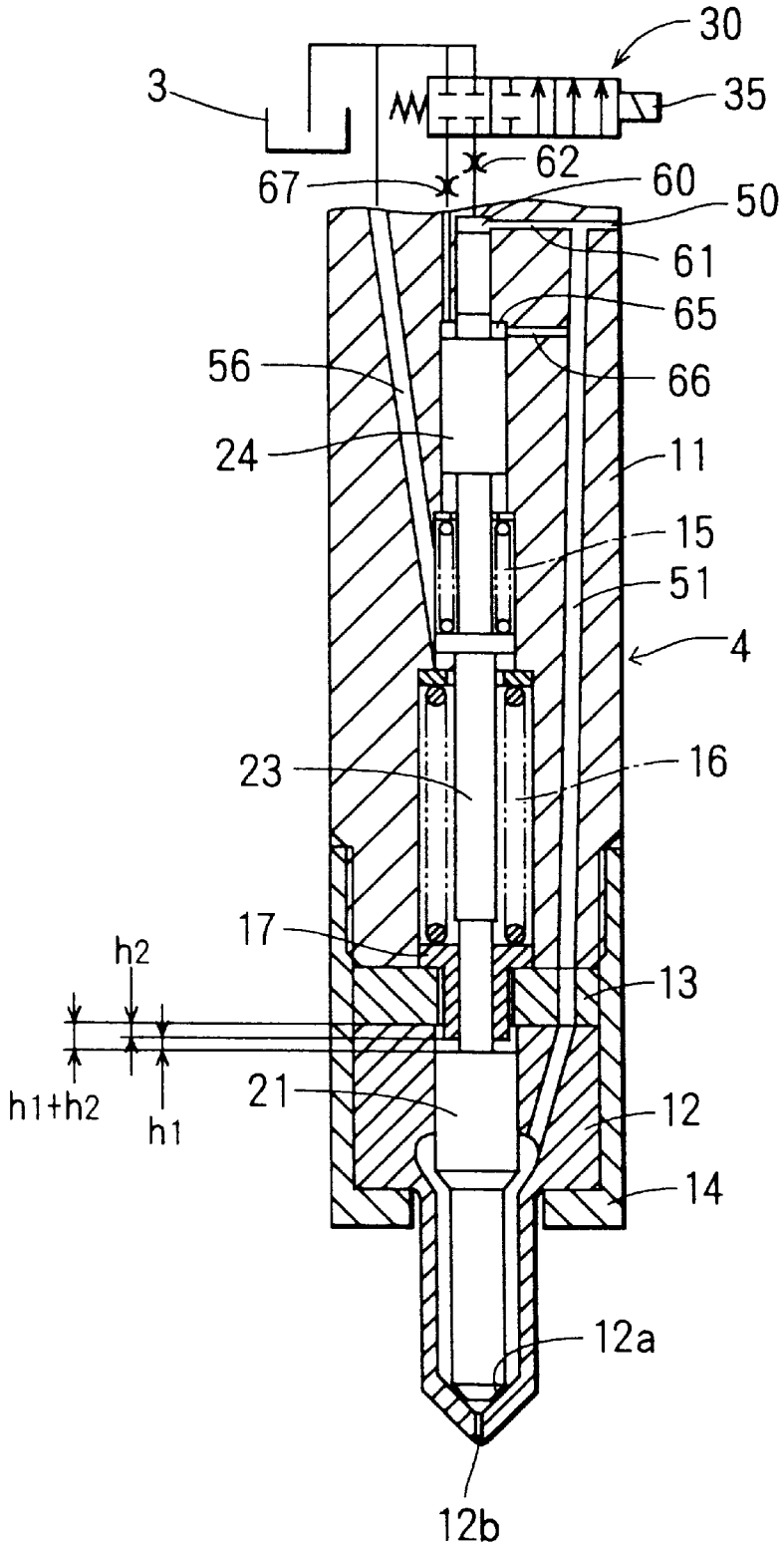
FIG. 12 is a cross sectional view of an injector according to a third embodiment of the present invention.

An injector according to a third embodiment of the present invention is described with reference to FIG. 12. With respect to components and construction of an injector 4 substantially same to those of the first embodiment, to which the same reference numbers are affixed, the explanation thereof is omitted. The construction of the electromagnetic valve 30 is schematically shown. According to the third embodiment, the first spring 15 is located beneath the control piston 24 for biasing the rod 23, instead of being disposed in the second control chamber 65 according to the first embodiment. A basic operation of the third embodiment is same to that of the first embodiment. As the volume of the second control chamber 65 of the third embodiment may be smaller, a changing responsiveness of fuel pressure Pc2 in the second chamber 65 becomes fast so that valve opening and closing responsiveness of the needle 21 may be improved. Further, as fuel in-flow and out-flow amount necessary for changing pressure may be reduced and the discharge amount of the fuel injection pump may be limited, engine output may be improved because of necessity of less driving torque of the fuel injection pump.

(Fourth Embodiment)

Figure 13:
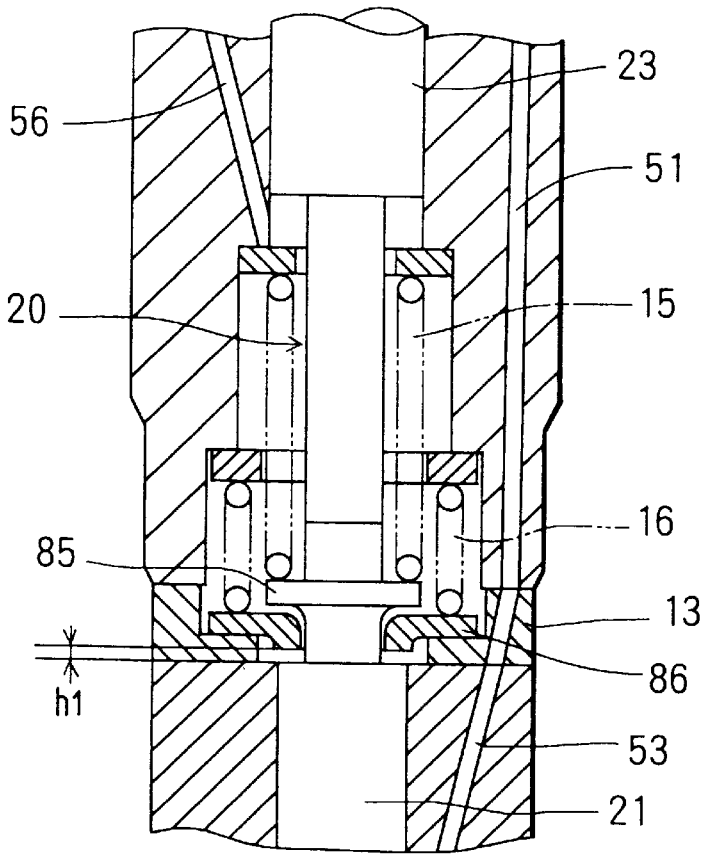
FIG. 13 is a cross sectional view of an injector according to a fourth embodiment of the present invention.

A fourth embodiment of the present invention is described with reference to FIG. 13. With respect to components and construction substantially same to those of the first embodiment, to which the same reference numbers are affixed, the explanation thereof is omitted. A difference from the first embodiment is that the first spring 15 is arranged inside the second spring 16 and the biasing force of the first spring 15 is given via a pressure pin 85 to the needle 21. As an upper end of the needle has a flat surface without a prolonged portion thereof, a shape of the needle 21 becomes simple. Further, according to the fourth embodiment, only the first lifting amount h1 is defined in such a manner that the needle 21 comes in contact with a spring seat 86 of the second spring 16 and the second lifting amount h2 is not defined.

The construction mentioned above serves to shorten a length of the rod 23 and to reduce the mass of the valve element 20. Further, as the second lifting amount depend on a balance between the forces acting on the needle in a direction of opening the injection hole and in a direction of closing the injection hole, adjusting processes on manufacturing the valve element 20 may be skipped to save its manufacturing cost.

(Fifth Embodiment)

Figure 14:
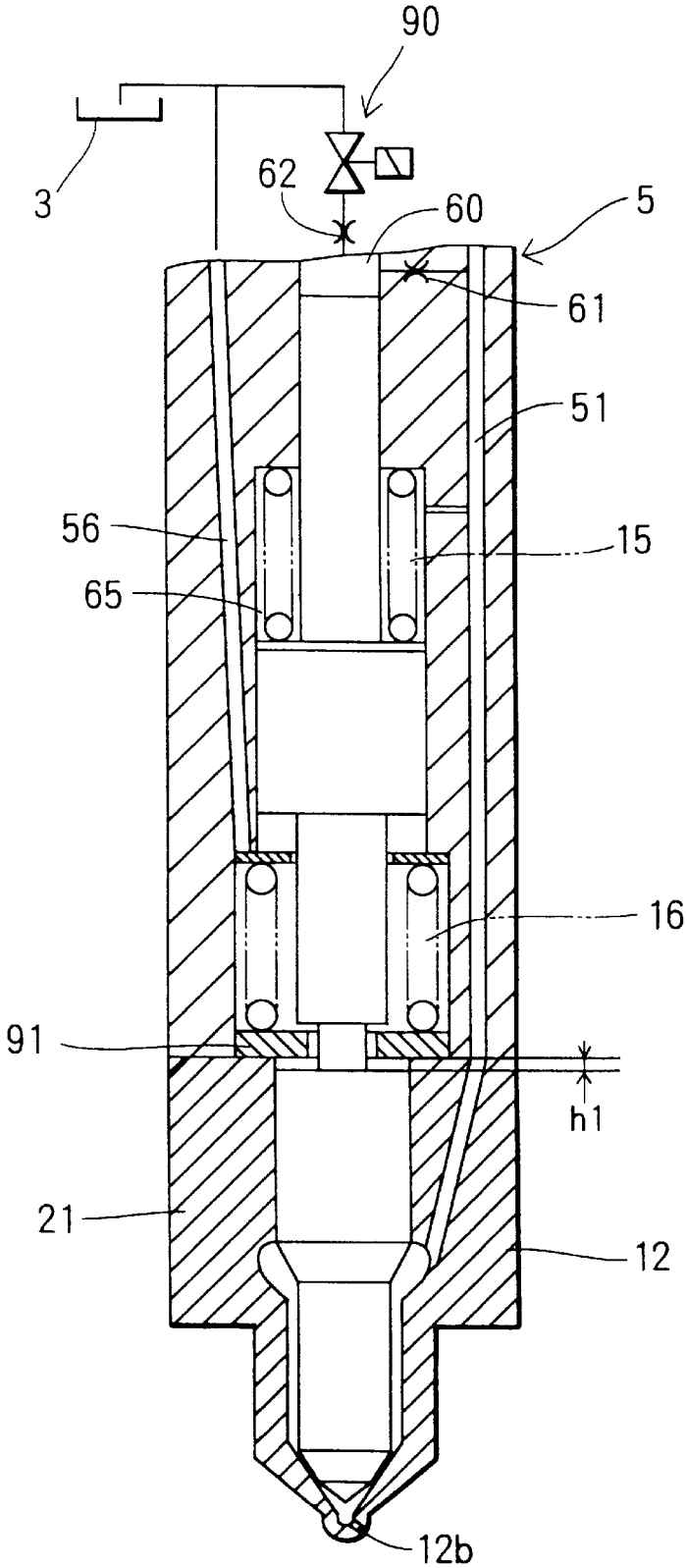
FIG. 14 is a cross sectional view of an injector according to a fifth embodiment of the present invention.

A fifth embodiment of the present invention is described with reference to FIG. 14. With respect to components and construction of an injector 5 substantially same to those of the first embodiment, to which the same reference numbers are affixed, the explanation thereof is omitted. According to the fifth embodiment, the construction of the electromagnetic valve becomes more compact by using a two position-two way electromagnetic valve 90 instead of the three position-three way electromagnetic valve 30 of the first embodiment. Consequently, the first and second control valves 40 and 43 are integrated into one body and one of the first and second springs 42 and 44 is omitted, though they are not shown in the drawing. The electromagnetic valve 90 is operative to open and close only the outlet throttle 62 of the first control chamber 60. The second control chamber 65 is not provided with the outlet throttle for out-flowing fuel. Therefore, pressure of the second control chamber 65 is not controlled and is always applied from pressure accumulating space. Further, the tip packing 13 of the first embodiment is omitted and, instead, a spring seat 91 of the second spring 16 is in contact with an end surface of the valve body 12. The second lifting amount h2 is not defined, as similar to the fourth embodiment.

In the construction mentioned above, the pressure for stating a second stage lifting of the needle 21 can not be controlled and the needle 21 automatically starts the second stage lifting with a predetermined constant pressure. The construction and control of the injector become simple, thus resulting in low cost and compact injector.

(Sixth Embodiment)

Figure 15:
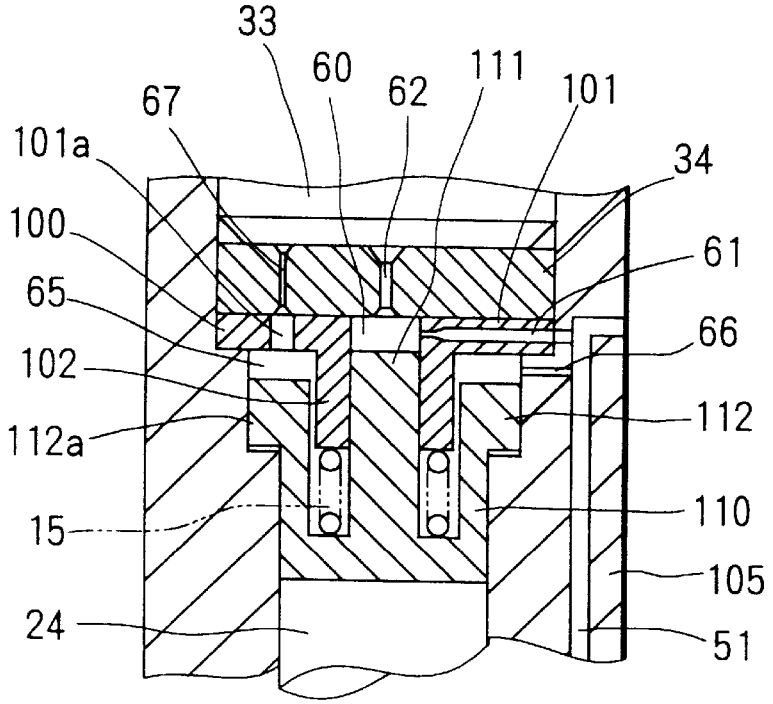
FIG. 15 is a cross sectional view of an electromagnetic valve of an injector according to a sixth embodiment of the present invention.

A sixth embodiment of the present invention is described with reference to FIG. 15. With respect to components and construction substantially same to those of the first embodiment, to which the same reference numbers are affixed, the explanation thereof is omitted.

A liner 100 is put between the plate 34 and a housing 105. The liner 100 is provided with a flange portion 101 and a cylindrical portion 102. The flange portion 101 is provided with a communication passage 101*a,* which communicates the second control chamber 65 and the outlet throttle 67, and the inlet throttle 61.

The control piston 110 is composed of a column portion 111 in a center and a cylindrical portion 112 outside the column portion 111. The cylindrical portion 112 has a cylindrical groove formed around an outer circumference of the column portion 111 and a larger diameter portion 112*a* extending radically and outwardly. The cylindrical portion 102 of the liner 100 is slidably fitted to the column portion 111 of the control piston 110.

As the control piston 110 has the larger diameter portion 112*a,* an area receiving fuel pressure of the second control chamber 65 is larger so as to increase fuel pressure necessary for the second stage lifting to a maximum injection pressure.

(Modification)

Figure 16:
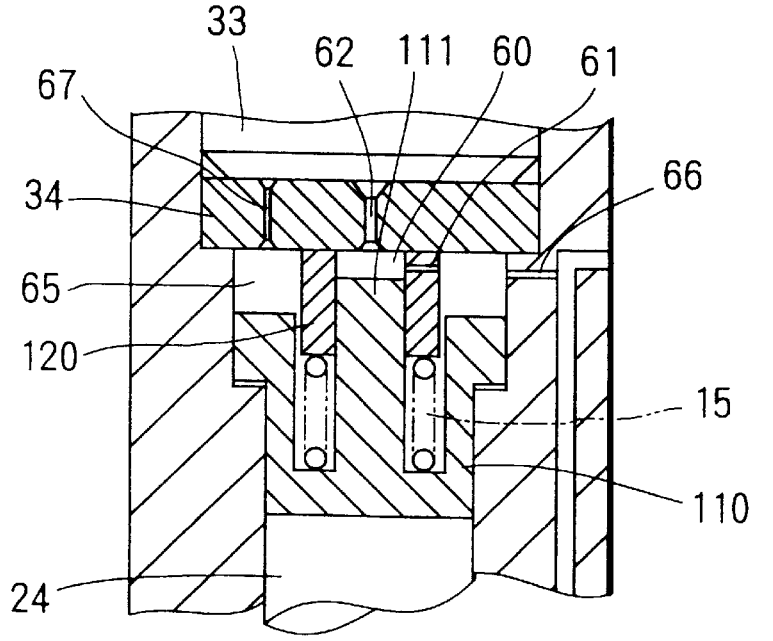
FIG. 16 is a cross sectional view of a modified electromagnetic valve of the injector according to the sixth embodiment of the present invention.

A modification of a shape of the liner 100 according to the sixth embodiment is shown in FIG. 16. A liner 120, which is formed in a cylindrical shape, is urged toward the plate 34 by the first spring 15 so that the first and second control chambers 60 and 65 are hydraulically sealed.

(Seventh Embodiment)

Figure 17:
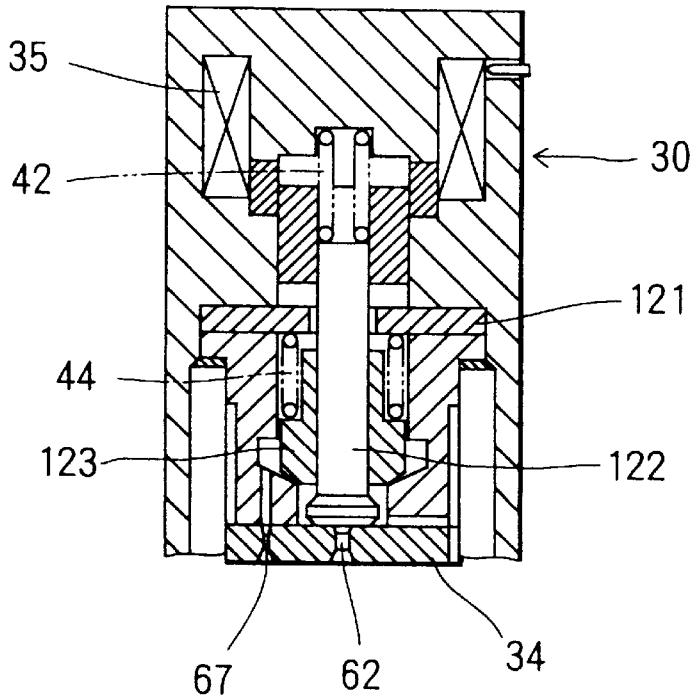
FIG. 17 is a cross sectional view of an electromagnetic valve of an injector according to a seventh embodiment of the present invention.

A seventh embodiment of the present invention is described with reference to FIG. 17. With respect to components and construction substantially same to those of the first embodiment, to which the same reference numbers are affixed, the explanation thereof is omitted. A difference from the first embodiment is that the second spring 44 is arranged on a side of a second control valve 123 relative to a spacer 121. With this construction, a length of a first control valve becomes shorter so that the electromagnetic valve may become compact.

(Eighth Embodiment)

Figure 18A:
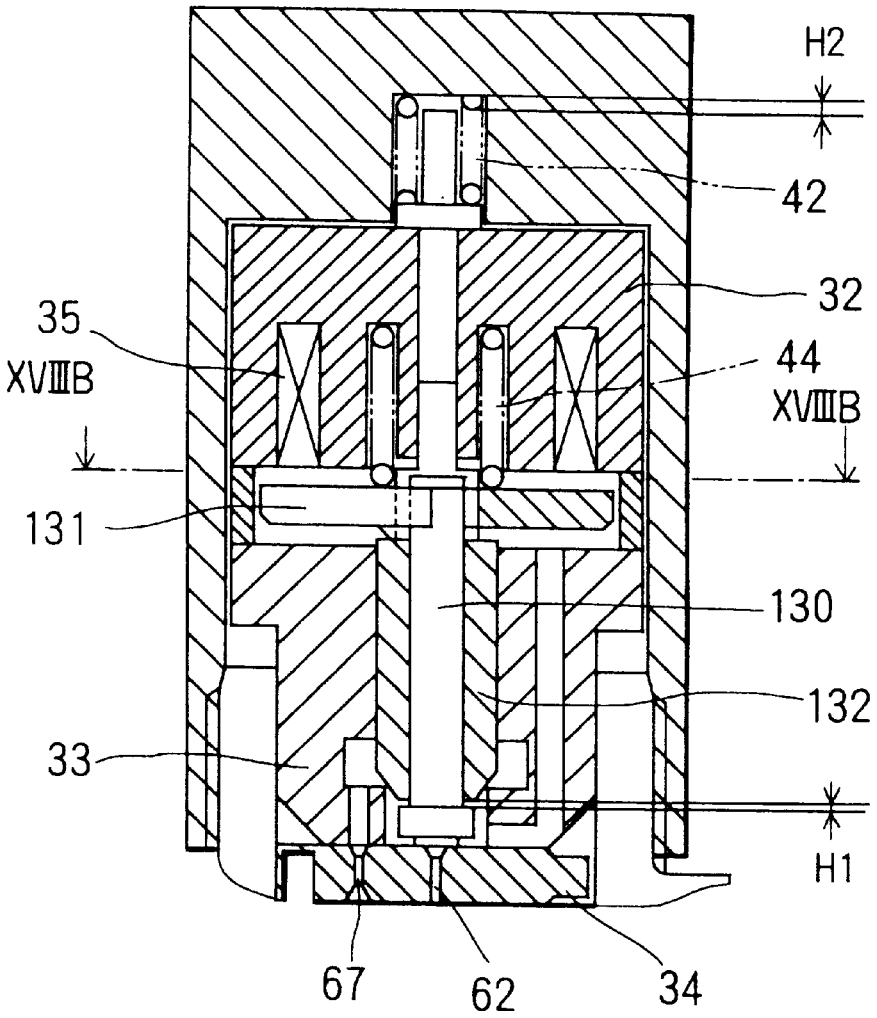
FIG. 18A is a cross sectional view of an electromagnetic valve of an injector according to a eighth embodiment of the present invention.
Figure 18B:
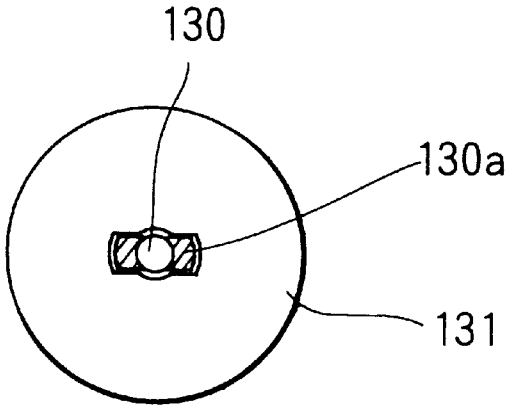
FIG. 18B is a cross sectional part view taken along a line XVIIIB—XVIIIB of FIG. 18A.

An eighth embodiment of the present invention is described with reference to FIG. 18. With respect to components and construction substantially same to those of the first embodiment, to which the same reference numbers are affixed, the explanation thereof is omitted. Differences from the first embodiment are that a core 131 of a first control valve 130 is formed in a flat plate shape instead of the plunger shape and the first spring 42 is arranged above the armature 32. The core 131 is fitted to a projection 130*a* formed in the first control valve 130. As the core 131 is of the flat plate shape, electromagnetic attracting force acting on the first control valve 130 increases. Further, as an adjustment of the first spring 42 is easy, a lift start timing of the second control valve 132 may be accurately set.

(Ninth Embodiment)

Figure 19:
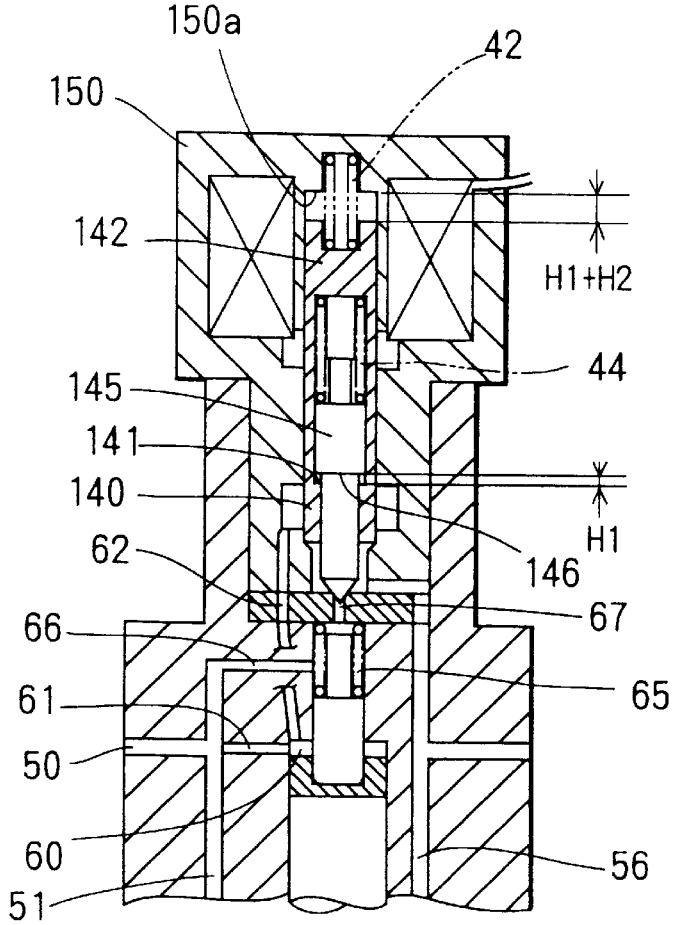
FIG. 19 is a cross sectional view of an injector according to a ninth embodiment of the present invention.

A ninth embodiment of the present invention is described with reference to FIG. 19. With respect to components and construction substantially same to those of the first embodiment, to which the same reference numbers are affixed, the explanation thereof is omitted. Differences from the first embodiment are that a first control valve 140 locating outside lifts at first and, then, a second control valve 145 locating inside lifts. The second control valve and the second spring 44 are housed inside the first control valve 140. With this construction, the first lifting amount H1 is defined in such a manner that a step portion 141 inside the first control valve 140 comes in contact with a stop portion 146 of the second control valve 145. The maximum lifting amount (H1+H2) is defined in such a manner that a core 142 of the first control valve 140 comes in contact with en end surface 150*a* of an armature 150. The first and second control chambers 60 and 65 are positioned in reverse each other in response to the positional relationship between the first and second control valves 140 and 145.

(Tenth Embodiment)

Figure 20:
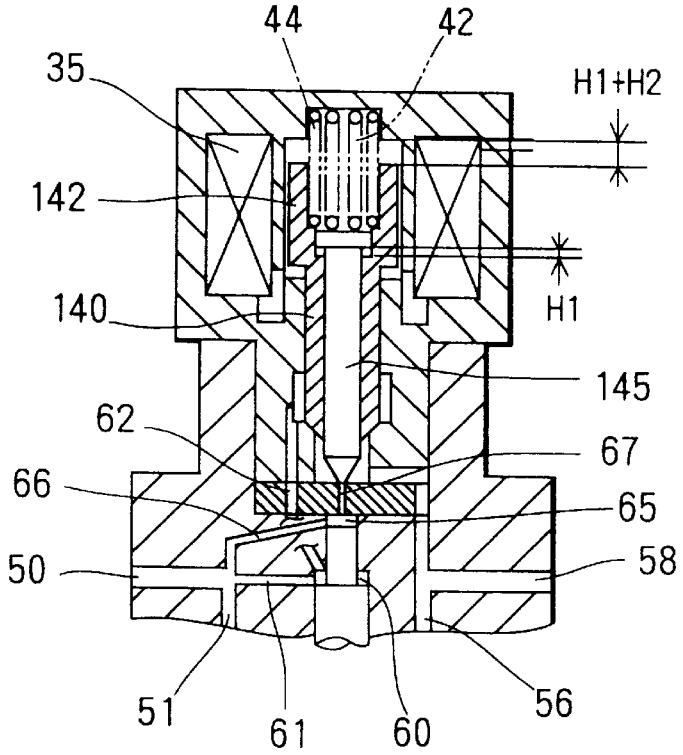
FIG. 20 is a cross sectional view of an injector according to a tenth embodiment of the present invention.

A tenth embodiment of the present invention is described with reference to FIG. 20. With respect to components and construction substantially same to those of the ninth embodiment, to which the same reference numbers are affixed, the explanation thereof is omitted. Differences from the ninth embodiment are that both of the first and second springs 42 and 44 for biasing the first and control chambers 140 and 145, respectively, are positioned on a side of the core 142. According to the ninth and tenth embodiment, the control valve construction including the core 142 is simple and may be manufactured at lower cost. As construction flexibility for the first and second control chambers 60 and 65 increases, an injector to be easily installed in the engine may be manufactured.

(Eleventh Embodiment)

Figure 21:
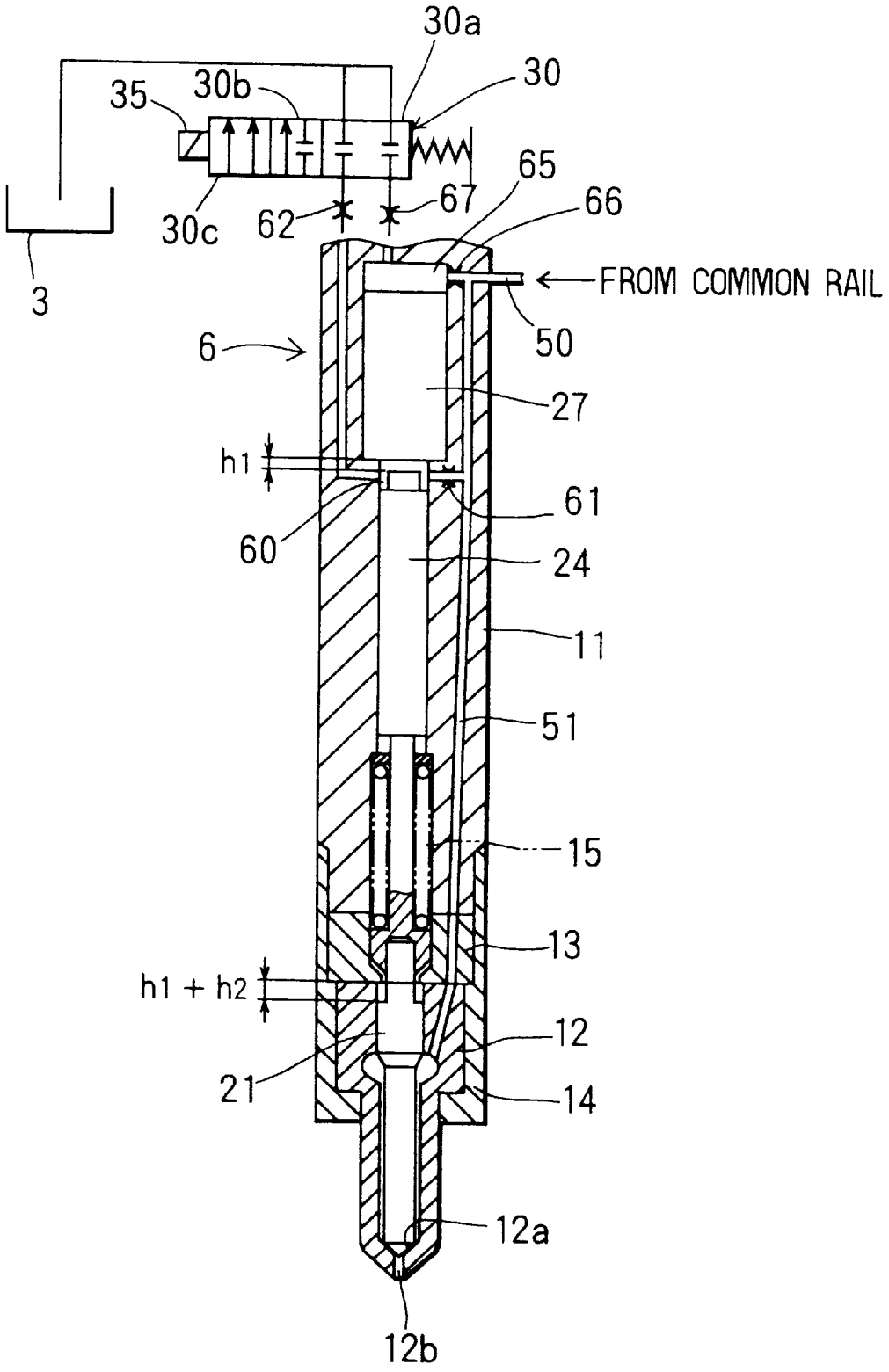
FIG. 21 is a cross sectional view of an injector according to an eleventh embodiment of the present invention.

An eleventh embodiment of the present invention is described with reference to FIG. 21. With respect to components and construction of an injector 6 substantially same to those of the first embodiment, to which the same reference numbers are affixed, the explanation thereof is omitted. The construction of the electromagnetic valve 30 is schematically shown. A valve position 30*a* of the electromagnetic valve 30 shown in FIG. 21 represents a state that driving current is not supplied to the coil 35 in the first embodiment.

A valve position 30*b* represents a state that only the first control valve lifts and a valve position 3*c* represents a state that the first and second control valves lift.

A control piston 27 is positioned on an opposite side of the needle with respect to the control piston 24. In a state that the needle 21 is seated on the valve seat 12*a,* the control piston 27 is in no contact with the control piston 24. The first control chamber 60 is provided between the control pistons 24 and 27. The second control chamber 65 is provided on an opposite side of the first control chamber relative to the control piston 27. As explained later in detail, when the needle 21 lifts so as to exceed the lifting amount h1, fuel pressure of the second control chamber 65 acts against the control piston 24 and the needle 21 in a direction of closing the injection hole and the second control chamber 65 constitutes biasing means as well as the pressure chamber. By controlling the pressure of the first control chamber 60, the injection hole 12*b* may be opened and closed. By controlling the pressure of the second control chamber 65, the lifting amount of the needle 21 is selected to h1 or (h1+h2).

Next, operation of the injector 6 is described.

Figure 22:
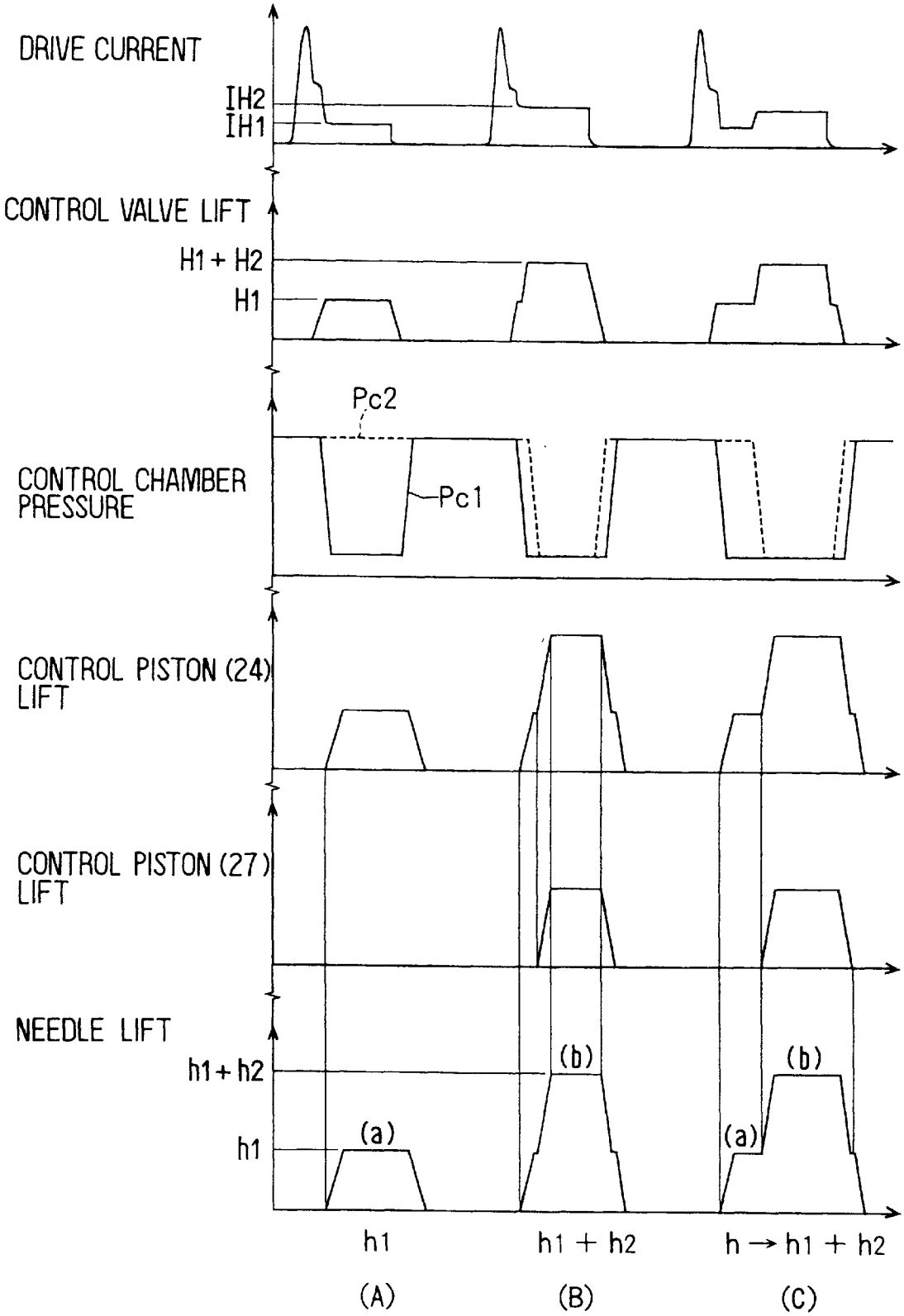
FIG. 22 is a time chart showing a stepwise lift according to the eleventh embodiment.

In a state that the needle 21 is seated on the valve seat 12*a* as shown in FIG. 21, when the coil 35 of the electromagnetic valve 30 is energized by ECU (not shown) with driving current according to engine operating conditions as shown in FIG. 22(A) and the valve position 30*b* of the electromagnetic valve 30 is selected, the outlet throttle 62 is opened and fuel pressure Pc1 of the first control chamber 60 begins to reduce. When the pressure of the first control chamber 60 reduces to an extent that a sum of the biasing force of the first spring 15 and a force receiving from fuel pressure of the first control chamber 60 in a direction of closing the injection hole becomes lower than a force urging upwardly the needle 21, the needle 21 and the control piston 24 begins to lift to spray fuel from the injection hole 12*b.* When the needle 21 and the control piston 24 lifts by the first lifting amount h1, the control piston 24 runs against the control piston 27. As the fuel pressure of the second control chamber 65 acts in a direction of moving the needle 21 to close the injection hole, if a fuel outlet is closed and the fuel pressure of the second control chamber is high, the needle 21 stops in a state that the control piston 24 comes in contact with the control piston 27.

In a state shown in FIG. 21, when the coil 35 of the electromagnetic valve 30 is energized with driving current according to engine operating conditions as shown in FIG. 22(B) and the valve position 30*c* of the electromagnetic valve 30 is selected, the outlet throttles 62 and 67 are opened and fuel pressure Pc1 and Pc2 of the first and second control chambers 60 and 65 begin to reduce. When the needle 21 and the control piston 24 lift and the control piston 24 runs against the control piston 27, the second control chamber 65 is in a state of low fuel pressure. Therefore, the needle 21 and the control piston 24 lift to exceed the first lifting amount h1 and, after lifting (h1+h2), further lifting of the needle 21 is stopped by a lower end surface 13*a* of the tip packing 13.

If the current to be supplied to the coil 35 is increased during an injection period, the lifting amount may be increased from h1 to (h1+h2) as shown in FIG. 22(C). On the contrary, if the current to be supplied to the coil 35 is reduced during an injection period, the lifting amount may be decreased from (h1+h2) to h1.

When the current supply to the coil 35 is interrupted after a lapse of a predetermined time at a state shown in FIG. 22(C), the outlet throttles 62 and 67 are closed so that fuel pressure of the first and second control chambers 60 and 65 increase. As a result, control pistons 24 and 27 are pushed downwardly in a direction of closing the injection hole and the needle 21 is seated on the valve seat 12*a* to finish the fuel injection.

Next, force acting on the needle 21 is described.

(1) When the lifting amount h of the needle 21 is less than the first lifting amount h1 (h<h1):

① At a valve closing by needle (h=0);

A valve closing force Fc1 is a sum of a force Fct1 acting on the valve element 20 in a direction of closing the injection hole due to the fuel pressure Pc1 of the first control chamber 60 and an initial pre-loaded force Fs1 of the first spring 15. That is, Fc1=Fct1+Fs1=Pc1×Ap1+Fs1 where Pc1 is pressure of the first control chamber 60, and Ap1 is an area of the valve element 20 receiving fuel pressure from the first control chamber 60 in a direction of closing the injection hole.

A valve opening force Fo is a force Fd acting on the needle 21 due to fuel pressure in a direction of opening the injection hole, that is, Fo=Fd=Pd (Ag−As) where Pd is fuel pressure in the fuel passage 55, Ag is a cross sectional hole area of the valve body 12 and As is an area of the valve seat 12*a* on which the needle 21 is seated.

A force F applied to the needle 21 is shown by the following formula (10).

$$F=Fo-Fc1=Pd(Ag-As)-Pc1\times Ap1-Fs1 \quad (10)$$

② At a valve opening by needle (o<h<h1);

When fuel pressure of the first control chamber 60 is decreased and the needle valve 21 is moved apart from the valve seat 12*a,* a spring force Fs becomes Fs=Fs1+K1×h by adding a force corresponding to a contraction h of the first spring 15. Accordingly, the valve closing force Fc1 is Fc1=Fct1+Fs=Fct1+Fs1+K1×h and the valve opening force Fo=Fd=Pd×Ag. The force F applied to the needle 21 is shown by the following formula (11).

$$F=Fo-Fc1=Pd\times Ag-Pc1\times Ap1-Fs1-K1\times h \quad (11)$$

(2) When the lifting amount h of the needle 21 is equal to or more than the first lifting amount h1 (h1≦h): As the control piston 24 is in contact with the control piston 27, a force Fct2 acting on the control piston 27 in a direction of closing the injection hole due to fuel pressure Pc2 of the second control chamber 65 is also applied to the needle 21. Fct=Fct1+Fct2. Therefore, the valve closing force Fc1 is Fc1=Fct+Fs=Fct1+Fct2+Fs1+K1×h=Pc1×Ap1+Pc2×Ap2+Fs1+K1×h. Ap2 is an area of the control piston 27 receiving fuel pressure in a direction of closing the injection hole from the second control chamber 65. The valve opening force Fo is Fo=Fd=Pd×Ag. The force F applied to the needle 21 is shown by the following formula (12).

$$F=Fo-Fc1=Pd\times Ag-Pc1\times Ap1-Pc2\times Ap2-Fs1-K1\times h \quad (12)$$

When the needle lifting amount is h1, Pc2 is almost same pressure as Pd. When the needle lifting amount is (h1+h2), pc2 is pressure lower than Pd.

According to the eleventh embodiment, the first control chamber 60 is formed between the control pistons 24 and 27 and the control piston 24 does not come in contact with the control piston 27 until lifting of the needle 21 becomes h1. The needle lifting amount may be freely changed by controlling driving current to be supplied to the coil 35 irrespectively to the value of the injection pressure. Consequently, any injection rate may be adequately realized.

(Twelfth Embodiment)

A twelfth embodiment of the present invention is described with reference to FIGS. 23 and 24. With respect to components and construction of an injector 7 substantially same to those of the first embodiment, to which the same reference numbers are affixed, the explanation thereof is omitted. According to the twelfth embodiment, a piezo element is used as a driving force of the control valve.

A valve holder 160, another valve holder 162 and a valve seat member 165 are put between the valve body 12 and a housing 167. A retaining nut 14 fastens the valve body 12 and the housing 167. Similarly to the eleventh embodiment, the control piston 27 is positioned on an opposite side of the needle with respect to the control piston 24. In a state that the needle 21 is seated on the valve seat 12*a,* the control piston 27 is retained on a shoulder portion 161 of the valve holder 160 and is in no contact with the control piston 24. The first control chamber 60 is provided between the control pistons 24 and 27. The second control chamber 65 is provided on an opposite side of the first control chamber relative to the control piston 27.

The control valve 170 is slidably and reciprocatingly housed in the valve holder 162. A spring 173 urges the control valve 170 toward a valve seat 166 of valve seat element 165. A piezo element 180 is connected in circuit with a pin 182 embedded in a connector 181. When a current voltage is applied to the piezo element 180, the piezo element 180 is expanded downward in FIG. 23. As the applied voltage is higher, an expanded length of the piezo element 180 becomes longer.

An end of a hydraulic piston 183 is in contact with the piezo element 180 and the other end thereof is in contact with a plate spring 184. So, the hydraulic piston 183 is urged toward the piezo element 180. A hydraulic piston 188 is urged toward the hydraulic piston 183 by a spring 188. A rod 187 of the hydraulic piston 186 is in contact with the control valve 170.

Figure 24:
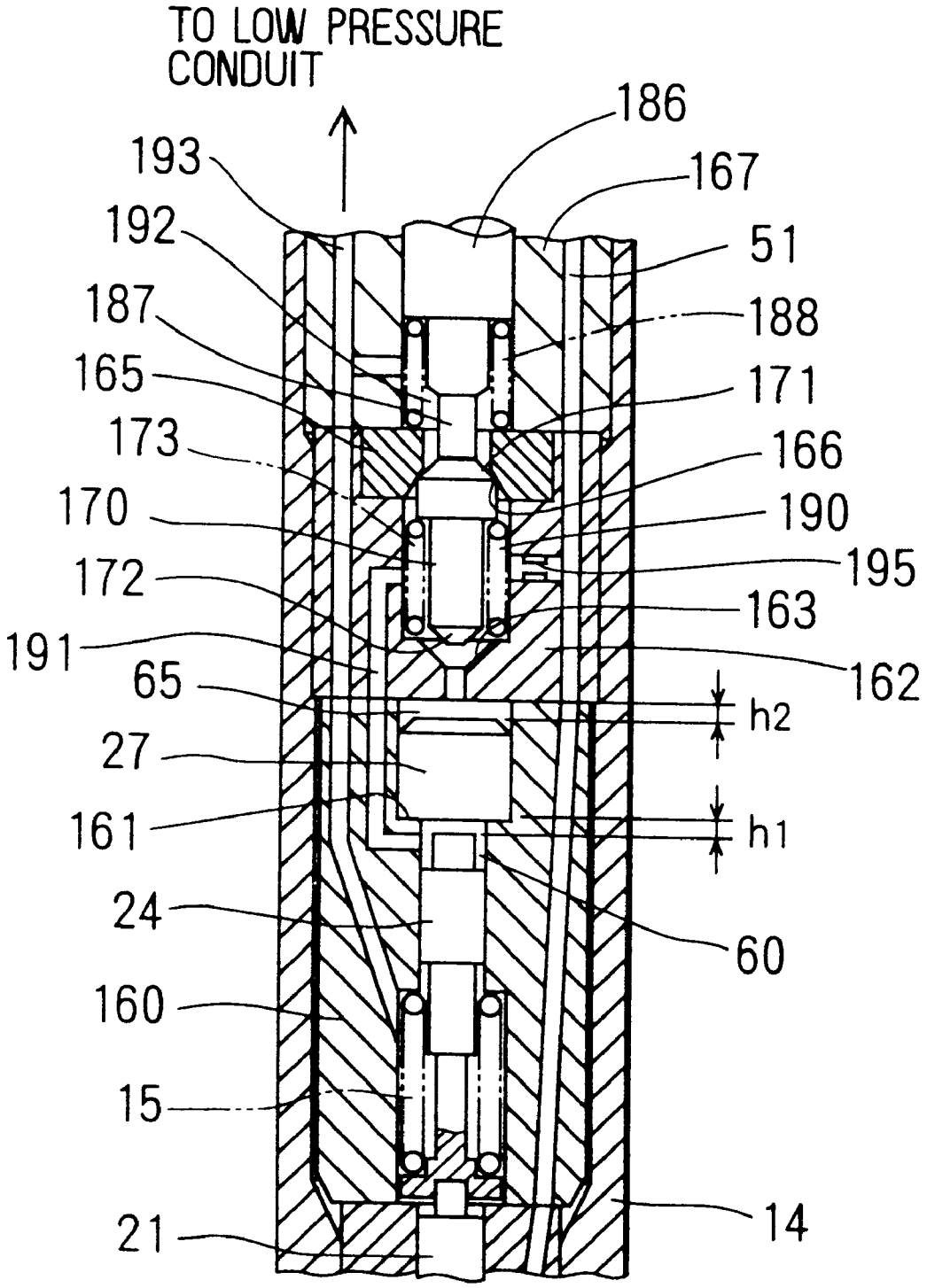
FIG. 24 is a partly enlarged view of the injector shown in FIG. 23.

As shown in FIG. 24, high pressure fuel is applied to a fuel space 190 formed around the control valve 170 via the fuel passage 51 and a throttle 195 from the common rail irreverently to a position of the control valve 170. In a state that a contacting portion 171 of the control valve 170 is seated on the valve seat 166 and a contacting portion 172 thereof is away from a valve seat 163, the fuel space 190 is communicated via a communicating passage 191 to the first control chamber 60 and also to the second control chamber 65. A fuel space 192 around a rod 187 is communicated with a low pressure fuel passage 193.

Next, an operation of the injector 7 is described.

Figure 23:
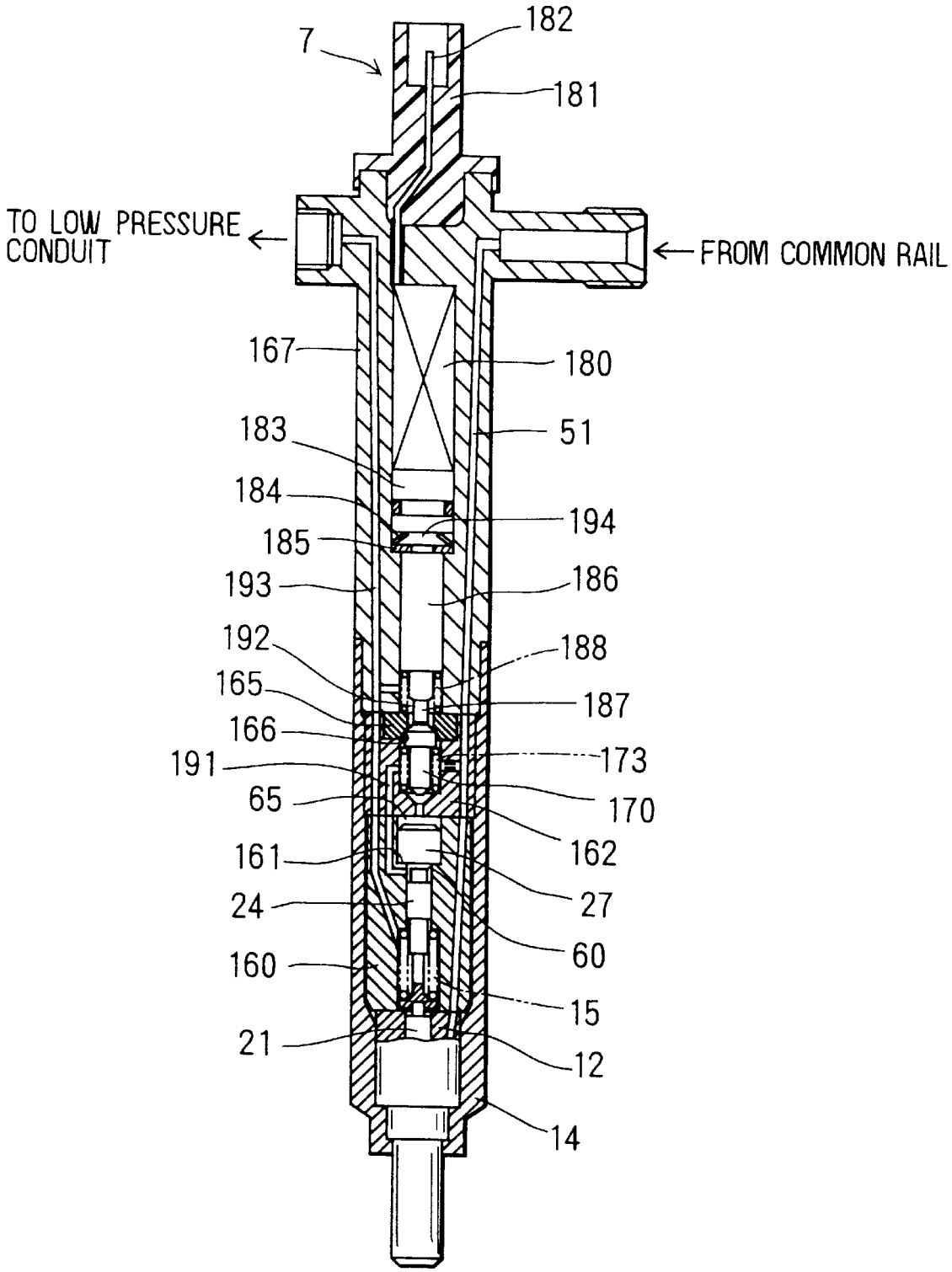
FIG. 23 is across sectional view of an injector according to an twelfth embodiment of the present invention.

(1) In a state that the voltage is not applied to the piezo element 180, the hydraulic pistons 183 and 186 are positioned as shown in FIG. 23. The control valve 170 is seated on the valve seat 166 of the valve seat element 165 by a biasing force of the spring 173. As the communication between the fuel space 190 and the low pressure fuel space 192 is interrupted, the fuel space 190 is under high pressure due to high pressure fuel supplied from the fuel passage 51. The first and second control chambers 60 and 65, which are communicated with the fuel space 190, are under high pressure. As an area of the control piston 27 receiving fuel pressure from the second control chamber 65 is larger than that receiving fuel pressure from the first control chamber 60, the control piston 27 is urged downwardly in FIG. 23 and in contact with a shoulder portion 161 of the valve holder 160. The control piston 24 and the needle 21 receive fuel pressure from the first control chamber 60 and are seated on the valve seat of the valve body 12 to close the injection hole.

(2) When the voltage is applied to the piezo element 180 and the piezo element 180 is expanded, the hydraulic piston 183 is moved downward in FIG. 23. Presuming that the expanded amount of the piezo element 180, that is, the moved amount of the hydraulic piston 183, is L, a cross sectional area of the hydraulic piston 183 is Ahl and a cross sectional area of the hydraulic piston 186 is Ahs, the hydraulic piston 186 is driven by the piezo element 180 to move downward by (L×Ahl/Ahs) in FIG. 23. As the rod 187 of the hydraulic piston 187 is in contact with the control valve 170, the L downward expansion of the piezo element 180 causes the control valve 170 to move downwardly by (L×Ahl/Ahs) in FIG. 23.

① When the contacting portion 171 of the control valve 170 leaves the valve seat 166 and the contacting portion 172 comes in contact with the valve seat 163 of the valve holder 162 due to the expansion of the energized piezo element 180, the first control chamber 60 is communicated with the low pressure fuel passage 93 via the communicating passage 191, fuel space 190, a opening portion between the contacting portion 171 and the valve seat 166, and the fuel space 192. As an area of the opening portion between the contacting portion 171 and the valve seat 166 is larger than a passage area of the throttle 195 through which high pressure fuel is supplied to the fuel space 190, pressure of the first control chamber 60 is reduced. The fuel pressure reduction in the first control chamber 60 causes the control piston 24 and the needle 21 to lift so that fuel is injected.

Figure 25:
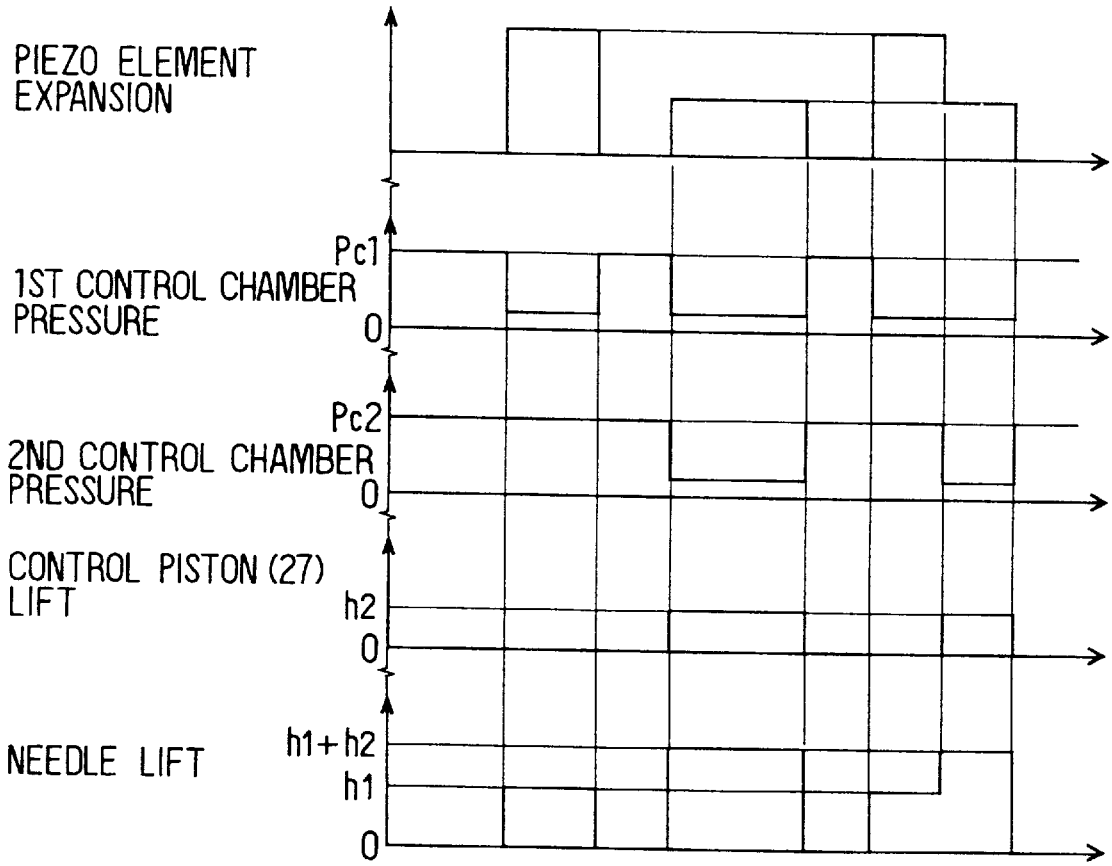
FIG. 25 is a time chart showing a stepwise lift according to the twelfth embodiment.

As the contacting portion 172 is seated on the valve seat 163 and the second control chamber 65 is closed, fuel pressure in the second control chamber is maintained. Therefore, when the control piston 24 lifts by h1 and runs into the control piston 27, the control piston 24 is retained to the control piston 27 due to the fuel pressure of the second control chamber 65 (refer to FIG. 25 (A)).

② When a smaller current voltage than that ① mentioned above is applied to the piezo element 180 and the movement amount of the control valve 170 becomes smaller than (L×Ahl/Ahs), the control valve 170 is kept at a position where the control valve 170 leaves not only the valve seat 163 but also the valve seat 166. Then, the first and second control chambers 60 and 65 are communicated via the fuel space 170, the opening portion between the contacting portion 171 and the valve seat 166, and the fuel space 192 to the low pressure fuel passage 193 so that fuel pressure in the first and second control chambers 60 and 65 may be reduced. When the control piston 24 lifts and runs into the control piston 27 according to the fuel pressure reduction of the second control chamber 65, the needle 21 together with the control pistons 24 and 27 lifts by (h1+h2) until the control piston 27 is stopped by an end surface of the valve holder 162 on a side of the needle 21 as shown in FIG. 25(B), as the fuel pressure of the second control chamber 65 is reduced, too. ③ When the piezo element 180 is deenergized after a lapse of a given time, the piezo element 180 contracts to a position shown in FIG. 23. Then, the hydraulic piston 186 is moved upward in FIG. 23 by a biasing force of the spring 188 and the control valve 170 is seated on the valve seat 166 due to a biasing force of the spring 173. The communication of the first and second control chambers 60 and 65 with the low pressure fuel passage is interrupted so that fuel pressure of the both control chambers may increase. Accordingly, the control piston 24 and the needle 21 are urged in a direction of closing the injection hole by the fuel pressure of the first control chamber 60 so that fuel injection may be stopped.

According to the twelfth embodiment, as the control valve 170 is driven by the expansion and contraction of the piezo element 180, an opening and closing response of the injector 7 may be improved, compared to a case that the control valve is driven by a magnetic attracting force of energized coils.

(Thirteenth Embodiment)

Figure 26:
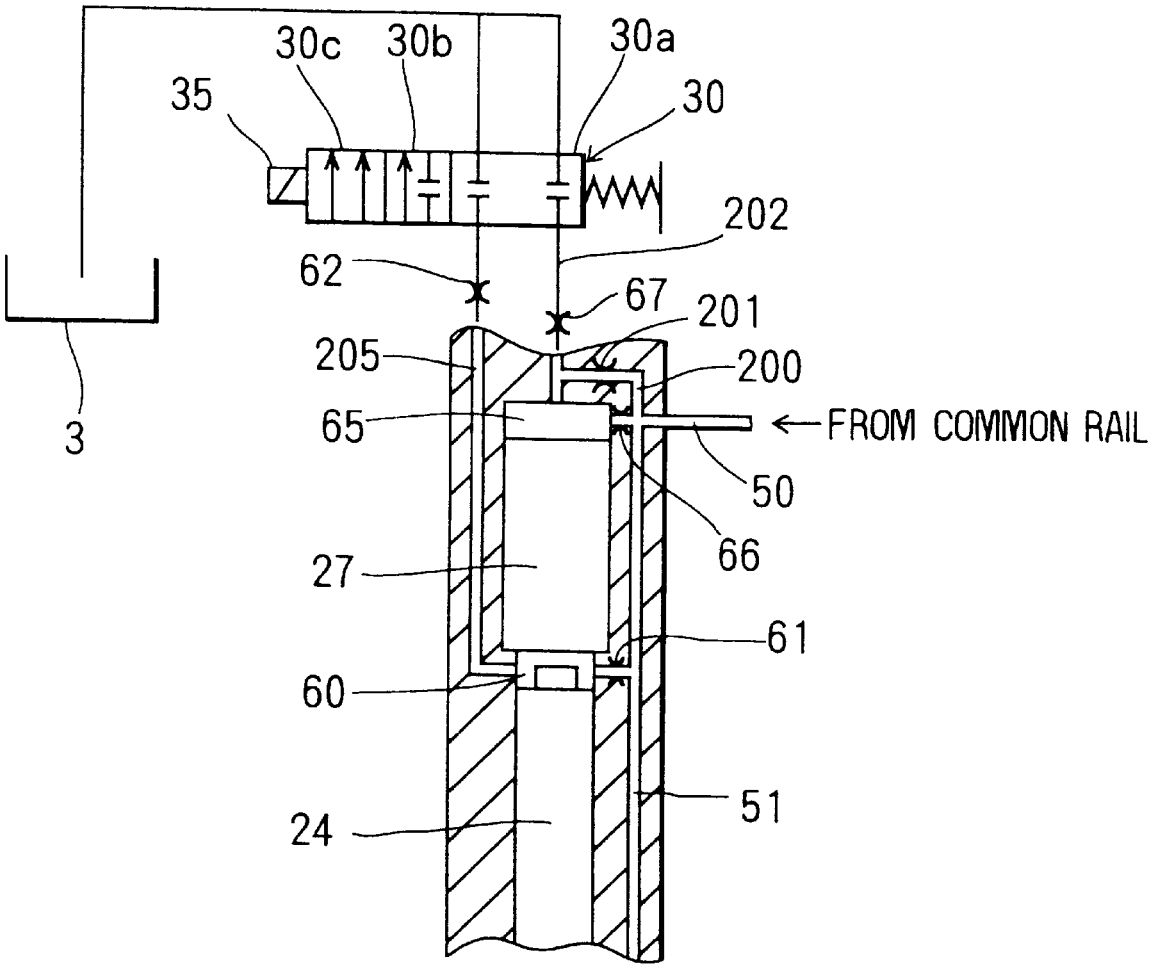
FIG. 26 is a schematic cross sectional view showing an injector according to a thirteenth embodiment.

A thirteenth embodiment of the present invention is described with reference to FIG. 26. With respect to components and construction substantially same to those of the eleventh embodiment, to which the same reference numbers are affixed, the explanation thereof is omitted.

Provided is a bypass passage 200, which communicates a fuel passage 202 connecting the second control chamber 65 and the electromagnetic valve 30 to the fuel in-flow passage 50 for introducing high pressure fuel of the common rail. The bypass passage is provided with a throttle 201, whose passage area is smaller than that of the outlet throttle 67. A fuel passage 205 connects the first control chamber 60 and the electromagnetic valve 30.

Figure 28A:
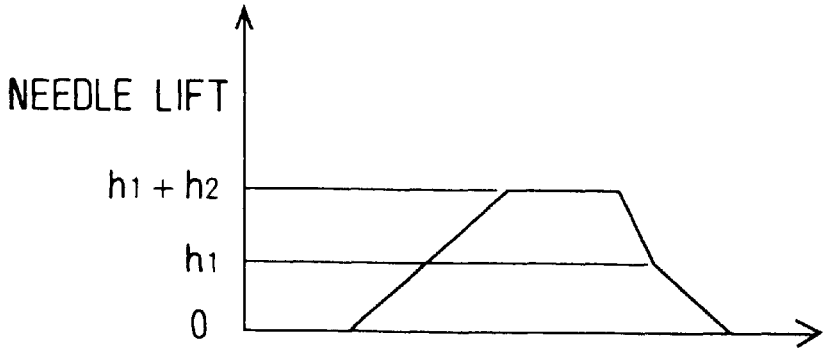
FIG. 28A is a timing chart showing a valve closing speed of a needle according to the thirteenth embodiment.
Figure 28B:
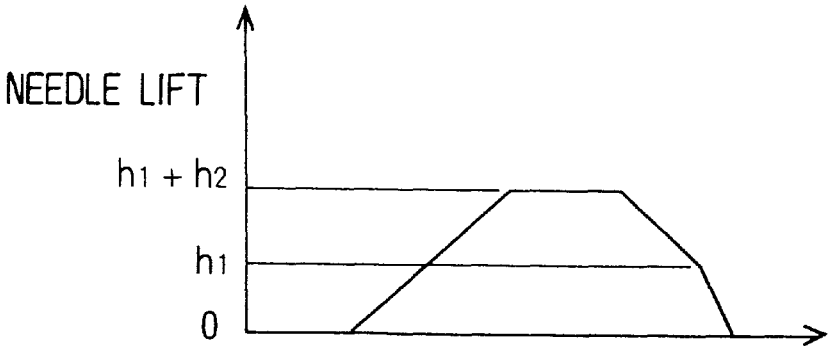
FIG. 28B is a timing chart showing a valve closing speed of a needle according to a modification of the thirteenth embodiment.
Figure 28C:
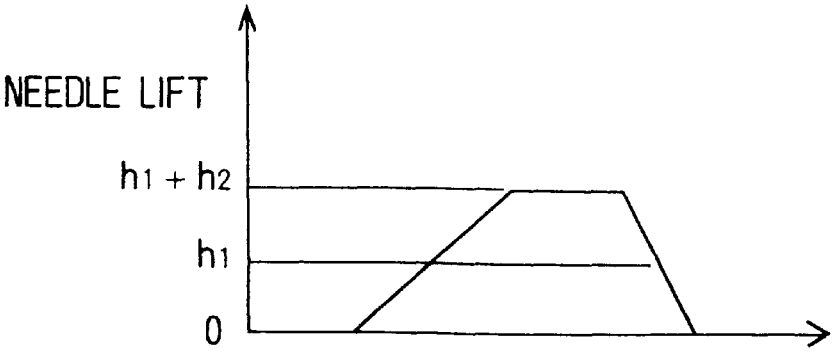
FIG. 28C is a timing chart showing a valve closing speed of a needle according to the thirteenth embodiment combined with the modification of the thirteenth embodiment.

When the valve portion 30*c* of the electromagnetic valve 30 is selected, the control valve 27 lifts so that the control piston 24 and the needle may lift by (h1+h2). Then, when the valve portion 30*a* of the electromagnetic valve 30 is selected by deenergizing the coil 35 of the electromagnetic valve 30, high pressure fuel is supplied from the common rail via the throttle 201 in addition to the inlet throttle 66 to the second control chamber 65. An increasing rate of the fuel pressure in the second control chamber 65 is higher than that according to the eleventh embodiment. As a valve closing speed of the needle, which moves from the lifting amount (h1+h2) to the lifting amount h1 as shown in FIG. 28A, becomes higher, fuel to be injected from the injection hole may be rapidly interrupted, resulting in decreasing unburned emissions. The valve closing speed of the needle may be controlled by adjusting the passage area of the throttle 201.

(Modification)

Figure 27:
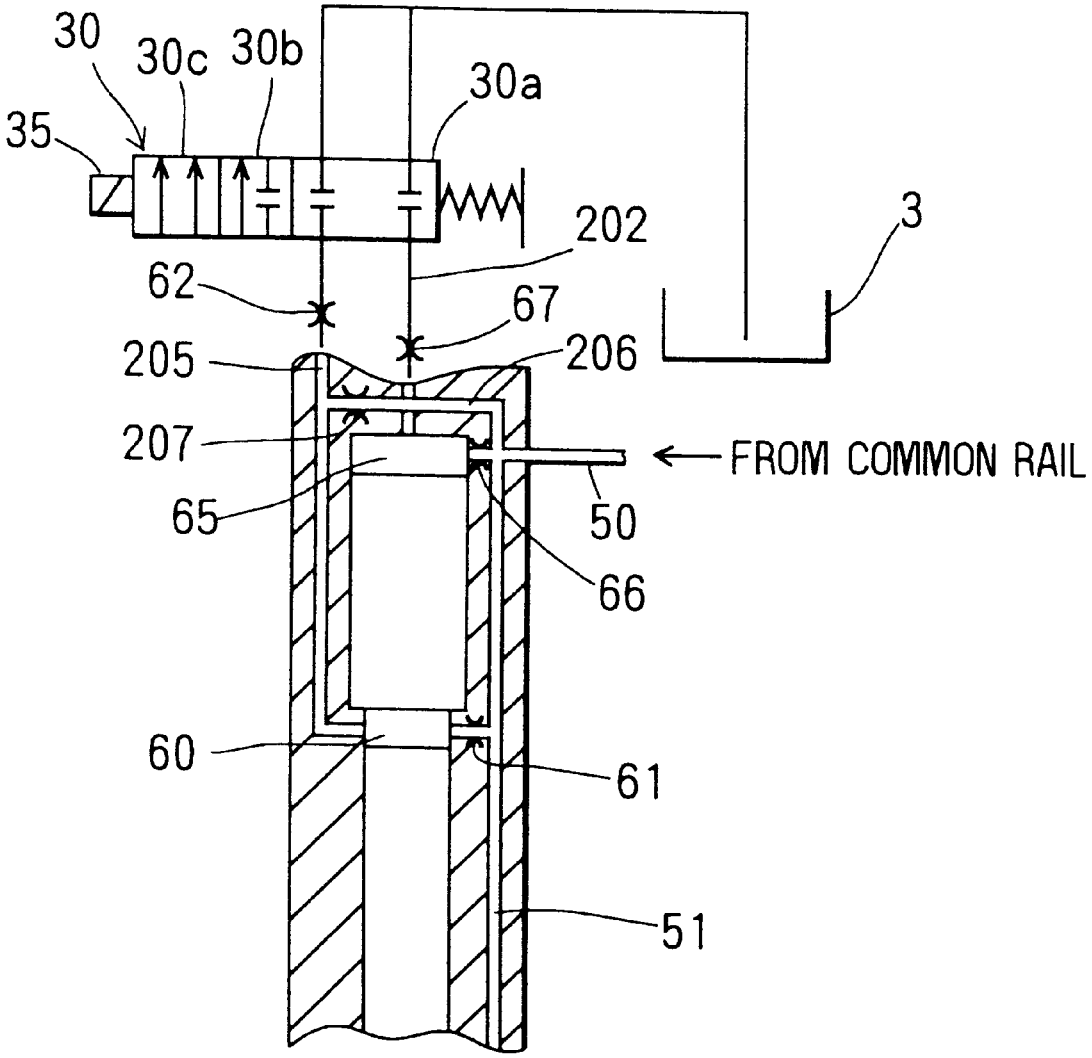
FIG. 27 is a schematic cross sectional view showing a modification of the injector according to the thirteenth embodiment.

Instead of the bypass passage 200 connecting the fuel in-flow passage 50 and fuel passage 202, a bypass passage 206 with a throttle 207 is provided as shown in FIG. 27. The bypass passage 206 communicates the fuel passage 51 for introducing high pressure fuel of the common rail to the first control chamber 60 with a fuel passage 205. A passage area of the throttle 207 is smaller than that of the outlet throttle 62.

For example, in a state that the control piston 24 and the needle lift by h1, the valve portion 30*a* of the electromagnetic valve 30 is selected by deenergizing the coil 35 of the electromagnetic valve 30, high pressure fuel is supplied from the common rail via the throttle 207 in addition to the inlet throttle 61 to the first control chamber 60. An increasing rate of the fuel pressure in the first control chamber 60 is higher than that according to the eleventh embodiment. As a valve closing speed of the needle, which moves from the lifting amount h1 till the injection hole is closed as shown in FIG. 28A, becomes higher, fuel to be injected from the injection hole may be rapidly interrupted, resulting in decreasing unburned emissions.

The valve closing speed of the needle may be controlled by adjusting the passage area of the throttle 207. Further, both of the bypass passages 200 and 206, which have the throttles 201 and 207, respectively, may be provided. In this case, the valve closing speed from the lifting amount (h1+h2) to the injection hole closing may be totally increased.

According to the eleventh to thirteenth embodiments, the first control chamber 60 is formed between the control pistons 24 and 27 and the control pistons 24 and 27 do not come in contact with each other in a lifting amount range from 0 to h1. The injection hole may be opened and closed by controlling fuel pressure of the first control chamber 60 and a lifting amount of the needle 21 may be stepwise changed by controlling fuel pressure of the second control chamber 65.

Further, though the two stages lifting is described according to the embodiments mentioned above, three or more than three stages lifting is available, for example, in such a way that three or more than three springs are provided for biasing the valve body element in a direction of closing the injection hole and three or more than three control chambers are provided for applying fuel pressure to the valve body element in a direction of closing the injection hole.

(Fourteenth Embodiment)

Figure 29A:
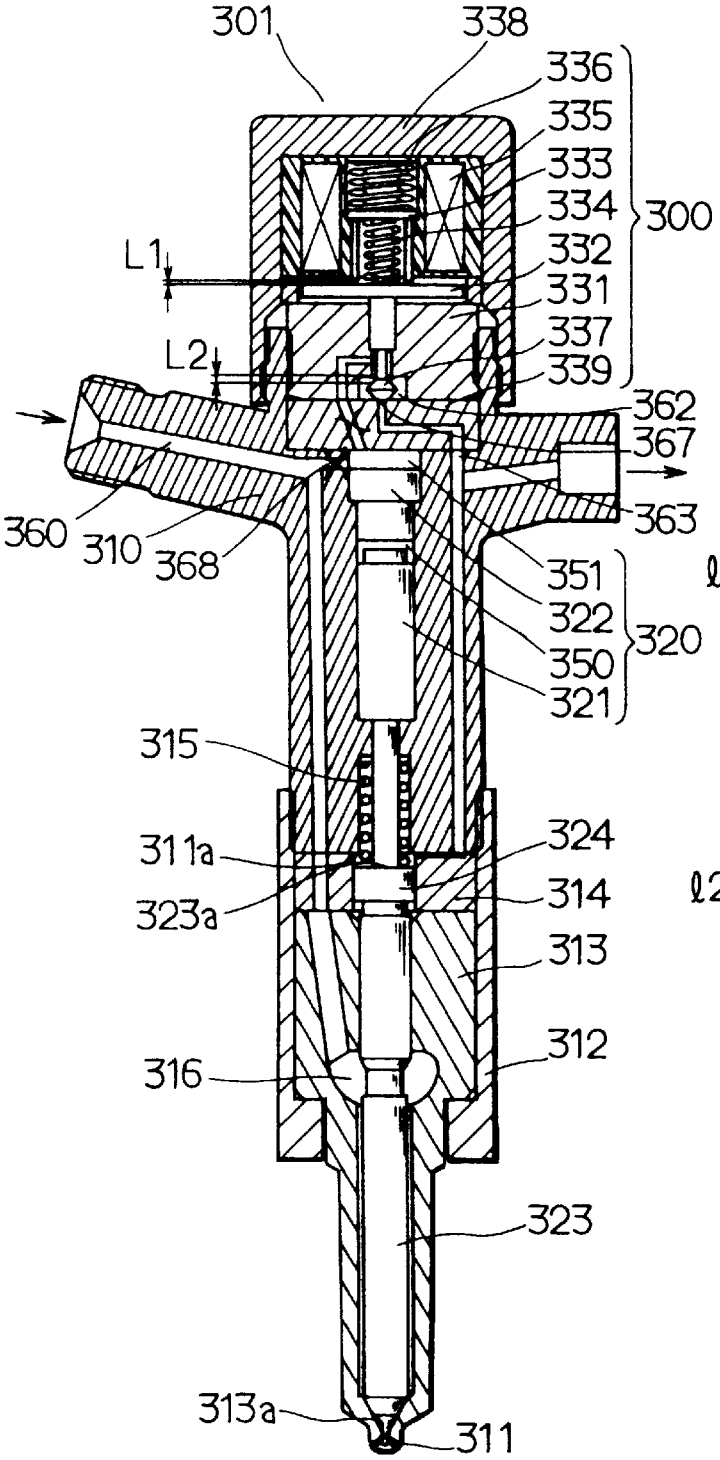
FIG. 29A is a cross sectional view of injector according to a fourteenth embodiment.
Figure 29B:
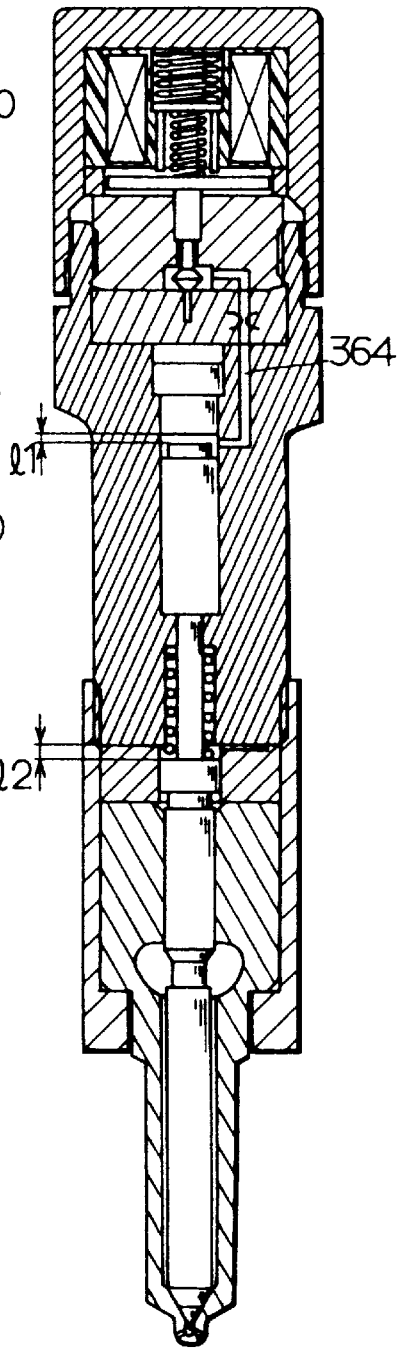
FIG. 29B is a cross sectional view rotated by 90° with respect to the injector of FIG. 29A.
Figure 30:
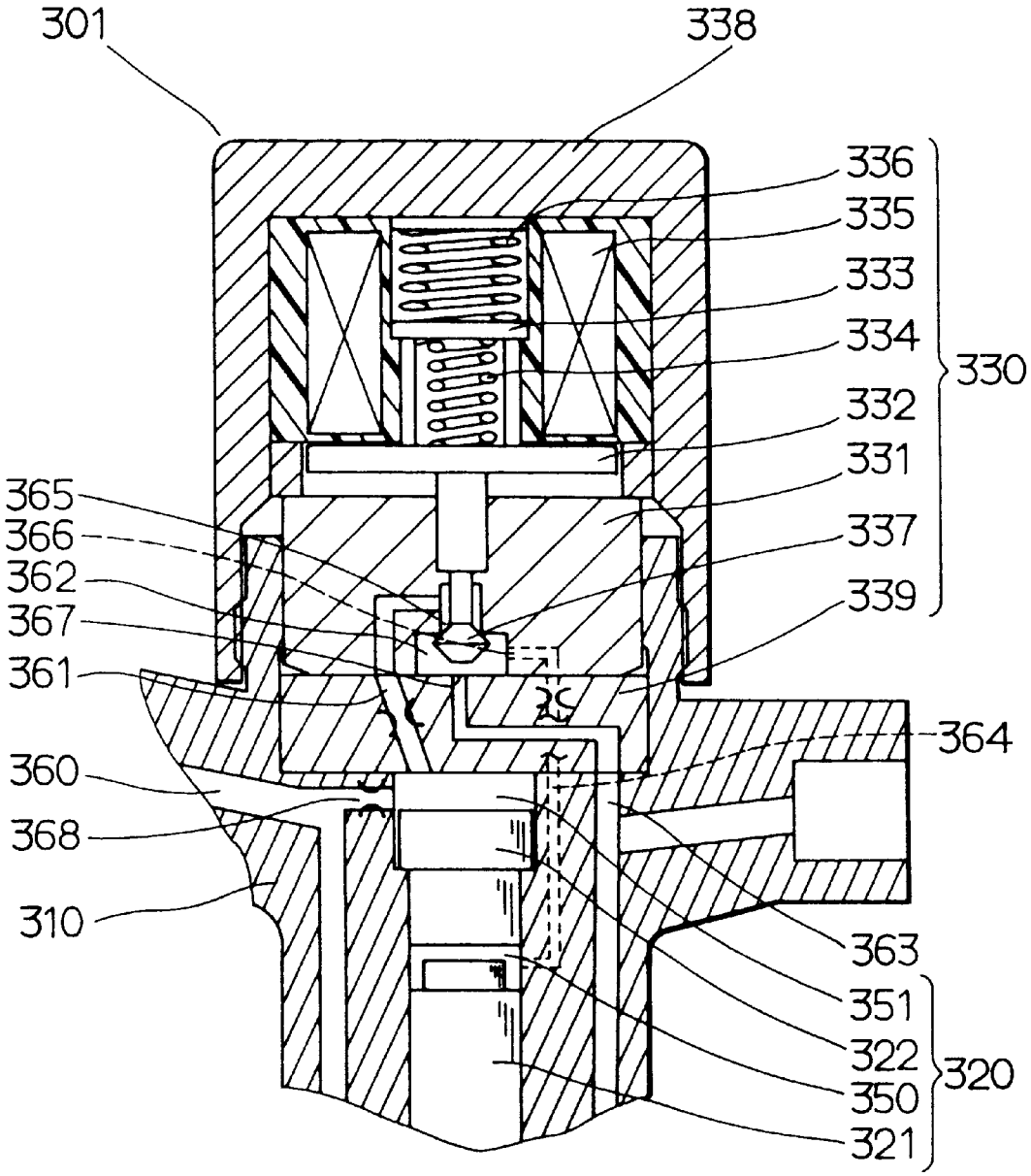
FIG. 30 is a part view showing a second lift of a valve element of the injector according to the fourteenth embodiment.
Figure 31:
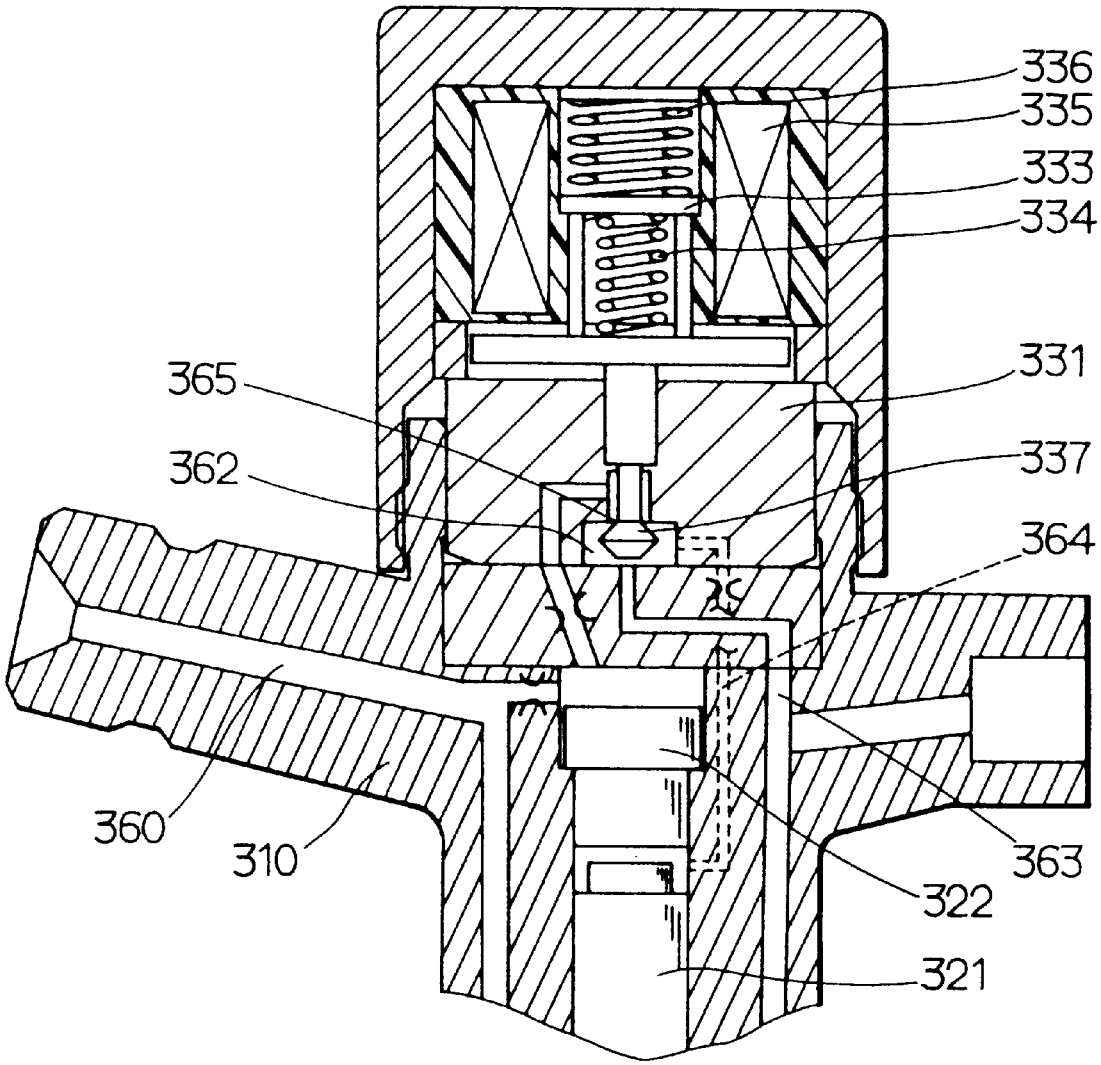
FIG. 31 is a part view showing a first lift of the valve element of the injector according to the fourteenth embodiment.

A construction of a fuel injector according to a fourteenth embodiment is described with references to FIGS. 29A, 29B, 30 and 31. FIGS. 29A and 29B are cross sectional views of the fuel injector. FIG. 30 is a partial cross sectional view showing a second lifting state of a valve element of the fuel injector shown in FIGS. 29A and 29B. FIG. 31 is a partial cross sectional view showing a first lifting state of a valve element of the fuel injector shown in FIGS. 29A and 29B.

According to the fuel injector 301 basically shown in FIGS. 29A and 29B, a first control piston 321 and a second control piston 322 on an upper side of the first control piston 321 are disposed in a housing 310. A first control chamber 350 is formed between the first and second control pistons 321 and 322 and a second control chamber 351 is formed on an upper end surface of the second control piston 322. Fuel pressure of the first and second control chambers 350 and 351 are controlled by an electromagnetic valve 330 provided above the second control chamber 351 so that a lifting amount of a needle 323, which is provided below the first control chamber 350 for opening and closing an injection hole 311, may be changed to secure an adequate shape of the injection rate.

A valve body 313 is fastened via a tip packing 314 to the housing 310 by a retaining nut 312. A control device 320 is composed of the first control piston 321, the first control chamber 350, the second control piston 322 and the second control chamber 351. The needle 323 and a rod 324, which work with the control device 320, are arranged on a side of the injection hole relative to the control device 320. The needle 323 is held slidably and reciprocatingly in the valve body 313. A first needle spring 315 is provided for urging the needle 323 via the rod 324 toward the injection hole 311.

The housing 310 is provided with a high pressure passage 360 communicated with a common rail (not shown). The high pressure passage 360 is communicated via the housing 310, the tip packing 314 and the valve body 313 to a fuel accumulating space 316 formed in the valve body 313. Further, the high pressure passage 360 is communicated via a communicating passage 368 to the second control chamber 351. Accordingly, high pressure fuel supplied from the common rail is supplied via the high pressure passage 360 to the second control chamber 351 and the fuel accumulating space 316. Further, the fuel is supplied, as shown in FIG. 30, via a communicating passage 361 opened to the second control chamber 351 and a valve chamber 362 described later, from the second control chamber 351 to the first control chamber 350.

A control valve 330 housed in a valve cover 338 (electromagnetic valve) is fastened by screw between an upper part of the housing 310 and the valve cover 338. The control valve 330 is composed of a body 331, an armature 332, a stopper 333, a first spring 334, an electromagnetic coil 335, a second spring 336, a valve element 337, a plate 339 and a valve chamber 362.

The valve chamber 362 is formed in the body 331 and the valve element 337 connected to the armature 332 is housed in the valve chamber 362. A second opening 365 to be communicated with the communicating passage 361 is opened on an upper end surface of the valve chamber 362 at a portion where the armature 332 and the valve element are connected to each other. A first opening 366 to be communicated with the communicating passage 364 is opened near on a central side surface of the valve chamber 362. A low pressure opening 367 is opened on a lower end surface of the valve chamber 362 through the plate 339.

The low pressure opening 367 is communicated with a low pressure passage 363, which is formed in the housing 310 and is communicated with a fuel tank (not shown) for releasing fuel in the valve chamber to the fuel tank.

The valve element 337 may be seated on the low pressure opening 367 by a biasing force of the first spring 334 through the armature 332. The valve element 337 may also be seated on the second opening 365 by moving upward with the armature 332 due to an attracting force of the electromagnetic coil 335.

FIGS. 29A and 29B show a state, when the electromagnetic coil 335 is not energized, that the valve element 337 is seated on the low pressure opening 367 and the needle 323 is seated on a valve seat 313A by the biasing force of the first spring 315 and fuel pressure of the first and second control chambers 350 and 351. In FIGS. 29A and 29B, a reference number 323*a* show a shoulder portion of the needle 323 and a reference number 311*a* shows a lower end surface of the housing 311.

As shown in FIG. 31, the armature 332 positioned above the valve element 337 is moved upwardly against the biasing force of the first spring 334 by an electromagnetic attracting force exerted by energizing the coil 335 so that the valve element 337 may lift by a first lifting amount until the valve element 337 comes in contact with a lower end of a stopper 333.

The valve element 337 stops after moving a lift distance L1, as shown in FIG. 29A, since the valve element 337 receives a biasing force of a second spring 336 at this position so that the attracting force exerted by the coil 335 is balanced with a sum of the biasing forces of the first and second springs 334 and 336.

When higher current is supplied to the electromagnetic coil 335 and the attracting force to the valve element 337 becomes higher, the valve element 337 further lifts against the sum of the biasing forces of the first and second springs 334 and 336. Then, as shown in FIG. 30, the valve element 337 lifts by a second lifting amount until the valve element 337 comes in contact with the second opening 365 provided in the valve chamber 362 so that the valve element 337 may close the second opening and stop at this position. As shown in FIG. 29A, a lifting amount of the valve element 337 from a position where the valve element 337 is seated on the low pressure opening 367 to a position where the valve element 337 is in contact with the second opening 365 is L2. Therefore, a moving amount of the valve element 337 from the first lifting amount to the second lifting amount is (L2–L1).

Next, an operation of the fuel injection valve 301 is described with reference to FIGS. 29A, 29B, 30, 31 and 32.

Current for driving the electromagnetic coil 335, a value of which is controlled by an engine control apparatus (ECU) according to engine operations, is supplied to the coil 335. The electromagnetic attracting force of the coil 335 exerted by the current supply attracts the armature 332 for lifting the valve element 337.

Figure 32:
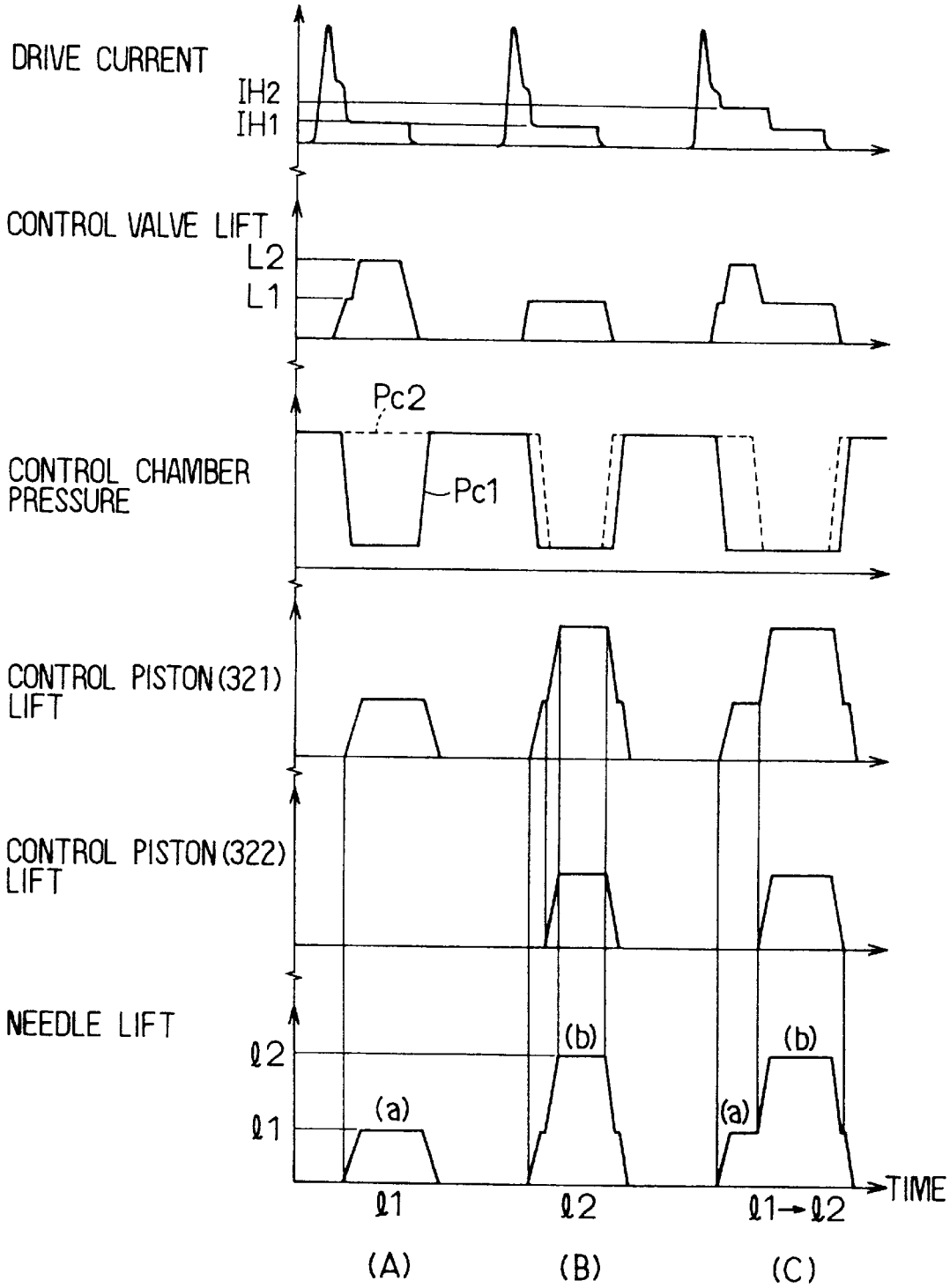
FIG. 32 is a time chart showing a stepwise lift according to the fourteenth embodiment.
Figure 33:
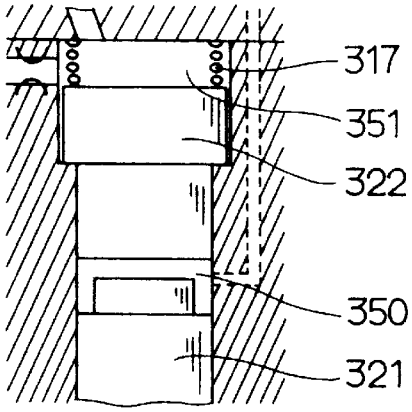
FIG. 33 is a view of a control valve according to a modification of the fourteenth embodiment.

When the valve element 337 shows the lifting amount L2 (refer to FIG. 30 and a timing (A) of FIG. 32), the passage between the second control chamber 351 and valve chamber 362 is closed as the opening 365 is closed, while the communication between the valve chamber 362 and the low pressure passage 363 is kept. That is, the second control chamber 351, to which high pressure fuel is supplied from the common rail (not shown), in interrupted to communicate with the low pressure passage 363. On the other hand, the first control chamber 350 is communicated via the first opening 366 of the valve chamber 362 to the low pressure passage 363 so that fuel pressure (PC1) of the first control chamber 350 may be reduced. Accordingly, as a sum of a pre-load biasing force of a first needle spring 315 and a force of receiving fuel pressure in the first control chamber 350, both of which act in a direction of closing the injection hole, becomes smaller than a force of moving upward the needle 323 due to fuel pressure of the fuel accumulating space 316 so that the needle 323 may start lifting. According to the fuel pressure decrease of the first control chamber 350, the needle 323 continues to lift and, after the needle 323 moves by a L1 lift, the first piston 321 comes in contact with an end surface of the second piston 322. At this time, as the fuel pressure (PC2) of the second control chamber 351 is kept high, the force acting in a direction of closing the injection hole due to the fuel pressure of the second control chamber 351 is larger than the force of moving upward the needle 323 so that a lifting amount of the needle 323 may not exceed the L1 lift.

When the valve element 337 shows the lifting amount L1 (refer to FIG. 30 and a timing (B) of FIG. 32), the first and second control chambers 350 and 351 are communicated to the low pressure passage 363 as all of the first, second and low pressure openings 366, 365 and 367 are opened. As a result, fuel pressure of the first and second control chambers 350 and 351 are reduced. Therefore, the force acting in a direction of closing the injection hole becomes smaller than a force of moving upward the needle 323 so that the needle may move by a L2 lift so as to exceed the L1 lift. At this time, the shoulder portion 323*a* of the needle 323 is retained by the lower end surface 311*a* of the housing 311 to stop a further movement of the needle 323.

As shown in a timing (C) of FIG. 32, it is possible to move stepwise from the L1 lift to the L2 lift by changing the lifting amount of the valve element 337 from L2 to L1 during a fuel injection period.

Then, after a lapse of a predetermined time and when the current for driving the electromagnetic coil 335 is cut off and the valve element 337 closes the low pressure opening 367, fuel pressure of the first and second control chambers 350 and 351 increase, since the communication between the low pressure passage 363 and the valve chamber 362 is interrupted, so that the first and second pistons 321 and 322 may move in order for the needle 323 to close the injection hole.

When the valve element 37 shows the second lift L2 and only the first piston 321 lifts, that is, when the needle 323 moves by the L1 lift, high pressure fuel of the high pressure passage 360 never releases to the low pressure passage according to the fourteenth embodiment. Therefore, ineffective works of the fuel pump for delivering high pressure fuel to the injector may be limited so that fuel consumption of the engine may improve.

(Modification)

According to a modification of the fourteenth embodiment, in addition to the first needle spring 315 for urging the needle 323 in a direction of closing the injection hole 311, a second needle spring 317 is provided in the second control chamber 351.

The second needle spring 317 is operative to urge the second piston 322 in a direction of closing the injection valve in addition to fuel pressure of the second control chamber 351 when the first piston 321 lifts and comes in contact with the second piston 322 according to fuel pressure decrease of the first control chamber 350 so that the second piston 322 may not be moved upward by an inertia force due to the lift of the first piston 321. As mentioned above, the second needle spring 317 serves to make the needle 323 lift accurately by the L1 lift so that the fuel injection valve may inject a stable injection amount.

(Fifteenth Embodiment)

Figure 34:
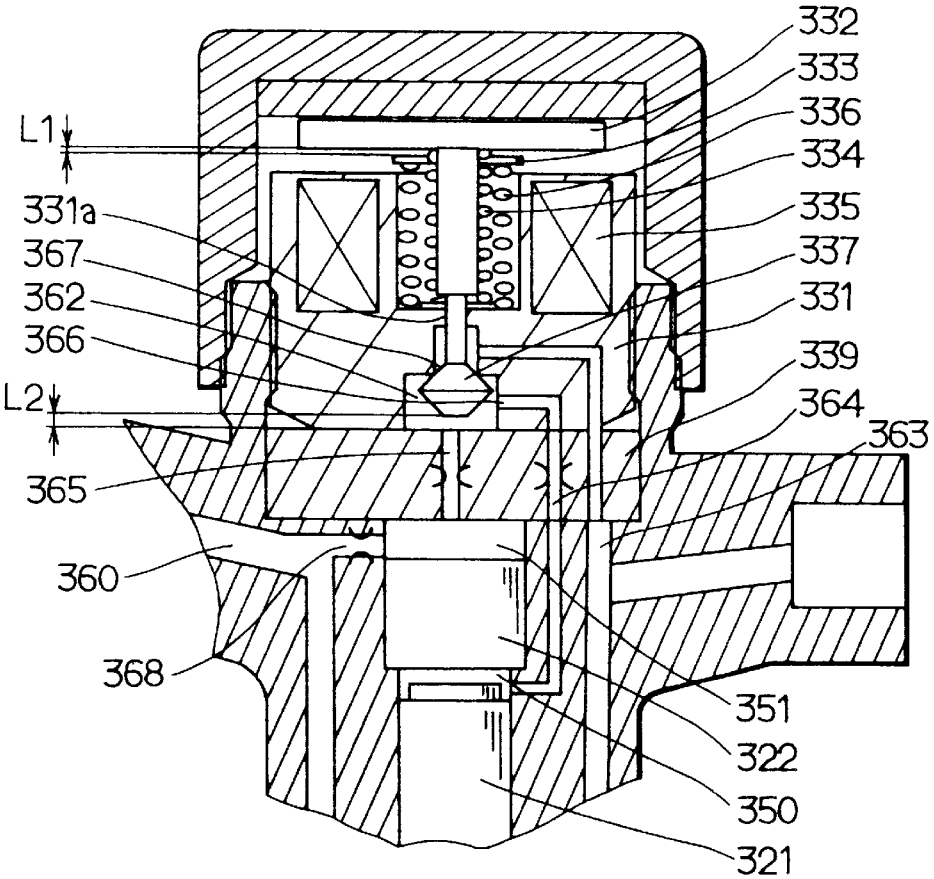
FIG. 34 is a cross sectional view of an electromagnetic valve of the injector according to a fifteenth embodiment.

A fifteenth embodiment of the present invention is described with reference to FIG. 34. With respect to components and construction substantially same to those of the fourteenth embodiment, to which the same reference numbers are affixed, the explanation thereof is omitted. A difference from the fourteenth embodiment is that the electromagnetic coil 335 is disposed at a lower part of the armature 332. According to the fifteenth embodiment, the attracting force on energizing the coil 335 acts to move downward the armature 332 so that the valve element 337 may lift downwardly. The low pressure opening 367 is positioned on an upper side of the valve chamber 362 and, when current for driving the coil 335 is not supplied, the low pressure opening 367 is closed so that fuel pressure of the first and second control chambers 350 and 351 may increase and the needle 323 may close the injection hole. As the low pressure passage 363 is connected on the upper side of the valve chamber 362, fuel leakage from a clearance 331*a* between the valve element 337 and a body 331 may be reduced.

(Sixteenth Embodiment)

Figure 35:
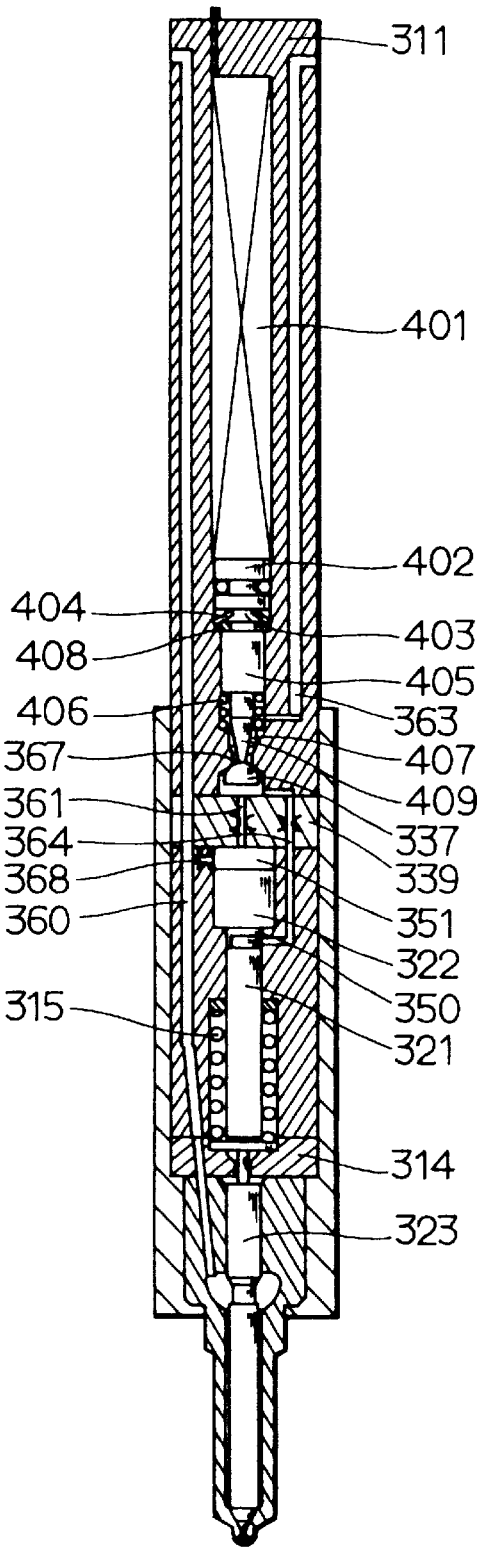
FIG. 35 is a cross sectional view of an injector according to a sixteenth embodiment.

A sixteenth embodiment of the present invention is described with reference to FIG. 35. With respect to components and construction substantially same to those of the fourteenth embodiment, to which the same reference numbers are affixed, the explanation thereof is omitted. A difference from the fourteenth embodiment is that, instead of the electromagnetic coil 335 for diving the valve element 337, a piezo element 401 is used. The piezo element 401 is contained in the housing 311 and, when current voltage is applied to the piezo element 401 according to a demand of a control computer (not shown), is expanded in an axial direction of the needle 323.

As an upper end of the piezo element 401 is retained by the housing 311, the expansion of the piezo element 401 urges a hydraulic piston 402, which is biased upwardly by a spring 404 and whose movement is followed to the movement of the piezo element 401. A movement of the first hydraulic piston 402 is transferred via a hydraulic chamber 403 to a second hydraulic piston 405 so that a lift amount of the second hydraulic piston corresponds to an expanded amount of the piezo element 401 multiplied by a ratio of a cross sectional area AH1 of the hydraulic piston 402 to a cross sectional area AH2 of the second hydraulic piston 405.

The hydraulic chamber 403 is formed by the housing 311 and the hydraulic pistons 402 and 405. An upward movement of the second hydraulic piston 405 is restricted by a stopper 408 and a spring 406 urges the second piston 405 upwardly. The spring 406 is positioned in an inner space of the housing 311 and the inner space 407 is communicated via the low pressure passage 363 to the fuel tank (not shown).

There is a small gap between a small diameter portion 409 of the second hydraulic piston 405 and the valve element 337 urged to the low pressure opening 367 in the valve chamber 362 by a spring (not shown) and, when the second hydraulic piston 405 moves downward, the small diameter portion 409 moves to come in contact with the valve element 337 and, then, to make the valve element 337 move downward so that the low pressure opening 367 may be opened. The valve chamber 362 is communicated via the passage 364 to the first control chamber 350 and via the passage 361 to the second control chamber 351. The second pressure chamber 351 is connected to the high pressure passage 360 communicated to the common rail (not shown).

The injection valve according to the sixteenth embodiment, in which a lift amount of the valve element 337 is controlled by changing current to be applied to the piezo element 401, has a same operation as disclosed in the fourteenth embodiment.

When the piezo element 401 is driven to move the valve element 337 with a high lifting amount so that the needle 323 may lift by the L1 lift, the first hydraulic piston 402 is driven against the biasing force of the spring 404 according to the expansion of the piezo element 401 so that pressure in the hydraulic chamber may increase. The increased hydraulic pressure in the hydraulic chamber 403 causes to drive the second hydraulic piston 405 against the biasing force of the spring 406. The small diameter portion 409 comes in contact with the valve element 337 and drives to move downwardly the valve element 337 so that the valve element 337 may come in contact with the plate 339 to interrupt the communication between the inner space 407 and the passage 361. As the valve element 337 moves downwardly, the first control chamber 350 is communicated via the passage 364 and the inner space 407 to the low pressure passage 363 so that pressure of the first control chamber is reduced. Accordingly, the needle 323 opens the injection hole since the force acting in a direction closing the injection hole becomes weaker. The first piston 321 comes in contact with the second piston 322 according to the upward movement of the needle 323 and a further lift movement of the first piston 321 stops at that place since pressure of the second chamber 351 is high.

When the piezo element 401 is driven to move the valve element 337 with a low lifting amount, the small diameter portion 409 of the second hydraulic piston 405 comes in contact with the valve element 337 and drives to move downwardly the valve element 337 to an extent that the valve element 337 does not come in contact with the plate 339. The first and second control chambers 350 and 351 are communicated via the passages 364 and 362 and the inner space 407 to the low pressure passage 363 so that pressure of the first and second control chambers are reduced. Therefore, even after the first piston 321 comes in contact with the second piston 322, the needle 323 continues to lift by the L2 lift until the needle 323 comes in contact with the tip packing 314 since the force acting in a direction closing the injection hole becomes lower than that of moving upwardly the needle 323.

Further, the injection rate in a boot shape may be secured by changing the expansion length of the piezo element 401 during the injection period. As the control valve of the piezo element 401 mentioned above may rapidly response to current supply for the expansion, the fuel injection valve having a better lifting response of the needle 323 may be realized.

(Seventeenth Embodiment)

Figure 36:
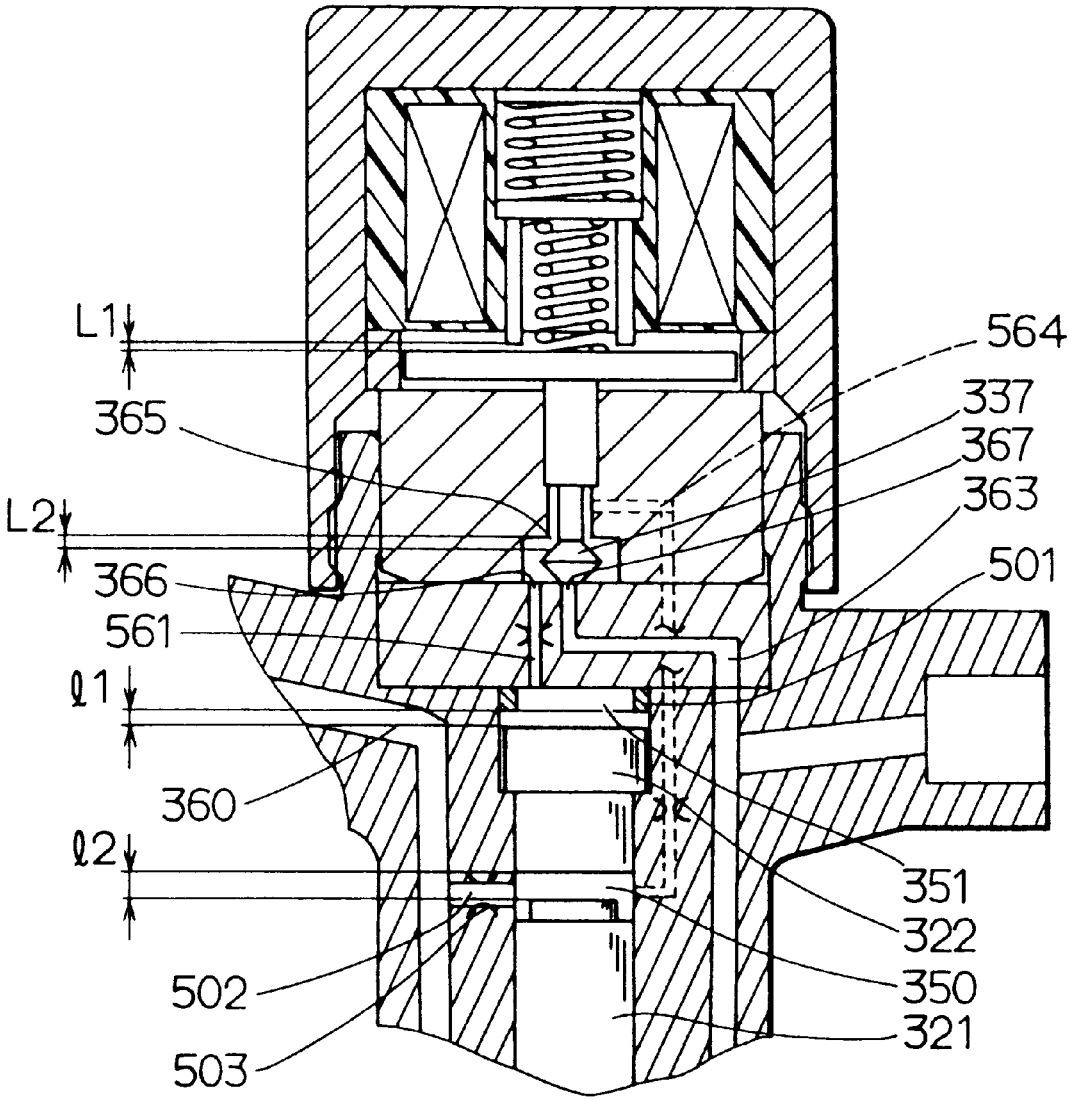
FIG. 36 is a cross sectional part view of an injector according to a seventeenth embodiment.

An seventeenth embodiment of the present invention is described with reference to FIG. 36. With respect to components and construction substantially same to those of the fourteenth embodiment, to which the same reference numbers are affixed, the explanation thereof is omitted. A difference from the fourteenth embodiment is that the high pressure conduit is directly communicated to the first control chamber and the lifting amount (the L1 lift) of the needle 323 is restricted by a movement of the second piston 322.

An operation of the injection valve according to the seventeenth embodiment is described hereinafter.

When the valve element 337 shows the lifting amount L2, the communication between the first control chamber 350 and the low pressure passage 363 is interrupted since the valve element 337 closes the second opening 365. The first control chamber 350 keeps a high fuel pressure state as the high pressure is introduced via the high pressure passage and a communicating passage 402 to the first control chamber 350. on the other hand, fuel pressure of the second control chamber 351 is reduced since the second control chamber 351 is communicated via the communicating passage 261, the first opening 366 and the low pressure opening 367 to the low pressure passage 363. Accordingly, the force of urging the second piston 322 in a direction of closing the injection hole becomes low and the second piston 322 moves upwardly (by the L1 lift) until the second piston 322 comes in contact with and be stopped by a stopper 401 provided at an upper portion of the second control chamber 351.

The area of the first control chamber 350 is changed in a direction of reducing fuel pressure in the control chamber 350 according to the upward movement of the second piston 322. However, as high pressure fuel amount supplied to the first control chamber 350 from the communication passage 402 is controlled by a throttle 403 so that the first control chamber 350 may keep the high pressure, the first piston may maintains a clearance 12.

When the valve element 337 shows the lifting amount L1, pressure of the first and second control chambers 350 and 351 are both reduced and the needle 323 further lift and moves by the L2 lift. With the construction mentioned above, the adjustment of the L1 lift may become simpler.

(Eighteenth Embodiment)

Figure 37:
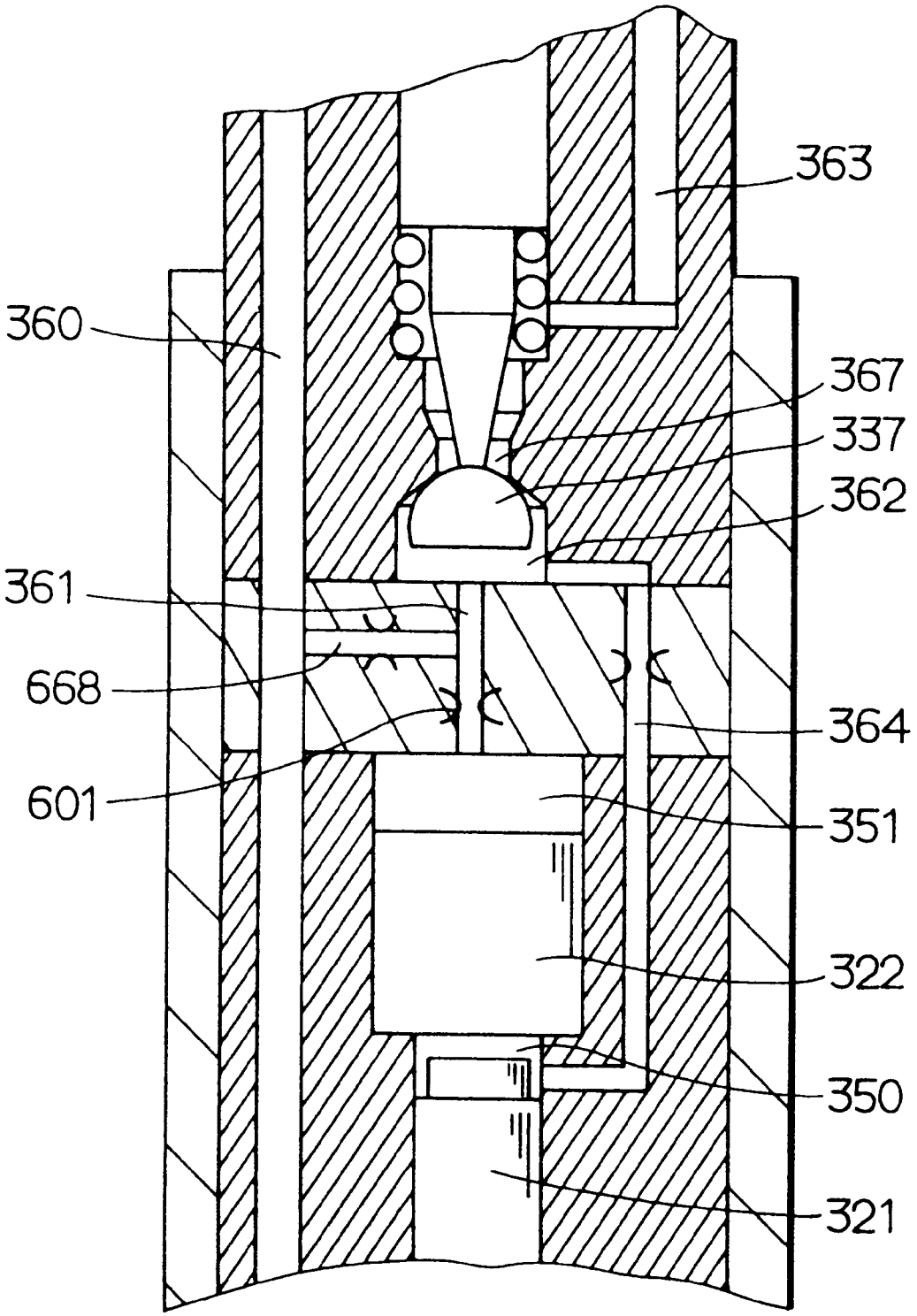
FIG. 37 is a cross sectional part view of an injector according to an eighteenth embodiment.

An eighteenth embodiment of the present invention is described with reference to FIG. 37. With respect to components and construction substantially same to those of the fourteenth embodiment, to which the same reference numbers are affixed, the explanation thereof is omitted. A difference from the fourteenth embodiment is a point that high pressure fuel is introduced to the second control chamber 351 from the high pressure passage 360 through a passage different from the passage of the fourteenth embodiment.

According to the fourteenth to sixteenth embodiments, the passage through which high pressure fuel is introduced to the second control chamber 351 from the high pressure passage 360 is the communicating passage 368. According to the eighteenth embodiment, instead of the communicating passage 368, a communicating passage 668 is provided so as to connect the high pressure passage 360 and the passage 361 which communicates the valve chamber 362 and the second control chamber 351. The communicating passage 668 is connected to the passage 361 on a side of the valve chamber 362 with respect to a throttle 601 disposed in the passage 361.

With the construction mentioned above, one of the throttles disposed in the communicating passages from the high pressure passage 360 to the first control chamber 350 may be eliminated as a number from the throttles described according to the fourteenth to sixteenth embodiments.

When the valve element 337 closes the low pressure opening 367 (when the lifting amount of the valve element 337 is zero), fuel supply to the first control chamber 350 becomes smoother due to the one elimination of the throttles so that pressure increase in the first control chamber 350 may become faster. As a result, force acting in a direction of closing the injection hole may be rapidly increased so that the downward speed of the needle 323 becomes faster so as to improve the valve opening response characteristic of the needle 323.

(Nineteenth Embodiment)

A nineteenth embodiment of the present invention is described with reference to FIG. 38. With respect to components and construction substantially same to those of the fourteenth embodiment, to which the same reference numbers are affixed, the explanation thereof is omitted. According to the nineteenth embodiment, a downward speed of the needle 323 is improved by a method different from that described in the eighteenth embodiment.

A difference from the fourteenth embodiment is that a communicating passage 701, through which high pressure fuel is introduced from the high pressure passage 360 to the second control chamber 351, is added.

Figure 38:
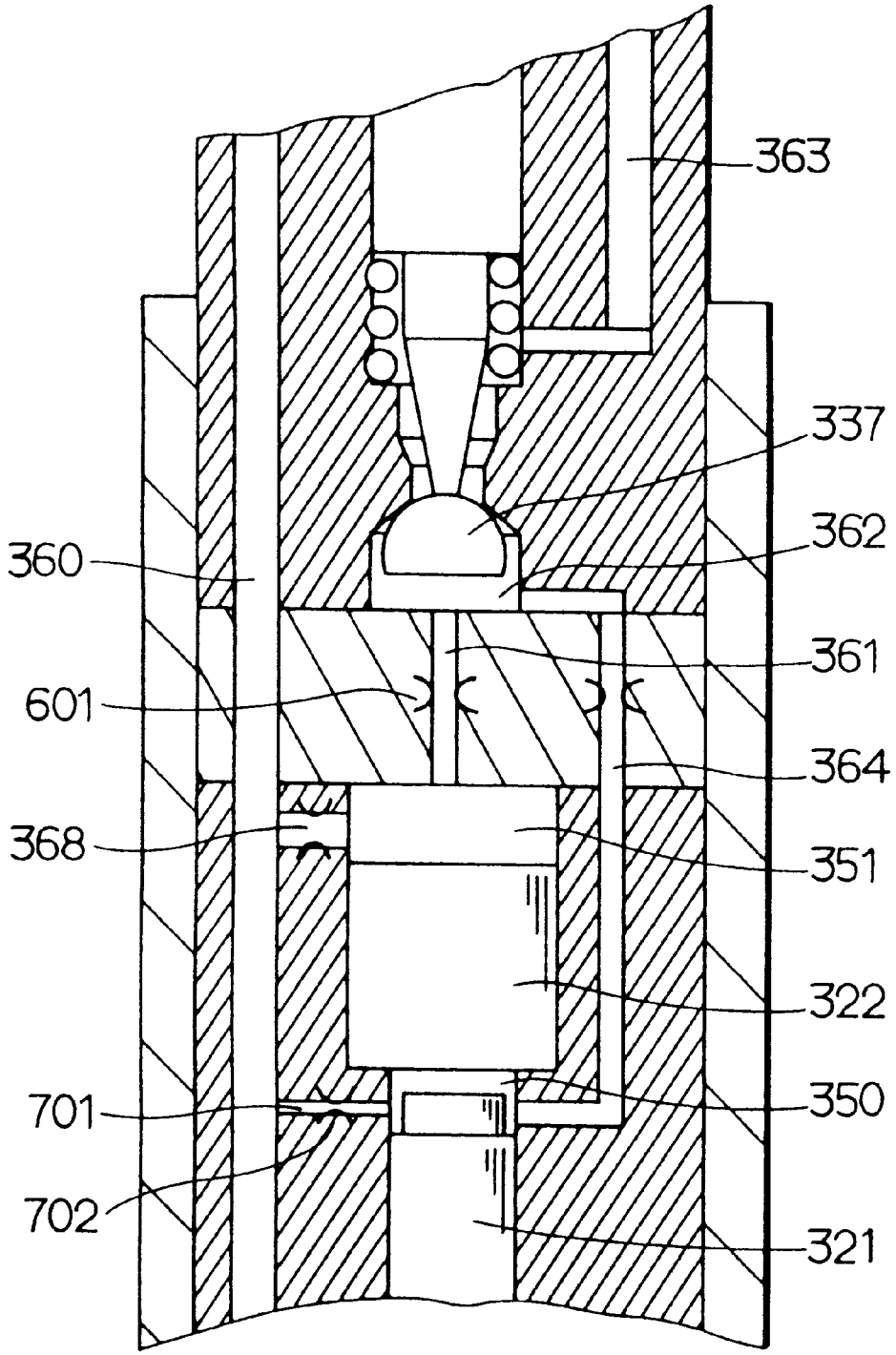
FIG. 38 is a cross sectional part view of an injector according to a nineteenth embodiment.

As shown in FIG. 38, the high pressure passage 360 is communicated via a throttle 702 through the communicating passage 701 to the first control chamber 350. High pressure fuel from the high pressure passage 360 can be introduced to the first control chamber 350 not only through the passage 364 via the valve chamber 362 but also through the passage 701.

Therefore, when the needle 323 closes the injection hole, fuel flow amount to the first control chamber 350 may increase so that pressure increase in the first chamber becomes faster. It is necessary to decide a flow area of the throttle 702 between the high pressure passage 360 and the first control chamber 350 to an extent that fuel leak amount from the high pressure passage 360 to the first control chamber 350 does not increase when the needle 323 closes the injection hole.

(Modification)

Figure 39:
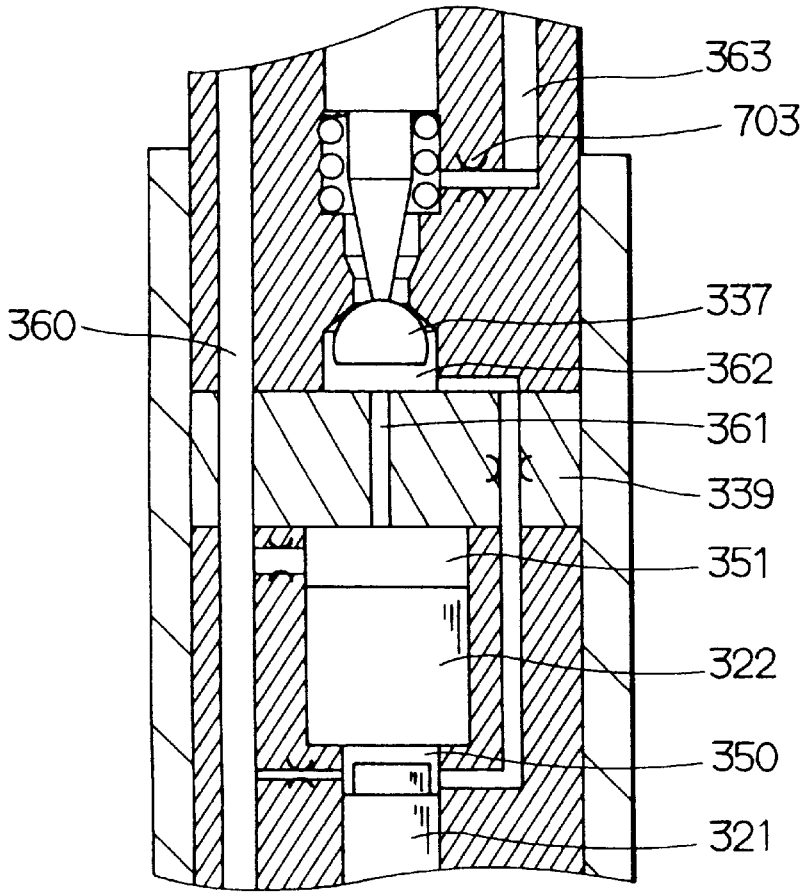
FIG. 39 is a cross sectional part view of an injector according to a modification of the nineteenth embodiment.

According to a modification of the nineteenth embodiment, as shown in FIG. 39, instead of the throttle 601 provided in the passage 361 communicating the valve chamber 362 and the second control chamber 351, a throttle 703 is provided in the low pressure passage 363.

When the valve element 337 lift downward in FIG. 39, high pressure fuel of the second control chamber 351 is released via the passage 361, the valve chamber 362 and the low pressure passage 363. The throttle 703, which is provided on a way of pressure releasing passages, serves to adjust a pressure reducing speed from high pressure to low pressure in the second control chamber 351.

According to the present embodiment, as the throttle 701 is not provided in the passage 361 connecting the high pressure passage 360 to the first control chamber 350, fuel flow amount to the first control chamber 350 may increase, when the needle 323 closes the injection hole, so that pressure increase in the first chamber becomes faster and, thus, the downward speed of the needle 323 may improve.

(Twentieth Embodiment)

A twentieth embodiment of the present invention is described with reference to FIG. 40. With respect to components and construction substantially same to those of the fourteenth embodiment, to which the same reference numbers are affixed, the explanation thereof is omitted. According to the twentieth embodiment, a downward speed of the needle 323 is improved by a method different from that described in the eighteenth or nineteenth embodiment.

A difference from the fourteenth embodiment is that a communicating passage 801, through which high pressure fuel is introduced from the high pressure passage 360 to the second control chamber 351, is added.

Figure 40:
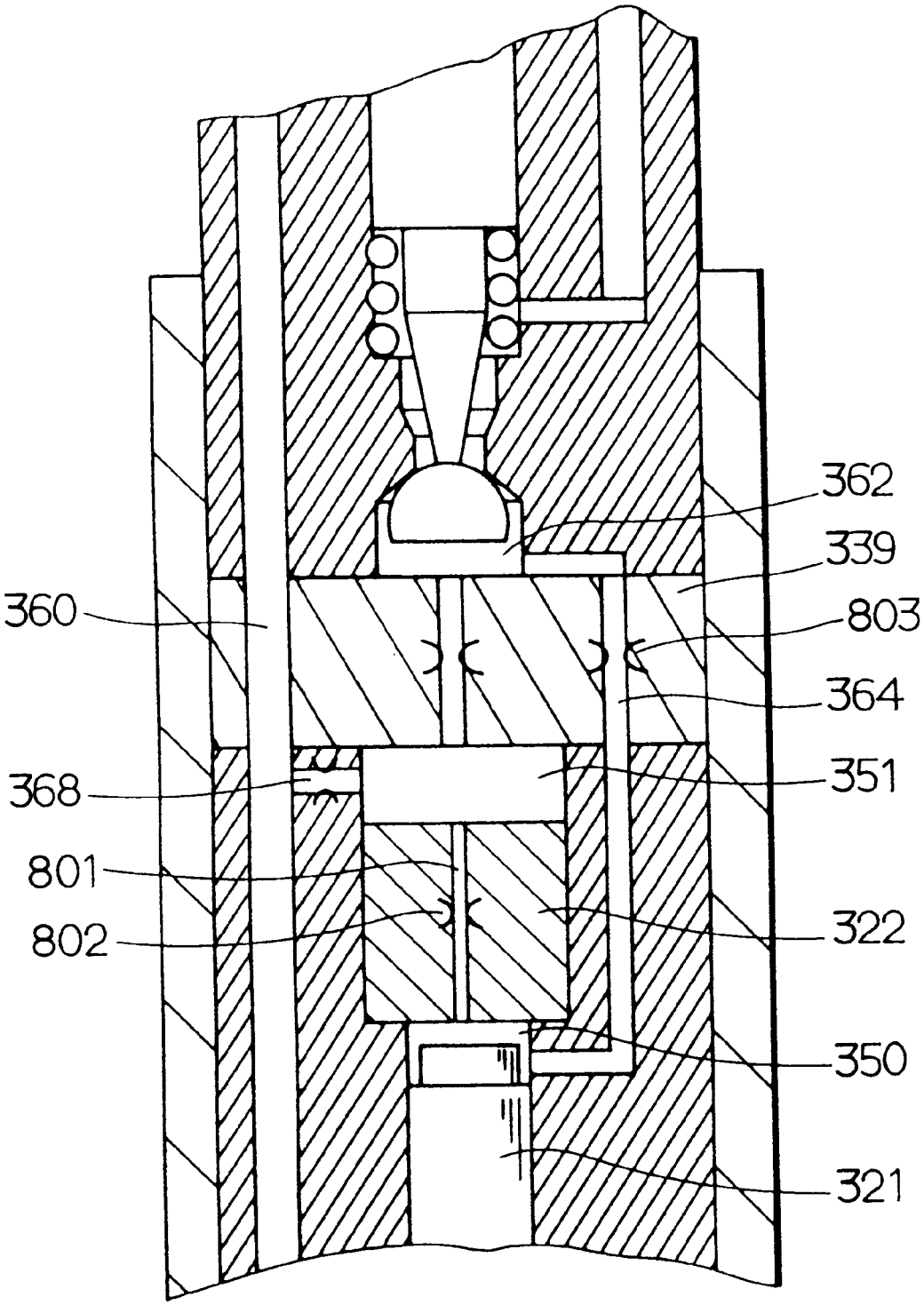
FIG. 40 is a cross sectional part view of an injector according to a twentieth embodiment.
Figure 42:
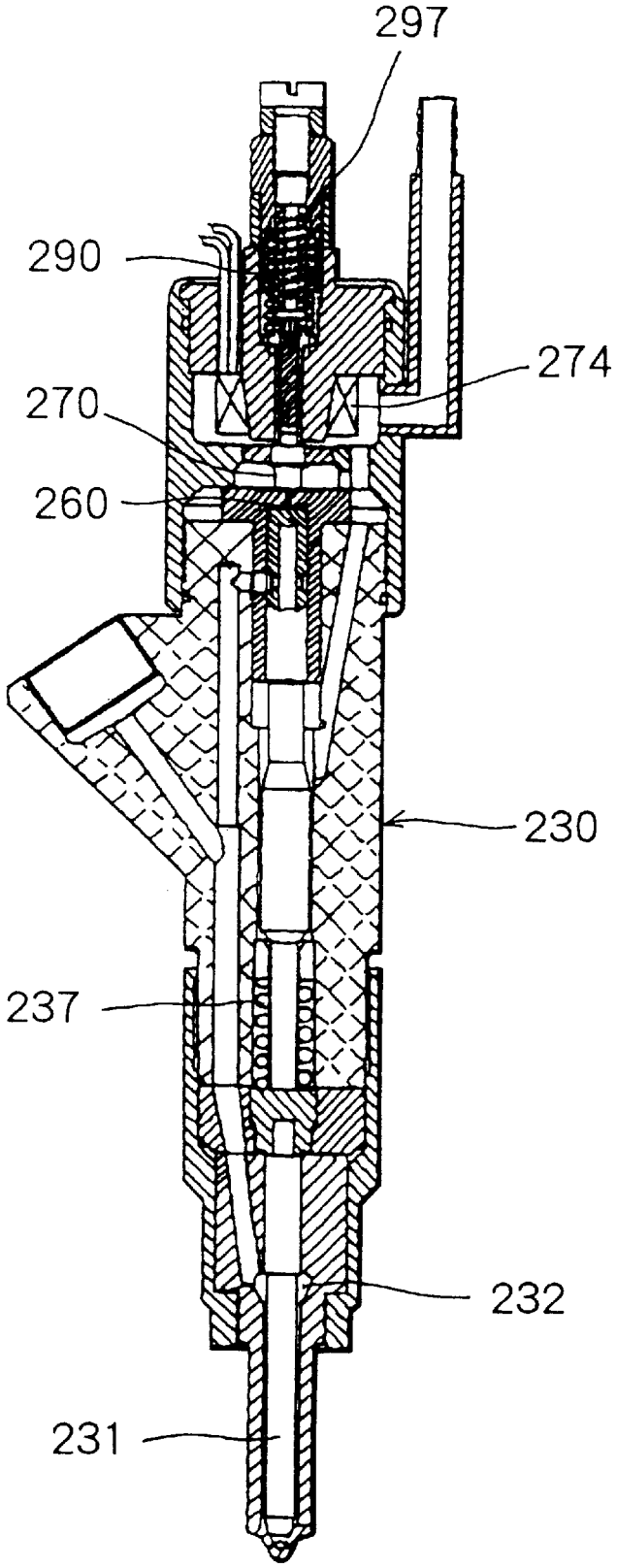
FIG. 42 PRIOR ART
FIG. 42 is a cross sectional view of a conventional injector as a prior art.

As shown in FIG. 40, the first control chamber 350 is communicated via a throttle 802 through a communicating passage 801 provided in the second piston 322 to the second control chamber 351. High pressure fuel from the high pressure passage 360 can be introduced to the first control chamber 350 not only through the passage 364 via the valve chamber 362 but also through the passage 801 via the passage 368 and the second control chamber 351.

Therefore, when the needle 323 closes the injection hole, fuel flow amount to the first control chamber 350 may increase so that pressure increase in the first chamber becomes faster. It is necessary to decide a flow area of the throttle 802 between the high pressure passage 360 and the first control chamber 350 to an extent that fuel leak amount from the second control chamber 351 to the first control chamber 350 does not increase when the needle 323 closes the injection hole.

Further, if the construction according to the twentieth embodiments is combined with those according to the eighteenth and nineteenth embodiments, a downward lifting speed of the needle 323 becomes further faster so that a sharp cut characteristic of the injection rate may much more improve.

According to the twentieth embodiment, a throttle 803 is disposed in the passage 364 provided in the plate 339. The throttle 803 may be provided by forming a long narrow hole in the plate 339 whose diameter is decided to adjust fuel flow amount.

(Modification)

Figure 41:
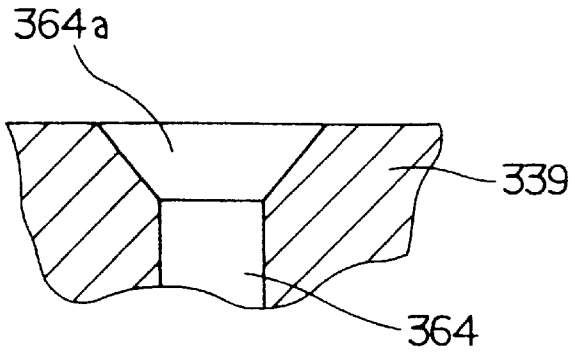
FIG. 41 is a cross sectional view of a throttle of an injector according to a modification of the twentieth embodiment.

FIG. 41 shows a modification of the twentieth embodiment. The communicating passage 364 constituted by the long narrow hole in the plate 339 is provided with a tapered opening 364*a* enlarged without being contracted toward the valve chamber 362. The tapered opening 364*a* on a side of an enlarged portion thereof is opened to the valve chamber 362.

As high pressure fuel from the high pressure passage 360 is introduced to the first control chamber 350 via the second control chamber 351 and the valve chamber 362, the communicating passage for introducing high pressure to the first control chamber 350 becomes relatively long. Accordingly, it takes a longer time before the chamber 350 is highly pressurized. According to the present embodiment, as the tapered opening 364*a* on a side of introducing high pressure fuel is wider, high pressure maybe easily and rapidly introduced to the first control chamber 350.

What is claimed is:

1. A fuel injection device to be communicated with a high pressure conduit and a low pressure conduit comprising:

a valve body having at least an injection hole and a valve seat;

a valve member slidably movable and to be lifted in the valve body in such a way that the injection hole is closed when the valve member is seated on the valve seat and the injection hole is opened when the valve member is away from the valve seat for lifting;

a high pressure fuel passage to be communicated with the high pressure fuel conduit for generating a basic fuel pressure force to urge the valve member in a direction of opening the injection hole;

fuel passages communicated with the high pressure fuel passage and to be communicated with the low pressure fuel conduit;

control valve means disposed in the fuel passages;

biasing means for generating a biasing force to urge the valve member in a direction of closing the injection hole; and a plurality of control chambers disposed in the fuel passages, the respective plurality of control chambers being communicated with the high pressure passage when the control valve means is not actuated and respective fuel pressure in the plurality of control chambers being used as chamber fuel pressure forces to urge the valve member in a direction of closing the injection hole, and the respective control chambers being communicated one after another at different timings to the low pressure conduit to reduce fuel pressure therein when the control valve means is actuated, wherein the valve member may be stepwise lifted to achieve variable fuel injection rate by controlling one after another at different timings the chamber fuel pressure force from selected any one of the plurality of control chambers that is applied to the valve member in order to change a force balance with the basic fuel pressure force and the biasing force that are then applied to the valve member.

2. A fuel injection device according to claim 1, wherein the biasing means comprises a first biasing element for generating first biasing force to urge the valve member in a direction of closing the injection hole irrelevantly to a lifting amount of the valve member and a second biasing element for generating second biasing force to urge the valve member in a direction of closing the injection hole after the valve member has established a predetermined lifting amount.

3. A fuel injection device according to claim 1, wherein the biasing means is a spring.

4. A fuel injection device according to claim 1, wherein the valve member comprises a needle to be seated on the valve seat and a transmitting element provided on an opposite side to the injection hole with respect to the needle for transmitting the biasing force and the chamber fuel pressure forces of the plurality of control chambers to the needle.

5. A fuel injection device according to claim 4, wherein the transmitting element comprises any one of an element integrated into one body having a plurality of cross sectional areas, whose largeness are different from each other, for receiving respective fuel pressure from the plurality of control chambers, and an element separated into a plurality of bodies having respective cross sectional areas, whose largeness are different from each other, for receiving fuel pressure respectively from the plurality of control chambers.

6. A fuel injection device according to claim 4, wherein the transmitting element has separated areas for receiving fuel pressure from the respective plurality of control chambers.

7. A fuel injection device according to claim 6, wherein the plurality of control chambers are formed on an axis same as that of the transmitting element.

8. A fuel injection device according to claim 2, wherein the biasing means is located at least in one of the plurality of control chambers.

9. A fuel injection device according to claim 1, wherein, an area of the valve member which receives fuel pressure from selected any of the plurality of control chambers for producing the chamber fuel pressure force is larger than an area of the valve member which receives fuel pressure from the high pressure passage for generating the main fuel pressure force, when the valve member is seated on the valve seat, and the area of the valve member which receives fuel pressure from selected any of the plurality of control chambers for producing the chamber fuel pressure force becomes smaller than the area of the valve member which receives fuel pressure from the high pressure passage for generating the main fuel pressure force, when the valve member lifts in a direction away from the valve seat.

10. A fuel injection device according to claim 1, wherein the control valve means has a control valve for controlling fuel pressure in the selected any of the plurality control chambers according to engine operating conditions.

11. A fuel injection device according to claim 10, wherein the control valve has a plurality of moving members which are operative to open and close fuel passages on a side of the low pressure conduit with respect to the respective plurality of control chambers.

12. A fuel injection device according to claim 11, wherein the plurality of moving members are electrically actuated.

13. A fuel injection device according to claim 11, wherein the plurality of moving members are provided on a common axis and have control valve springs for biasing the respective plurality of moving members in a direction of closing the fuel passages to be communicated to the low pressure conduit, the plurality of moving members being operative at respective different timings to open the fuel passages on a side of the low pressure conduit with respect to the plurality of control chambers against the biasing forces of the control valve springs.

14. A fuel injection device according to claim 13, wherein the plurality of the control chambers comprise first and second control chambers for producing the chamber fuel pressure forces to urge the valve member in a direction of closing the injection hole, and the plurality of the control valve means comprise first and second moving members and first and second control valve springs, the first moving member being slidably and reciprocatingly held in the second moving member in such a manner that, at first, the first moving member comes in contact with the second moving member in a predetermined lifting stroke after the first moving member moves to open the fuel passage on a side of the low pressure conduit with respect to the first control chamber and, then, the first moving member together with the second moving member further moves so that the fuel passage on a side of the low pressure conduit with respect to the second control chamber may be opened by the second moving member.

15. A fuel injection device according to claim 1, wherein the transmitting element has at least first and second pistons separated from each other, one of the control chambers being formed between an end of the first piston and an end of second piston and another of the control chambers being formed on another end of the second piston so that chamber fuel pressure force of the another of the control chambers may be fully applied to the needle for urging the same in a direction of closing the injection hole after the first piston has come in contact with the second piston by reducing fuel pressure in the one of control chambers.

16. A fuel injection device according to claim 1, wherein the valve member establishes a first lifting amount in at least one of a low to middle speed range and a low to middle load range as engine operating conditions, and a second lifting amount larger than the first lifting amount in at least one of a high speed range and a high load range as engine operating conditions.

17. A fuel injection device according to claim 16, wherein the valve member changes stepwise a lifting amount from the first lifting amount to the second lifting amount within a fuel injection period when the engine operating conditions show one of a change from the low speed range to the high speed range and a change from the low load range to the high load range.

18. A fuel injection device according to claim 1, wherein the valve member is moved to inject fuel with optimum numbers of injections in a cycle of engine and in an optimum lifting state of the valve member and for an optimum injection period in each injection, when engine operating conditions are changed from one to another.

19. A fuel injection device according to claim 1, wherein the valve member is moved to inject fuel with optimum numbers of injections in a cycle of engine and in an optimum lifting state of the valve member during whole ranges of engine operating conditions.

20. A fuel injection device according to claim 1, wherein the plurality of control chambers comprise first and second control chambers, the second control chamber being communicated with the high pressure passage, the valve member comprises a needle to be seated on the valve seat and first and second pistons for forming the first and second control chambers on an opposite side to the injection hole with respect to the needle for transmitting the chamber fuel pressure forces from the first and second control chambers to the needle, and the control valve means has a valve chamber formed in the fuel passages, a control valve movable in the valve chamber and an electrically controlled device for driving stepwise the control valve, the valve chamber having a first opening communicated with the fuel passage leading to the first control chamber, a second opening communicated with the fuel passage leading to the second control passage and a low pressure opening to be communicated to the low pressure conduit, whereby a fuel communication between the first and low pressure openings and a fuel communication between the second and low pressure openings are sequentially controlled by the stepwise moving of the control valve so that the chamber fuel pressure forces of the first and second control chambers may be changed.

21. A fuel injection device according to claim 20, wherein the first control chamber is formed between an end of the first piston on an opposite side of the needle and an end of the second piston, and the second control chamber is formed on another end of the second piston in such a manner that, at first, the first piston lifts and comes in contact with the second piston by reducing the chamber fuel pressure force of the first control chamber and the first piston further lifts together with the second piston by reducing the chamber fuel pressure force of the second control chamber.

22. A fuel injection device according to claim 20, wherein the control valve closes the low pressure opening when the electrically controlled device is not actuated, the control valve opens the low pressure opening when the electrically controlled device is actuated to drive the control vale during a first lifting stroke so that the first and second control chambers may be communicated to the low pressure conduit, the control valve closes the second control chamber when the electrically controlled device is further actuated to drive the control valve during a second lifting stroke so that the communication of the second control chamber to the low pressure conduit may be interrupted, while the communication of the first control chamber via the valve chamber to the low pressure conduit may be maintained.

23. A fuel injection device according to claim 20, wherein the biasing means comprises a first biasing element for generating first biasing force to urge the valve member in a direction of closing the injection hole irrelevantly to a lifting amount of the valve member and a second biasing element for generating second biasing force to urge the valve member in a direction of closing the injection hole after the valve member has established a predetermined lifting amount.

24. A fuel injection device according to claim 20, wherein the low pressure opening is closed when the control valve is at a position in the valve chamber most near the electrically control device.

25. A fuel injection device according to claim 20, wherein the fuel passage between the second control chamber and the second opening is provided with a first throttle for regulating fuel flow and with the fuel passage for communicating the second control chamber to the high pressure passage on a side of the second control chamber relative to the first throttle.

26. A fuel injection device according to claim 20, wherein the fuel passage for communicating the first control chamber to the high pressure passage is provided with a second throttle for regulating fuel flow.

27. A fuel injection device according to claim 20, wherein the fuel passage between the first and second control chambers is provided with a third throttle for regulating fuel flow.

28. A fuel injection device according to claim 20, wherein the fuel passage between the second opening and the second control chamber is provided with a tapered opening portion enlarged toward the second opening.

29. A fuel injection device according to claim 20, wherein the fuel passage between the low pressure opening and the low pressure conduit is provided with a fourth throttle for regulating the fuel flow through the fuel passage between the high pressure passage and the first control chamber.

30. A fuel injection device according to claim 1, wherein the plurality of control chambers comprise first and second control chambers, the first control chamber being communicated to the high pressure passage, the valve member comprises a needle to be seated on the valve seat and first and second pistons for forming the first and second control chambers, the first control chamber being formed between an end of the first piston on an opposite side of the needle and an end of the second piston and the second control chamber being formed on another end of the second piston and being provided therein with a stopper for limiting a lifting stroke of the second piston, and the control valve means has a valve chamber formed in the fuel passages, a control valve movable in the valve chamber and an electrically controlled device for driving stepwise the control valve, the valve chamber having a first opening communicated with the fuel passage leading to the first control chamber, a second opening communicated with the fuel passage leading to the second control passage and a low pressure opening to be communicated to the low pressure conduit, whereby the control valve closes the low pressure opening when the electrically controlled device is not actuated, resulting in that the first and second pistons do not move, the control valve opens the low pressure opening when the electrically controlled device is actuated to drive the control vale during a first lifting stroke so that the first and second control chambers may be communicated to the low pressure conduit, resulting in that the first and second pistons move a second lifting amount until the second piston is stopped by the stopper and the first piston comes in contact with the second piston, and the control valve closes the second opening when the electrically controlled device is further actuated to drive the control valve during a second lifting stroke so that the communication of the first control chamber to the low pressure conduit may be interrupted, while the communication of the second control chamber via the valve chamber to the low pressure conduit may be maintained, resulting in that the second piston moves a first lifting amount until the second piston is stopped by the stopper.

31. A fuel injection device according to claim 20, wherein the electrically controlled device has a electromagnetic coil for driving the control valve.

32. A fuel injection device according to claim 20, wherein the electrically controlled device has a piezo actuator for driving the control valve.

* * * * *